US009708782B2

(12) United States Patent
Houle et al.

(10) Patent No.: US 9,708,782 B2
(45) Date of Patent: Jul. 18, 2017

(54) SNOWBLOWER AUGER

(71) Applicant: IMMEUBLES MFP 1006 INC., Wickham (CA)

(72) Inventors: Pascal Houle, Wickham (CA); Gaston Houle, Wickham (CA)

(73) Assignee: IMMEUBLES MFP 1006 INC., Wickham (CA)

( * ) Notice: Subject to any disclaimer, the term of this patent is extended or adjusted under 35 U.S.C. 154(b) by 67 days.

(21) Appl. No.: 14/639,586

(22) Filed: Mar. 5, 2015

(65) Prior Publication Data

US 2015/0252544 A1 Sep. 10, 2015

Related U.S. Application Data

(60) Provisional application No. 61/988,959, filed on May 6, 2014, provisional application No. 61/948,911, filed on Mar. 6, 2014.

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC .. E01H 5/04; E01H 5/045; E01H 5/08; E01H 5/09; E01H 5/098
See application file for complete search history.

(56) References Cited

U.S. PATENT DOCUMENTS 1,698,901 A 1/1929 Zinn
2,219,204 A 10/1940 Wandscheer
2,387,423 A * 10/1945 Venable ..... E01H 5/09 37/249
2,642,680 A * 6/1953 Curtis ..... E01H 5/04 193/16
2,692,445 A 10/1954 Darnell
(Continued)

FOREIGN PATENT DOCUMENTS

CA 998919 10/1976
CA 1065904 11/1979
(Continued)

OTHER PUBLICATIONS

Souffleuse à neige Max-Twin, Mar. 5, 2014, Agrimetal, Wickham (QC), Canada.
(Continued)

*Primary Examiner* — Jamie L McGowan
(74) *Attorney, Agent, or Firm* — Mathieu Audet

(57) ABSTRACT

A snowblowing apparatus that is including an auger with a plurality of snow shovel members is herein presented, the snowblowing apparatus is further including an auger including an axle and a screw member configured to rotate about an axis of rotation thereof, the screw member having two opposed screw member portions for displacing snow toward a snow-blowing mechanism and a plurality of snow shovel members substantially disposed between the two opposed screw member portions and radially secured on a peripheral support about the axis of rotation, the snow shovel members can also be disposed at an angle thereof to provide a vertical component to snow propelled therewith.

19 Claims, 52 Drawing Sheets

(56) References Cited

U.S. PATENT DOCUMENTS 2,714,772 A * 8/1955 Erickson ..... E01H 5/04 172/121
2,732,638 A 1/1956 Leufvenius
3,081,565 A * 3/1963 Varnum ..... E01H 5/08 37/238
3,085,832 A 4/1963 Guillemette
3,115,714 A 12/1963 Johann
3,131,491 A 5/1964 Durrschmidt
3,244,271 A * 4/1966 Wenning ..... A01D 61/004 198/669
3,484,962 A 12/1969 Klaprodt
3,603,008 A * 9/1971 Heth ..... E01H 5/098 198/513
3,673,715 A 7/1972 Lines
3,736,674 A 6/1973 Enters
3,774,321 A * 11/1973 David ..... E01H 5/04 37/243
3,780,455 A 12/1973 Stevenson
3,862,539 A * 1/1975 Stevens ..... A01G 23/093 37/258
4,023,287 A * 5/1977 de Brito ..... E01H 5/04 37/231
4,062,135 A 12/1977 Dobberpuhl
4,068,397 A 1/1978 Bacon
4,123,857 A 11/1978 Enters
4,184,274 A 1/1980 Vohl
4,203,237 A * 5/1980 Enters ..... E01H 5/04 198/659
4,261,116 A 4/1981 Kahlbacher
4,288,933 A 9/1981 Fair
D262,797 S 1/1982 Arthur
4,322,896 A * 4/1982 Miyazawa ..... E01H 5/04 37/233
4,325,195 A * 4/1982 Comer ..... E01H 5/045 37/227
D269,092 S 5/1983 Davies, III
4,409,748 A 10/1983 Westimayer
4,418,485 A 12/1983 Herren
4,457,086 A 7/1984 Bacon
4,477,989 A 10/1984 Vachon
4,480,397 A 11/1984 Vachon
4,541,187 A 9/1985 Phelps
4,592,156 A 6/1986 Schmidt
4,597,203 A 7/1986 Middleton
4,619,061 A 10/1986 Swanson
4,852,279 A * 8/1989 Gerbrandt ..... E01H 5/045 198/676
4,869,003 A 9/1989 O'Loughlin
D307,912 S * 5/1990 Yoshida ..... D15/12
5,018,592 A 5/1991 Buchdrucker
5,090,142 A 2/1992 Peters
5,101,585 A * 4/1992 Gerbrandt ..... E01H 5/04 37/249
5,113,610 A * 5/1992 Liebrecht, Jr. ..... A01B 13/00 37/189
5,123,186 A 6/1992 Matushita
5,127,174 A 7/1992 Takeshita
5,209,003 A * 5/1993 Maxfield ..... E01H 5/098 37/249
5,398,431 A * 3/1995 Beihoffer ..... E01H 5/098 37/247
5,438,770 A 8/1995 Miller
5,479,730 A 1/1996 Gogan
5,570,996 A 11/1996 Smiley, III
5,603,173 A 2/1997 Brazell
5,813,152 A 9/1998 Weight
D408,950 S 4/1999 Basham
5,915,835 A 6/1999 Fair
6,058,629 A 5/2000 Peterson
6,154,985 A 12/2000 Champagne
6,318,003 B1 11/2001 Heismann
6,327,798 B1 * 12/2001 Sakai ..... E01H 5/04 37/249
6,336,280 B1 * 1/2002 Haigh ..... E02F 3/183 37/352
D457,171 S 5/2002 Fowler
6,578,292 B2 6/2003 Dowe
6,624,477 B1 9/2003 Takemura
6,662,477 B2 12/2003 Dowe
6,865,826 B1 3/2005 Lakin
6,938,364 B2 9/2005 White, III
7,121,021 B2 10/2006 Sakai
7,703,223 B2 * 4/2010 Walker ..... E01H 5/045 37/244
7,735,246 B2 6/2010 Kaskawitz
7,866,068 B2 1/2011 Van Buren
7,971,695 B2 7/2011 Vaughn
8,065,823 B2 11/2011 Morrell
8,544,856 B2 10/2013 Sayre
8,584,383 B1 11/2013 Morse
D705,271 S 5/2014 Cmich
D705,272 S 5/2014 Cmich
D737,335 S 8/2015 Cmich
9,096,980 B2 8/2015 Ricketts
9,096,981 B2 8/2015 Wians
9,279,222 B2 3/2016 Gerrits
9,309,638 B2 * 4/2016 Gilpatrick ..... E01H 5/045
2002/0108274 A1 8/2002 Dowe
2003/0033736 A1 2/2003 Fortin
2003/0154632 A1 8/2003 Dowe
2003/0159317 A1 8/2003 Dowe
2004/0172860 A1 9/2004 Sakai
2004/0255492 A1 12/2004 White, III
2005/0241190 A1 11/2005 Kettering
2006/0225309 A1 10/2006 Champagne
2009/0159392 A1 6/2009 Vaughn
2009/0223089 A1 9/2009 Kaskawitz
2009/0293321 A1 12/2009 Walker
2010/0236106 A1 9/2010 Muscarella
2010/0281718 A1 11/2010 Van Buren
2011/0146112 A1 6/2011 Morrell
2012/0074662 A1 3/2012 Sayre
2012/0180346 A1 7/2012 Gerrits
2012/0192464 A1 8/2012 Winter
2013/0291411 A1 11/2013 Cmich
2013/0291412 A1 11/2013 Cmich
2014/0090278 A1 4/2014 Ricketts
2014/0096418 A1 4/2014 Kaskawitz
2014/0215863 A1 8/2014 Wians
2014/0237863 A1 8/2014 Winter
2014/0237864 A1 * 8/2014 Gilpatrick ..... E01H 5/045 37/259
2015/0184358 A1 * 7/2015 Berndt ..... E21O 50/00 37/318
2015/0252542 A1 9/2015 Houle
2016/0138241 A1 * 5/2016 Thompson ..... E02F 3/3654 37/352

FOREIGN PATENT DOCUMENTS

| | | |
|---|---|---|
| CA | 1187909 | 5/1985 |
| CA | 1189882 | 7/1985 |
| CA | 1195704 | 10/1985 |
| CA | 2215457 | 3/1999 |
| CA | 2225196 | 6/1999 |
| CA | 2239744 | 12/1999 |
| CA | 2240436 | 5/2000 |
| CA | 2371704 | 7/2003 |
| CA | 2541044 | 9/2006 |
| CA | 2690821 | 7/2011 |
| EP | 0198155 | 10/1986 |
| EP | 2712963 | 4/2014 |
| WO | WO2013154676 | 10/2013 |

OTHER PUBLICATIONS

Souffleuse à neige Max-Snow, Mar. 5, 2014, Agrimetal, Wickham (QC), Canada.

Econor souffleuses à neige, Mar. 5, 2014, La Compagnie Normand Ltée, Saint-Pascal (QC), Canada.

(56) References Cited

OTHER PUBLICATIONS

Souffleuse à neige Pronovost, Mar. 5, 2014, Pronovost, Canada.
Supplementary European search report, Mar. 15, 2011, European Patent Office, The Hague.

* cited by examiner

SNOWBLOWER AUGER

CROSS-REFERENCES

The present application is a nonprovisional of, and claims priority under 35 U.S.C. 119(e) to, U.S. provisional patent application No. 61/948,911, filed Mar. 6, 2014, entitled SNOWBLOWER, and to U.S. provisional patent application No. 61/988,959, filed May 6, 2014, entitled SNOWBLOWER, which are both incorporated herein by reference in their entireties. Any publication of and any patent issuing from the foregoing U.S. patent applications is hereby incorporated herein by reference.

BACKGROUND OF THE INVENTION

1. Field of the Invention

This invention generally relates to an apparatus for blowing snow. The present invention more specifically relates to a member of a snowblower that is adapted to manage snow in front of the snowblower prior to blow the snow. The present invention also relates to other features adapted to improve the efficiency of a snowblower.

2. Description of the Related Art

Apparatuses for removing snow come in various configurations. They come in small size for personal snowblowers and they reach significant sizes in industrial applications. Generally, snowblowers are designed to remove snow, ice, and sometimes other debris, from the ground and propel the snow and ice at a distance to clear the ground.

Snowblowers can use different mechanical configurations to perform the required task. Some snowblowers are using an endless screw, an auger, in front of the apparatus to break the snow and the ice in smaller portions, in a first stage, and then use a rotatable impeller to propel the snow and the ice at a distance from the snowblower, in a second stage. The distance and the direction are managed with a directional nozzle. The snowblower can be powered in different ways, generally with an engine via a drive member. The engine can be part of the snowblower in some configurations. A vehicle carrying the snowblower can alternatively provide power to the snowblower in other configurations.

The rotatable impeller generally includes a series of vanes or blades sized and designed to receive thereon snow and ice. Rotation of the blades is propelling the snow and the ice. The blades are generally equipped with a knife portion to cut through snow and ice. The blades are generally disposed on the snow contacting edge of the impeller to propel the snow. The snow is generally pushed toward the exterior diameter of the impeller when propelled by the rotating impeller, subjected to centrifugal forces.

The auger rotates to manage snow in front of the snowblower. Snow and ice are broken in small fragments in front of the snowblower by the auger. The rotating auger moves the snow toward the center of the snowblower to be introduced in the snow-blowing mechanism and propelled by the impeller. The auger help direct the snow in the snow-blowing mechanism although is it difficult to collect all the snow by the snowblower, particularly when there is little snow left on the ground.

It is therefore desirable to provide an improved snowblower auger over the existing art.

It is also desirable to provide an improved auger over the existing art that is adapted to ingest and propel more snow in the snowblower.

It is equally desirable to provide an improved auger design over the existing art to keep as much snow in the center of the auger as possible and prevent snow axially pulled from one longitudinal side of the auger to the opposite side of the auger.

It is desirable to provide an improved auger design over the existing art that includes a plurality of blades rotating in the center of the auger to collect and propel more snow in the snowblower.

Other deficiencies will become apparent to one skilled in the art to which the invention pertains in view of the following summary and detailed description with its appended figures.

SUMMARY OF THE INVENTION

One aspect of the present invention is to alleviate one or more of the shortcomings of the background art by addressing one or more of the existing needs in the art.

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The invention is generally described as an improved impeller for a snowblower having improved snow-blowing capability and other improvements thereof as described below.

The invention is generally described as a self-powered snowblower having improved snow-blowing capability and other improvements thereof caused, at least in part, by an improved design of the auger as described below.

The invention is generally described as a vehicle including a snowblower having improved snow-blowing capability and other improvements thereof caused, at least in part, by an improved design of the auger as described below.

The invention is generally described as a method of propelling snow and other materials by a snow blower having improved snow blowing capability and other improvements thereof caused, at least in part, by an improved design of the auger as described below.

The invention is generally described as a method of propelling snow and other materials carried on by a vehicle including a snowblower having improved snow blowing capability and other improvements thereof caused, at least in part, by an improved design of the auger as described therein.

The invention is generally described as an auger in a snowblower although it encompasses a replacement auger for existing snowblowers, the replacement auger having improved snow-blowing capability and other improvements thereof caused, at least in part, by an improved design of the auger as described below.

Aspects of our work, in accordance with at least one embodiment of the invention, provide an improved snowblower snow-collecting performance over the existing art.

Aspects of our work, in accordance with at least one embodiment of the invention, provide an auger including a plurality of snow shovel members adapted to propel snow and ice.

Aspects of our work, in accordance with at least one embodiment of the invention, provide an auger including a central member adapted to secure thereon a plurality of snow shovel members.

Aspects of our work, in accordance with at least one embodiment of the invention, provide an auger including a central member adapted to separate snow axially moved toward the center of the auger.

Aspects of our work, in accordance with at least one embodiment of the invention, provide an auger including a plurality of snow shovel members disposed at an angle thereof to direct snow in a direction having a vertical component when propelling the snow in a direction opposed to the snowblower.

Aspects of our work, in accordance with at least one embodiment of the invention, provide a central member having a continuous periphery that can contact a foreign object by slipping thereon without "biting" the foreign with an edge.

Aspects of our work, in accordance with at least one embodiment of the invention, provide an auger including snow shovel members securing an end of the screw of the auger.

Aspects of our work, in accordance with at least one embodiment of the invention, provide a snow shovel member secured to the screw-like tooth member that is sized and designed to push snow from the ground in front of the opening of the snow-blowing mechanism, about the center of the screw-like tooth member, and that is limiting or preventing pushing snow in the opposite direction in front of the snowblower.

Aspects of our work, in accordance with at least one embodiment of the invention, provide a snow shovel member secured to the screw-like tooth member that does not extend from the rotating axle to improve the efficiency of the snow shovels to shovel snow toward the snow-blowing mechanism while shoveling less or no snow in the opposite direction in front of the snowblower.

Aspects of our work, in accordance with at least one embodiment of the invention, provide a snow shovel that is parallel with the rotating axle and reduce the axial length of the screw-like tooth member.

Aspects of our work, in accordance with at least one embodiment of the invention, provide an angled snow shovel, in respect with the ground, that is compact and does not extend from the rotating axle to improve the efficiency of the snow shovels to shovel snow toward the snow-blowing mechanism while shoveling less or no snow in the opposite direction.

Aspects of our work, in accordance with at least one embodiment of the invention, provide a pair of snow shovel members connected on a lateral distal side thereof to the screw-like tooth member and to a radial member that has a reduced area that limits or preclude its snow shoveling capability when rotating with the screw-like tooth member.

Aspects of our work, in accordance with at least one embodiment of the invention, provide a pair of snow shovel member connected on a lateral distal side thereof to the screw-like tooth member and to a radial member in a position that is substantially parallel with the rotating axle, the pair of snow shovel members being angled in respect with the ground when passing near the ground to shovel snow toward the snow-blowing mechanism in a rotational movement toward the snow-blowing mechanism while having less shoveling capacity when moving away from the snow-blowing mechanism.

Aspects of our work, in accordance with at least one embodiment of the invention, provide a pair of opposed and radially extended snow shovels connected on a radial distal side thereof to the screw-like tooth member and to the rotating axle on a proximal radial side thereof, the pair of snow shovel members being angled in respect with the ground when passing near the ground to shovel snow toward the ground and toward the snow-blowing mechanism with a rotational movement screw-like tooth member toward the snow-blowing mechanism while having less shoveling capacity when moving away from the snow-blowing mechanism.

Aspects of our work, in accordance with at least one embodiment of the invention, provide a replacement screw-like tooth member, rotating axle and/or snow shovels adapted to be retrofitted on an existing snowblower. The replacement parts can be sold individually or collectively as a kit without departing from the scope of the present invention.

Aspects of our work, in accordance with at least one embodiment of the invention, provide a snowblower comprising an auger including an axle and a screw member configured to rotate about an axis of rotation thereof, the screw member having two opposed screw member portions for displacing snow toward a snow-blowing mechanism; and at least three snow shovel members, substantially disposed between the two opposed screw member portions, radially secured on a peripheral support about the axis of rotation.

Aspects of our work, in accordance with at least one embodiment of the invention, provide an auger for a snowblower comprising an axle and a screw member configured to rotate about an axis of rotation thereof, the screw member having two opposed screw member portions for displacing snow toward a snow-blowing mechanism; and at least three snow shovel members, substantially disposed between the two opposed screw member portions, radially secured on a peripheral support about the axis of rotation.

Aspects of our work, in accordance with at least one embodiment of the invention, provide a snow shovel members kit for an auger for a snowblower, the kit comprising at least three snow shovel members adapted to be substantially disposed on an auger, between two opposed screw member portions thereof, and radially secured on a peripheral support substantially located about the axis of rotation.

Additional and/or alternative features, aspects, and advantages of embodiments of the present invention will become apparent from the following description, the accompanying drawings, and the appended claims.

DESCRIPTION OF EMBODIMENT(S) OF THE INVENTION

Our work is now described with reference to the figures. In the following description, for purposes of explanation, numerous specific details are set forth in order to provide a thorough understanding of the present invention by way of embodiment(s). It may be evident, however, that the present invention may be practiced without these specific details.

Figure 1:
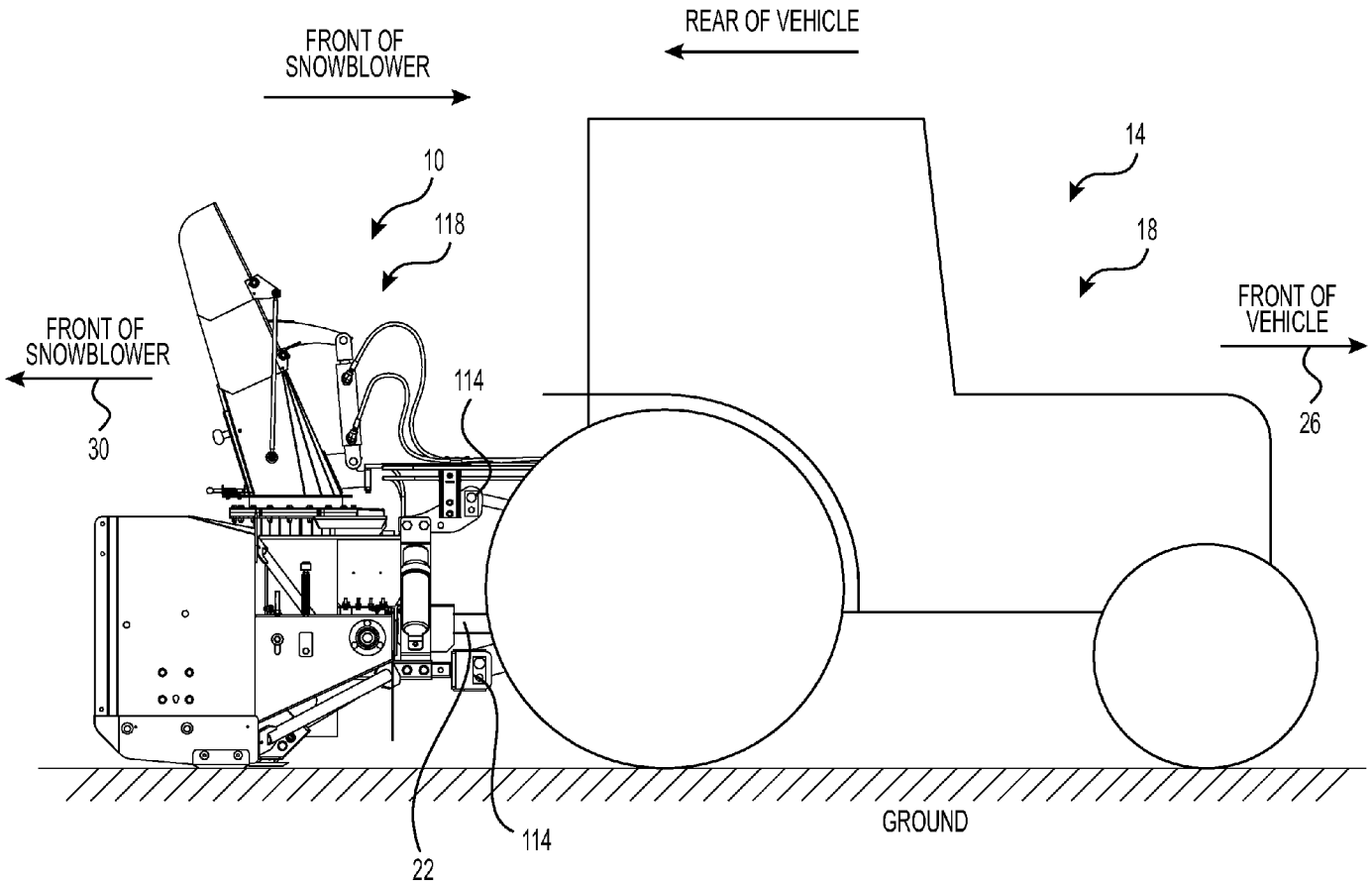
FIG. 1 is an illustration of an exemplary snowblower operatively attached at the back of a vehicle.

A snowblower 10 driven and powered by a vehicle 14 is illustrated in FIG. 1. In the present situation, the vehicle 14 is a schematically illustrated tractor 18 that is powering the snowblower 10 with its power take off (PTO) 22. The tractor 18 has a front side 26 and is driven in reverse to remove snow from the ground with the snowblower 10. The snowblower 10 thus has a front side 30 that is opposed to the tractor's front side 26 in the illustrated configuration. The snowblower 10 could alternatively be secured to the tractor 18 in the opposite direction causing the snowblower's front side 30 to be in the same direction as the tractor's front side 26 (not illustrated) without departing from the scope of the present invention. The snowblower 10 could also alternatively be located in front of the tractor 18 (not illustrated) without further departing from the scope of the invention. In the latter configuration, the front of the snowblower 10 would be in the same direction as the front of the tractor 18. The snowblower 10 could also be located in front of the tractor 18 with the snowblower's 10 front toward the rear of the tractor 18 (not illustrated).

Figure 2:
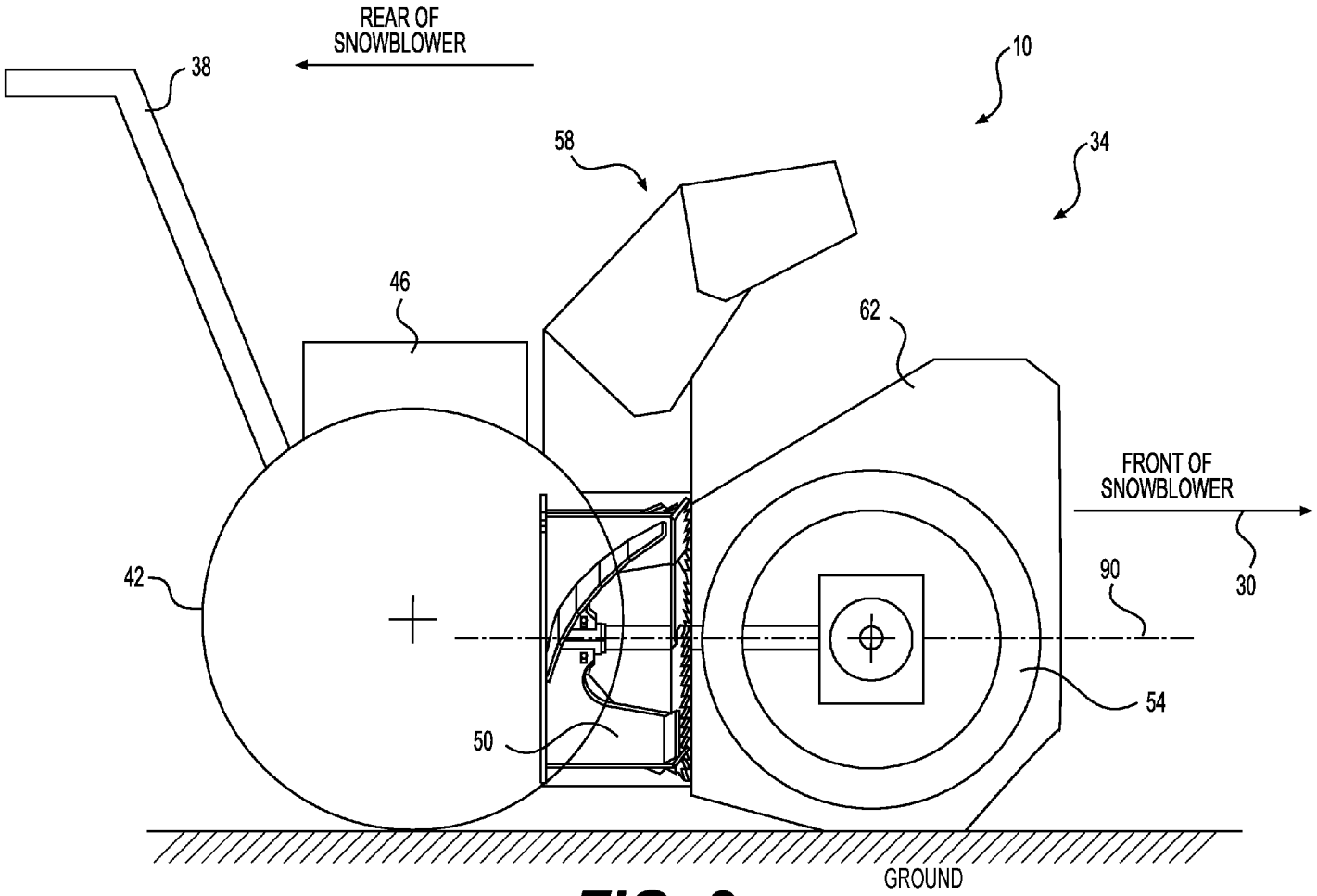
FIG. 2 is a side elevational view of a manually operated snowblower, in accordance with at least one embodiment thereof r.

A snowblower 10 of a different configuration is illustrated in FIG. 2. The self-powered snowblower 34 illustrated in FIG. 2 generally refers to personal snowblowers 10. The snowblower 34 generally includes a pair of handles 38 for a user to grasp to operate the snowblower 10, a pair of wheels 42, an engine 46 driving the wheels 42, an impeller 50 and a screw 54 located in front of the snowblower 34 to manage the snow introduced in the impeller 50. A snow-directing mechanism 58 operatively associated with the impeller 50 is located above the impeller 50.

The text that follows is going to describe a snowblower in the configuration illustrated in FIG. 1 to facilitate the reading of the text. The focus put on the snowblower in the configuration illustrated in FIG. 1 is not intended to disclaim any rights associated with snowblowers 10, 34 of different configurations, even if not expressly described therein.

Figure 3:
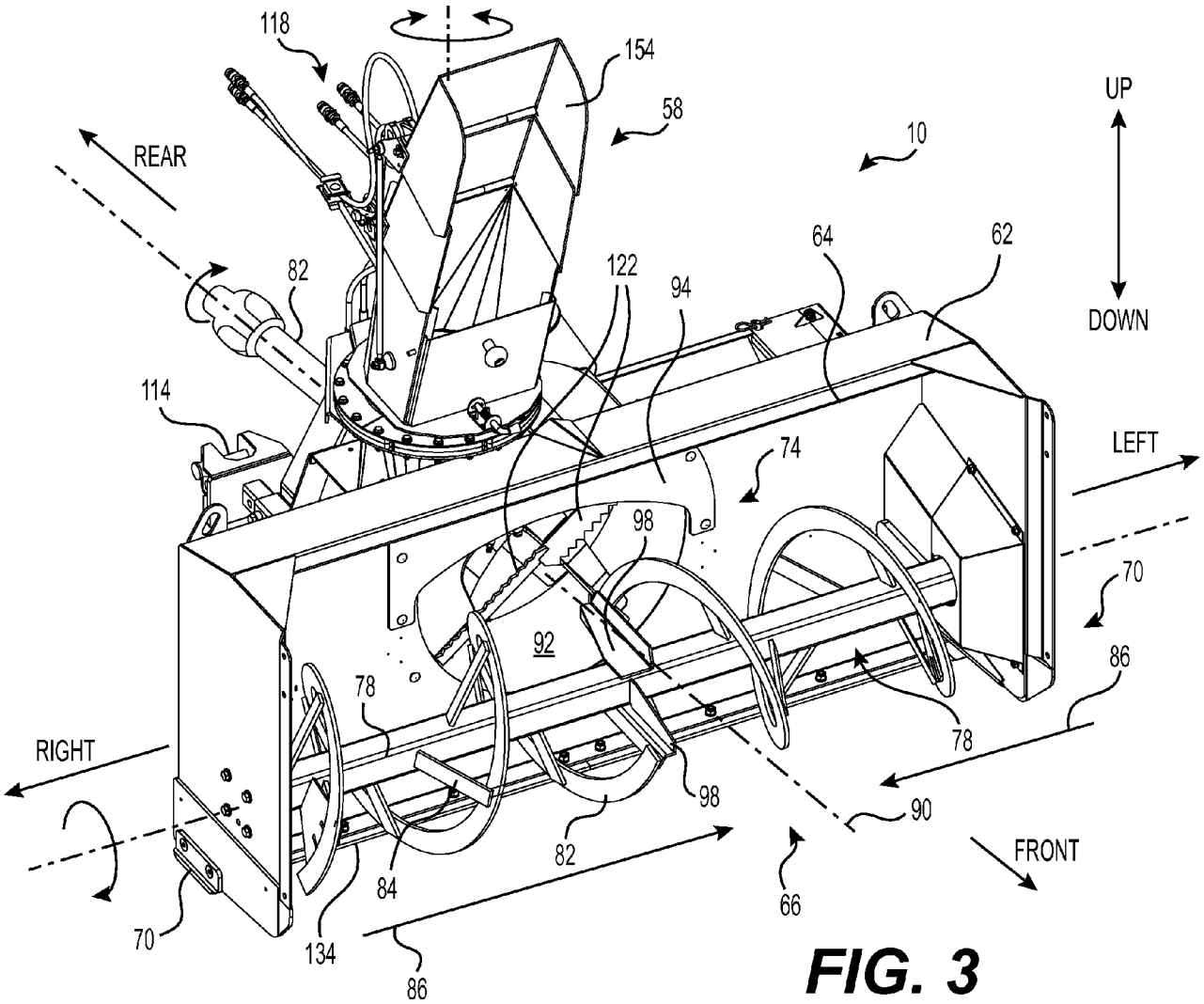
FIG. 3 is a perspective illustration of the front-right side of an exemplary snowblower, in accordance with at least one embodiment thereof.
Figure 5:
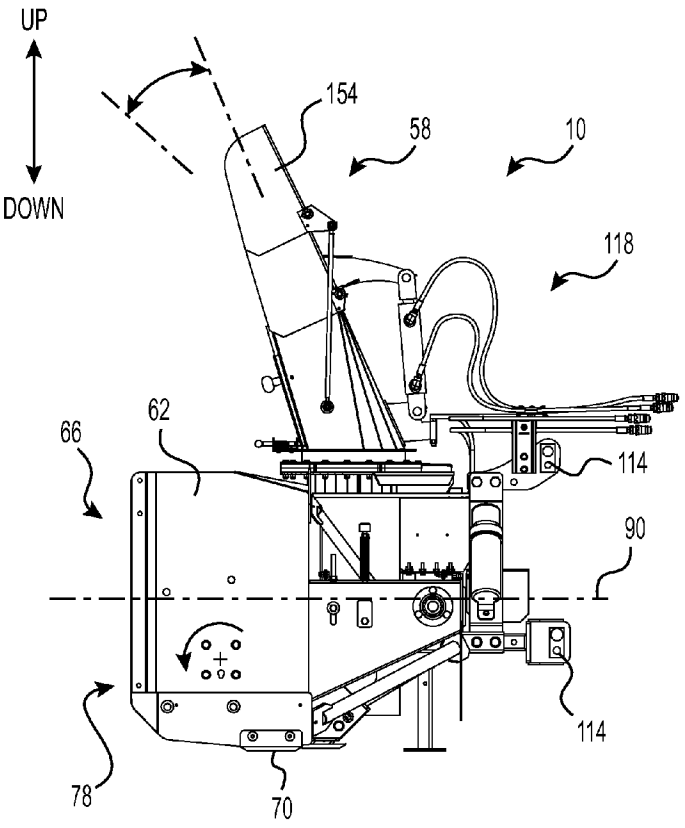
FIG. 5 is a left side elevational view of an exemplary snowblower, in accordance with at least one embodiment thereof.
Figure 4:
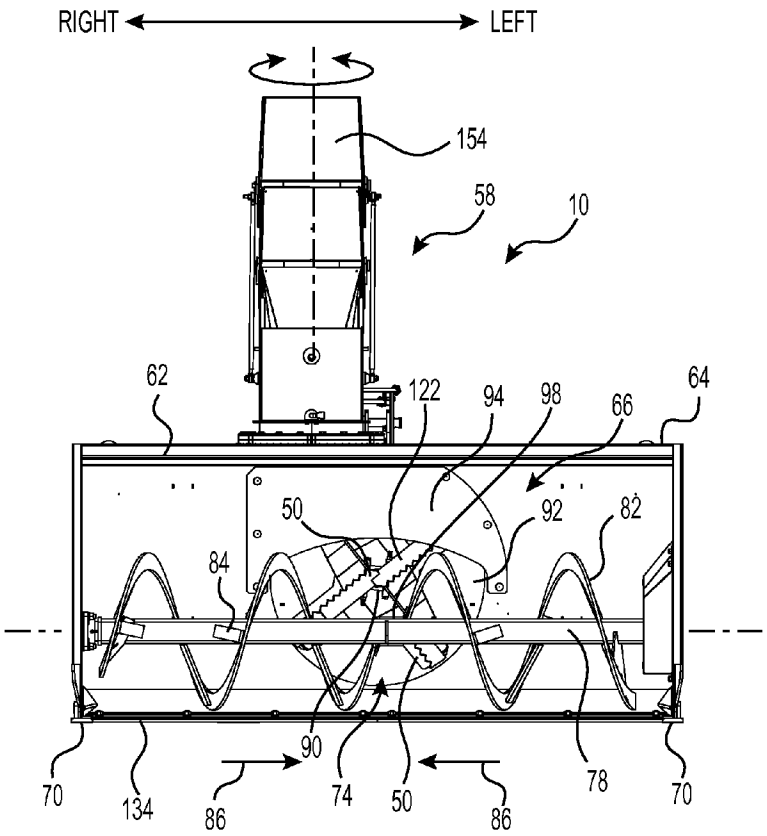
FIG. 4 is a of the an exemplary snowblower wherein the impeller is displayed.
Figure 7:
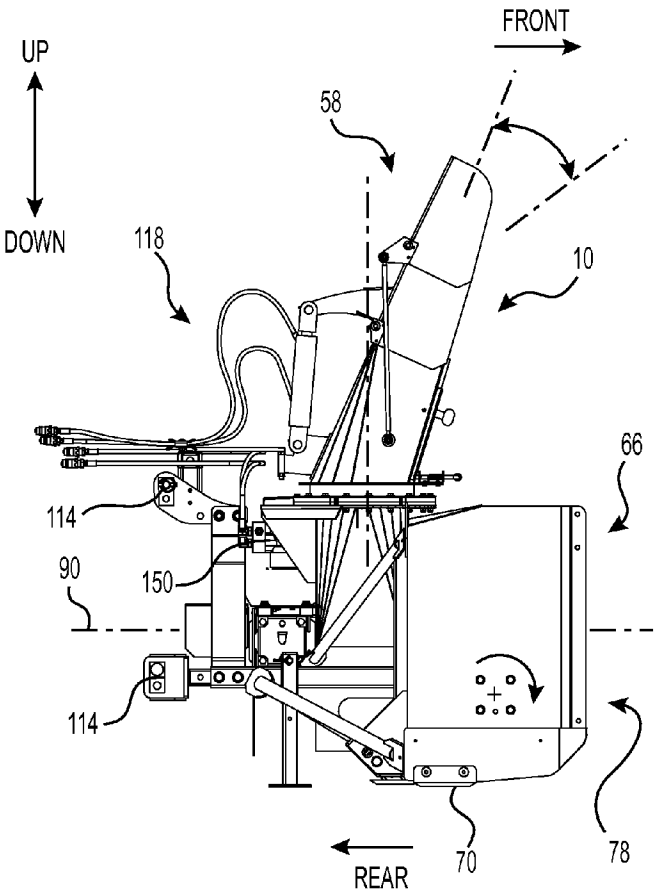
FIG. 7 is a left elevational view of an exemplary snowblower, in accordance with at least one embodiment thereof.
Figure 6:
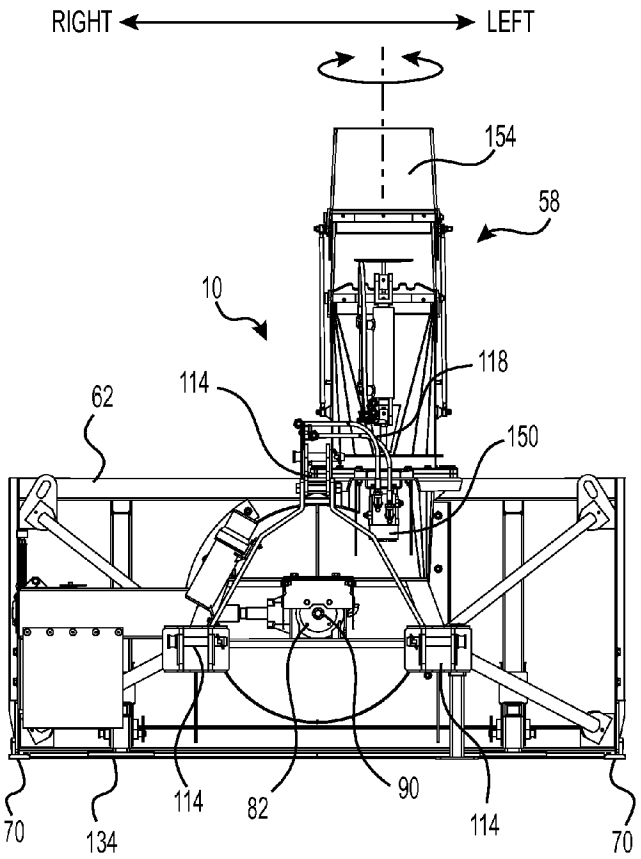
FIG. 6 is a rear elevational view of an exemplary snowblower, in accordance with at least one embodiment thereof.

Moving now to FIG. 3 throughout FIG. 7, illustrating a snowblower 10 with a snow-directing mechanism 58 (also referred to as a chute) capable of directing the snow propelled by the snowblower 10. The snow-directing mechanism 58 is configured to manage the direction and the height of the flow of snow when blown by the snowblower 10. The snowblower 10 includes a body 62 to which the snow-directing mechanism 58 is attached. The body 62 includes a snow-collecting portion 66 generally made of steel and generally having a rectangular section that is equipped with a pair of ground-contacting members 70 adapted to set the height of the snowblower 10 and facilitate the movement of the snowblower 10 on the ground. The body 62 also accommodates a snow-blowing mechanism 74 taking the snow from the snow-collecting portion 66 to the snow-directing mechanism 58 and propel the snow at a distance from the snowblower 10.

Figure 8:
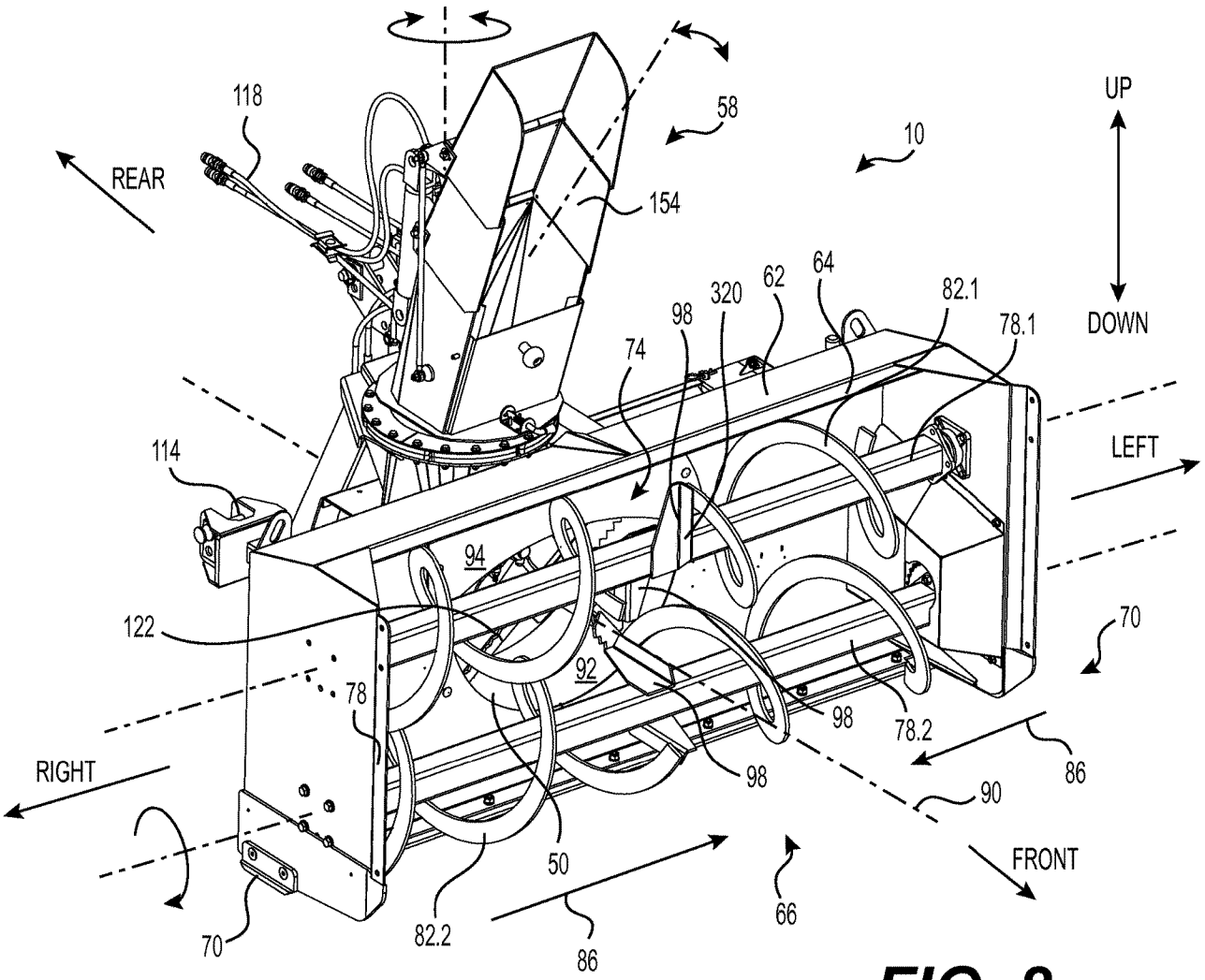
FIG. 8 is a rear-right perspective view of an exemplary snowblower with two screw-like tooth member, in accordance with at least one embodiment thereof.
Figure 17:
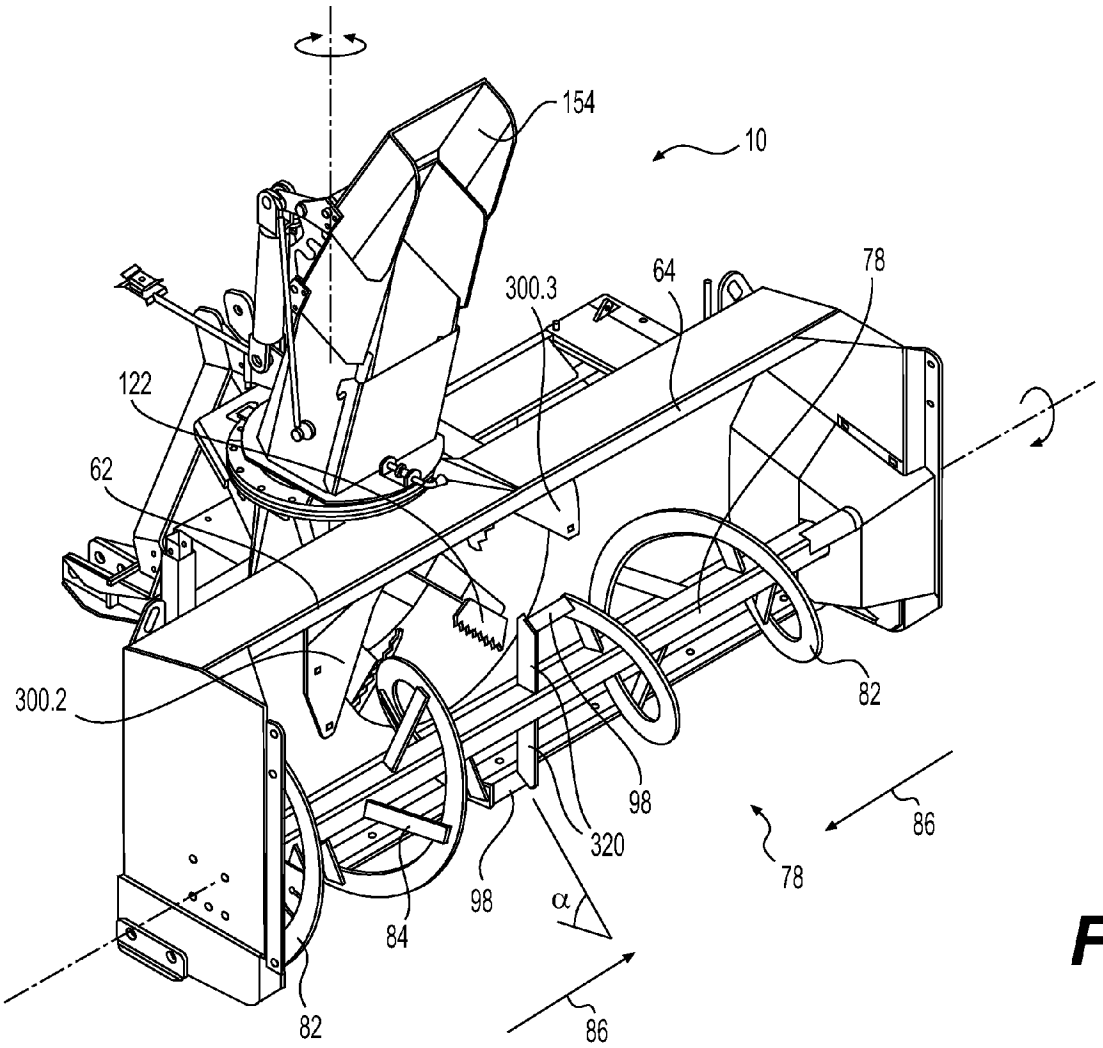
FIG. 17 is a perspective illustration of the front-right side of a snowblower and an embodiment of the screw-like tooth member and its snow shovel members.
Figure 18:
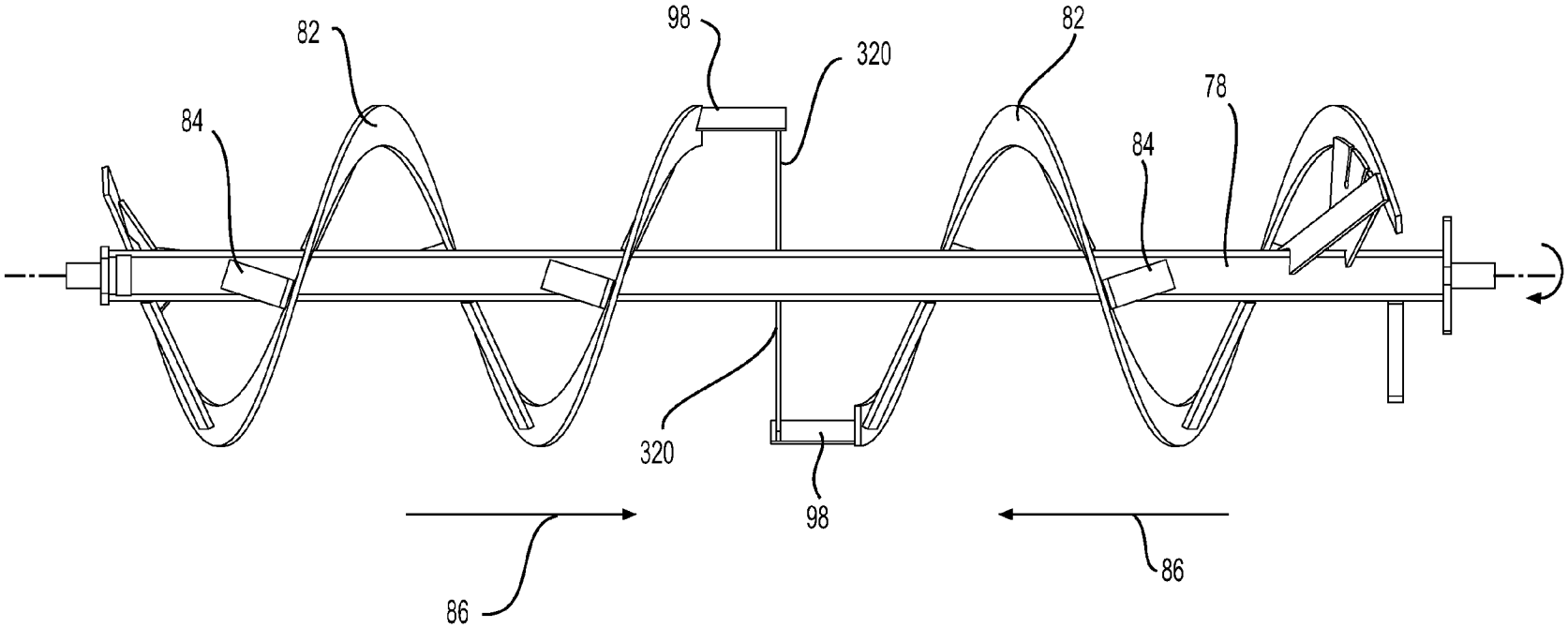
FIG. 18 is a perspective illustration of an embodiment of the screw-like tooth member and its snow shovel members.
Figure 19:
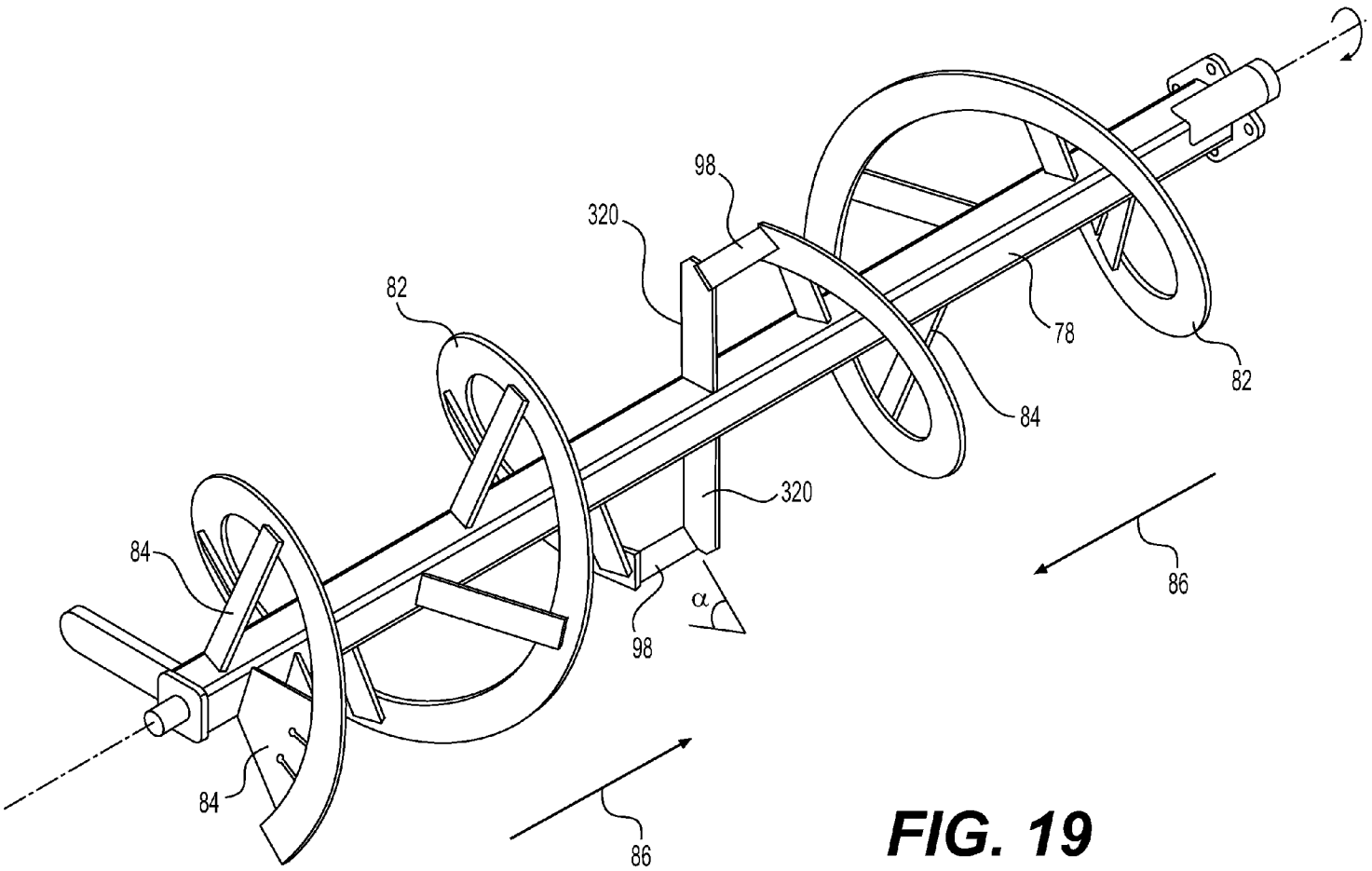
FIG. 19 is a perspective illustration of an embodiment of the screw-like tooth member and its snow shovel members.

The snow-collecting portion 66 is used to collect the snow on the ground and for other purposes. One of the other purposes is to manage the snow toward the snow-blowing mechanism 74 and make sure to limit the size of the pieces of snow to prevent blocking the snowblower 10 with blocks of snow and ice and therefore ensuring proper functioning of the snow blowing mechanism 74. An exemplary embodiment of a mechanism adapted to do so is illustrated in FIG. 3 throughout FIG. 8. A front horizontal rotating axle 78 is equipped with a screw-like tooth member 82 (also referred to as an auger) via support members 84 to grind the snow in front of the snowblower 10. The axle 78 is rotated by a drive taking power from the engine's PTO (not shown) of the tractor 18. The screw-like tooth member 82 is designed in such a way that the snow is going to be moved 86 toward the center of the snowblower 10. In so doing, the direction of rotation of the screw-like tooth member 82 is opposed on each of the right side and the left side of the snowblower 10. A snowblower 10 with a pair of superposed rotating axles 78 is illustrated in FIG. 8 throughout FIG. 10. The pair of superposed rotating axles 78 is generally driven together in the same direction to manage snow gathering to the snow-blowing mechanism 74. Still in FIG. 1 throughout FIG. 17, one can appreciate the typical three-point fastening mechanism 114 adapted to connect the snowblower 10 to the tractor 18. Other systems like the hydraulic system 118 for managing the direction of the snow can be appreciated. The snowblower 10 includes a snow-blowing mechanism 74 between the snow-collecting portion 66 and the snow-directing mechanism 58. The snow-blowing mechanism 74 is generally housed within the body 62 in a shape of an impeller 50 rotating about a rotational axis 90 as it is illustrated in FIGS. 2-7. One can appreciate that the opening 92 of the snow-blowing mechanism 74 is managed with a restriction member 94. The restriction member 94 is embodied as a plate in the Figures and could be embodied differently to serve a comparable function. The restriction member 94 is covering the upper portion of the impeller's housing opening 92 in the body 62. The restriction member 94 restricts the opening 92 that is accelerating the flow of air and snow inside the snow-blowing mechanism 74 given the smaller opening 92. The restriction member 94 can be adjustable and covers a desired portion of the opening 92. The restriction member 94 is preferably applied on the upper portion of the opening 92 and can cover a small portion of the opening 92 to about half of the opening 92. The restriction member 94 also interacts with the impeller 50 to optimize the vacuum created by the rotative impeller 50.

Figure 11:
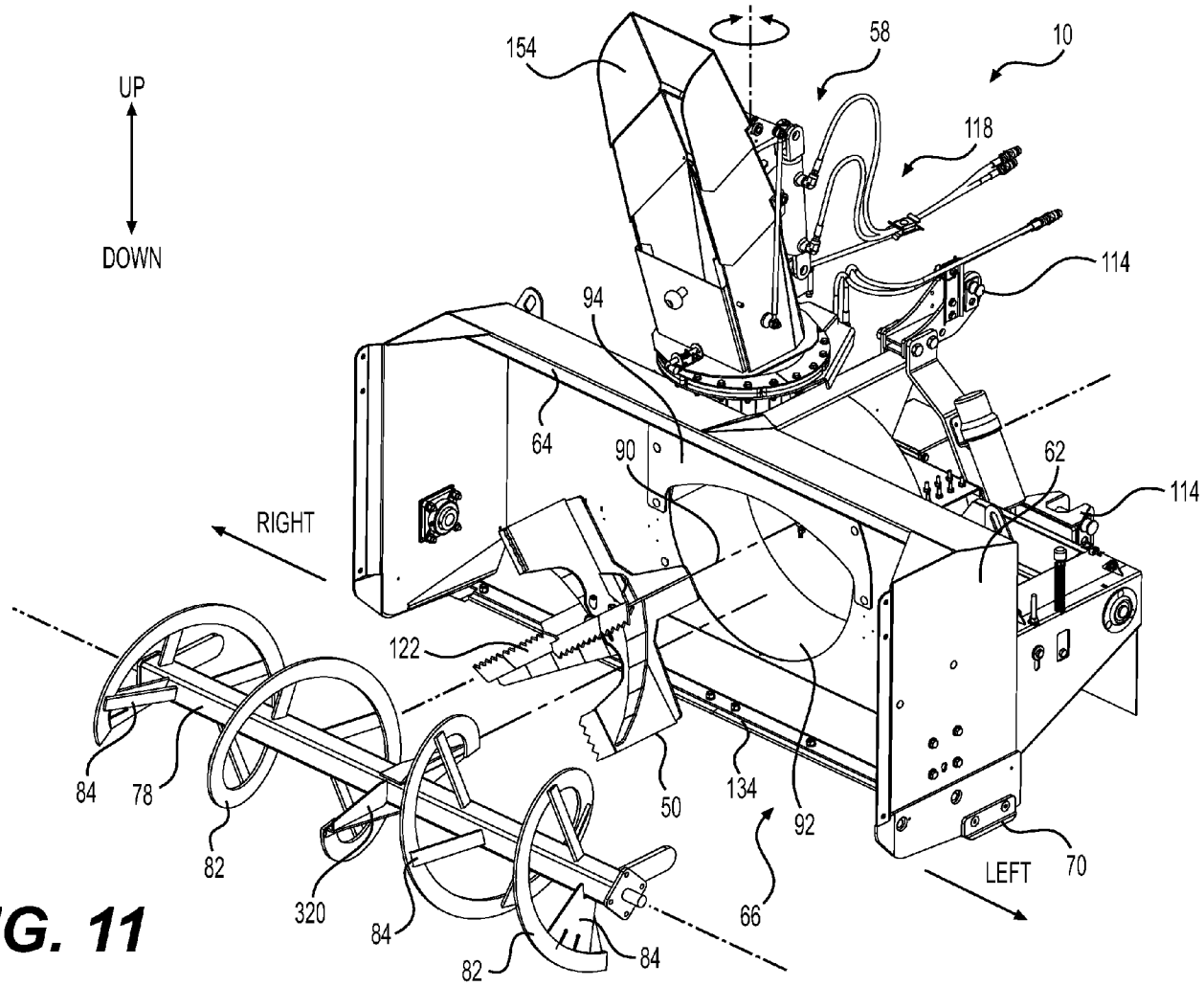
FIG. 11 is a perspective illustration of a semi-exploded view of an exemplary snowblower, in accordance with at least one embodiment thereof.
Figure 12:
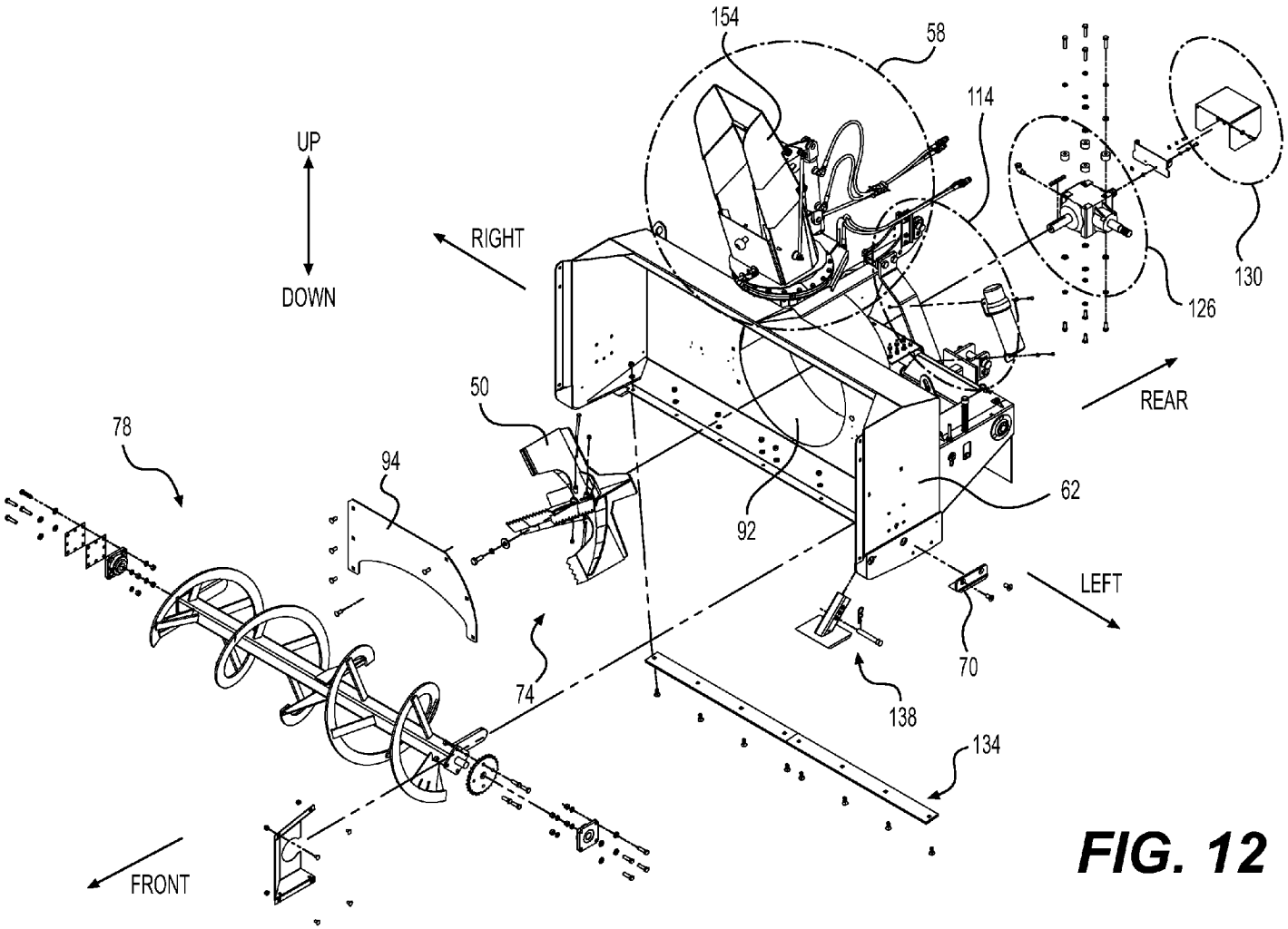
FIG. 12 is an exploded perspective view of an exemplary snowblower assembly, in accordance with at least one embodiment thereof.
Figure 13:
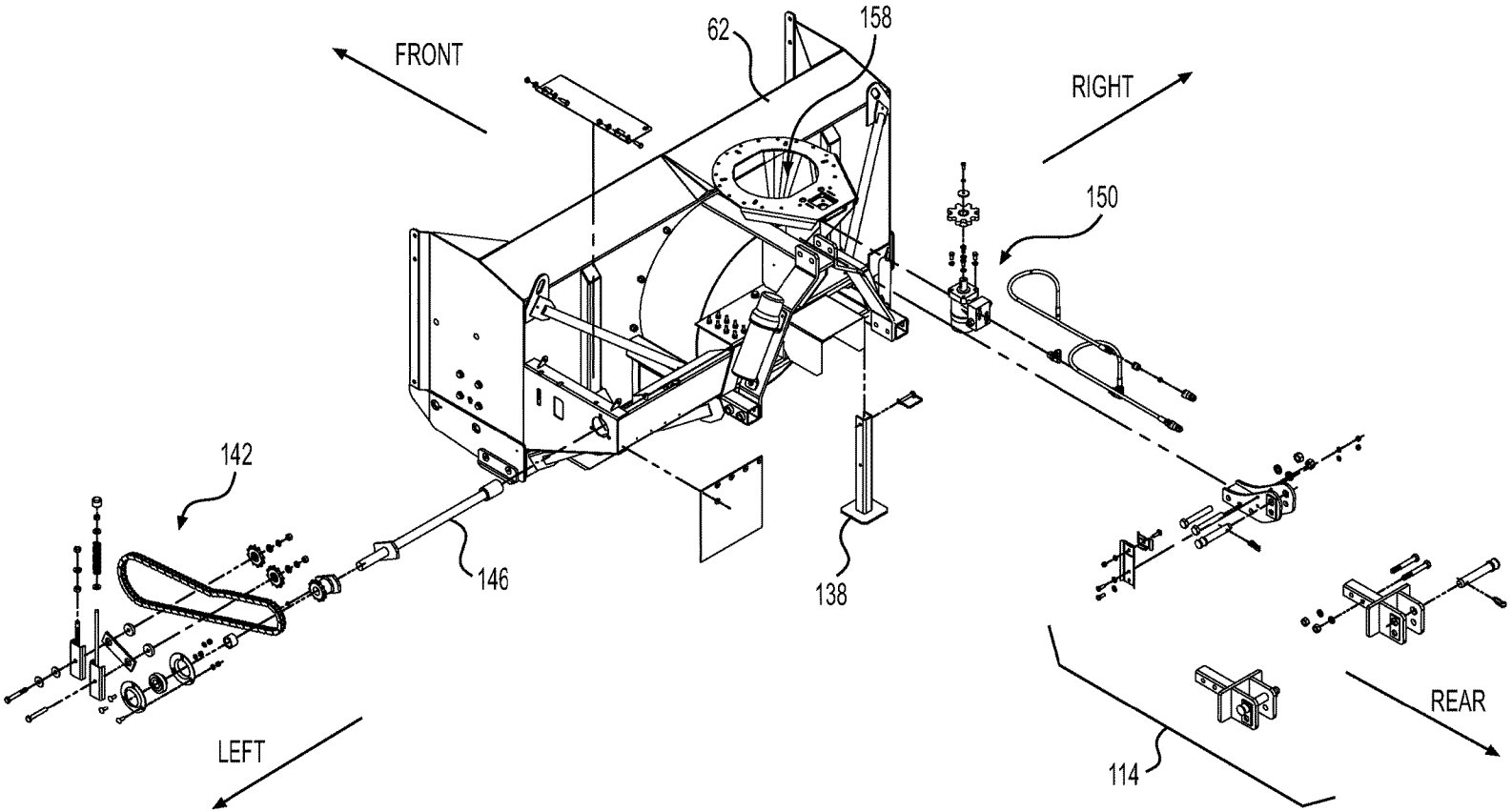
FIG. 13 is an exploded perspective view of an exemplary snowblower assembly, in accordance with at least one embodiment thereof.
Figure 14:
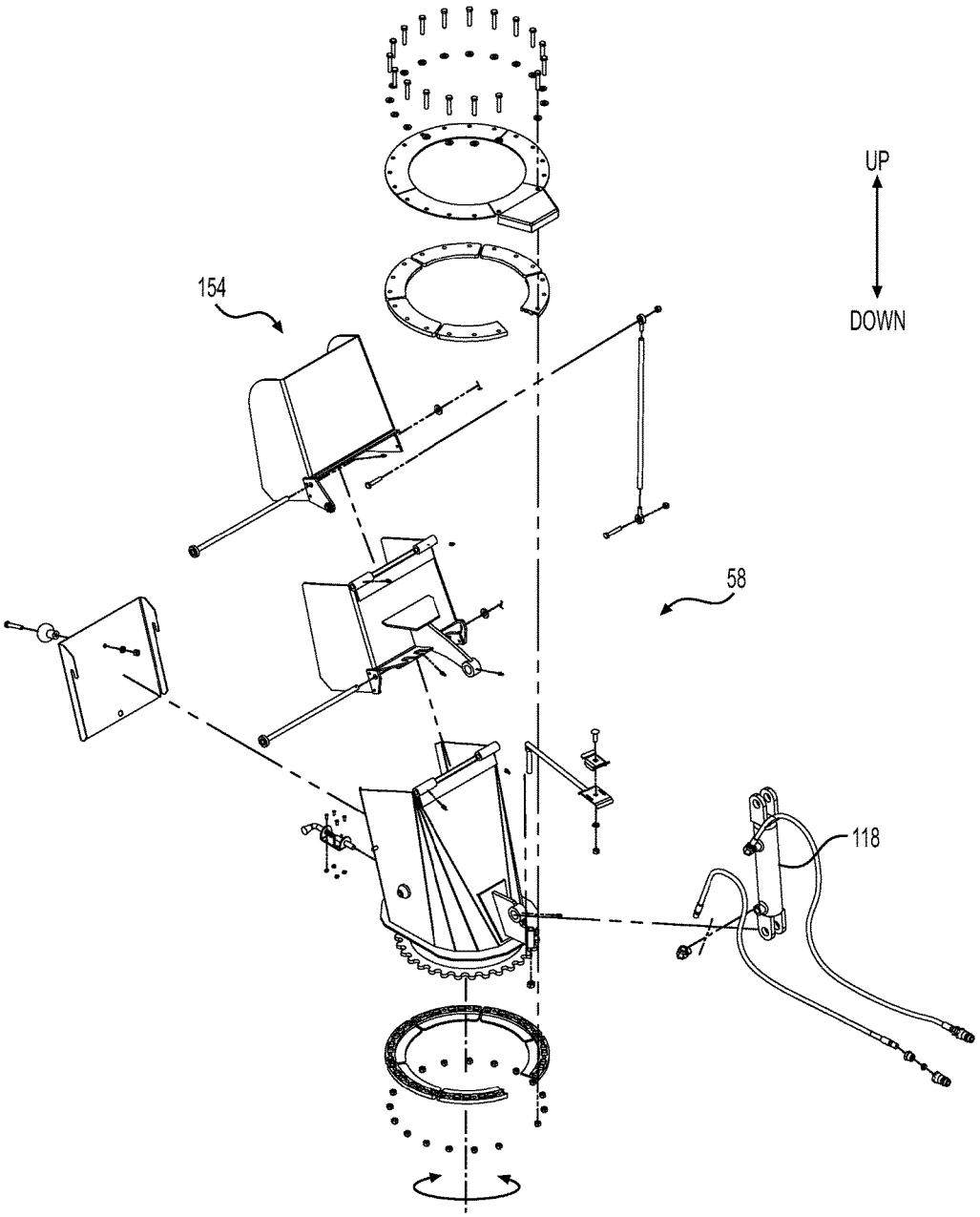
FIG. 14 is an exploded perspective view of an exemplary snowblower assembly, in accordance with at least one embodiment thereof.

FIG. 11 throughout FIG. 14 illustrate a semi-exploded view of the snowblower 10 where the rotating axle 78 and the impeller 50 are disassembled from the body 62 illustrating various exploded views of the snowblower 10 for further understanding of the assembly. A gearbox 126 is secured to the body 62 to receive rotative motive power from the engine (tractor's PTO), protected with guard 130, and transmit power to the impeller 50 and the rotative axle 78 assembly. One can also appreciate the lower portion of the body 62 includes a blade 134 and optional supporting legs 138. A drive system 142 is used to transmit power to the rotating axle 78 via a drive axle 146. A hydraulic actuator 150 is also depicted in FIG. 13. The hydraulic actuator 150 is used to rotate a nozzle 154 of the snow-directing mechanism 58. An opening 158 in the body 62 is also illustrated in FIG. 13 to allow passage of the snow from the impeller 50 to the snow-directing mechanism 58.

Figure 15:
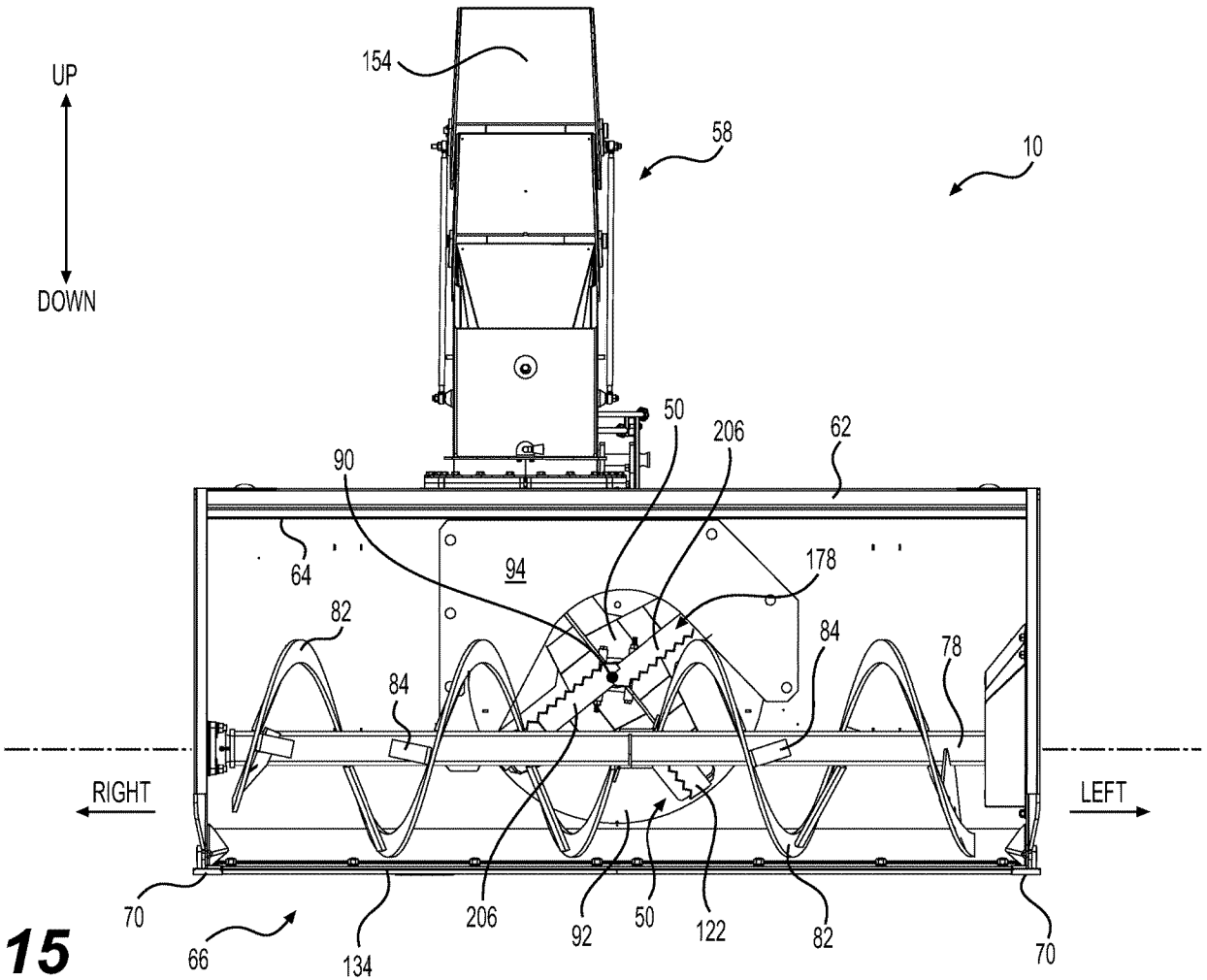
FIG. 15 is a front elevational view of a snowblower and an embodiment of the restriction member thereon.

Turning now to FIG. 15 illustrating an embodiment of the restriction member 94 in cooperation with the body 62 and the impeller 50. The restriction member 94 is secured to the body 62 of the snowblower 10 and is configured to restrict the opening 92 of the snow-blowing mechanism 74. Generally, a blowing apparatus using a rotating impeller to generate a vacuum has an impeller's eye 178 about the center of rotation of the impeller 50. This implies covering the radial and distal portion of the opening 92, about the rotation axis 90. Covering the radial and distal portion of the opening 92 ensures to create a vacuum through the impeller's eye 178 given the centrifugal force created by the rotating turbine 50.

In the present situation, the impeller 50 creates a vacuum when rotating and is required to propel ice and snow as well (solid materials). The complete distal portion of the impeller's eye 178 is preferably not covered because the snow and the ice are more prone to engage with the impeller 50 at the lower portion of the opening 92.

The restriction member 94 is thus designed to cover a significant portion of the opening 92 but the lowermost portion thereof to allow ice and snow to enter the opening 92 more easily without having to pile up to reach the impeller's eye 178 should the periphery of the lower portion of the opening 92 be restricted. The impeller's eye 178 of at least one embodiment is thus extending to a portion of the periphery of the opening 92 of the impeller 50 housing. The restriction member 94 can, in embodiments thereof, be used to selectively restrict the opening 92 to improve vacuum and allow passage of snow and ice in the snow-blowing mechanism 74.

Figure 10:
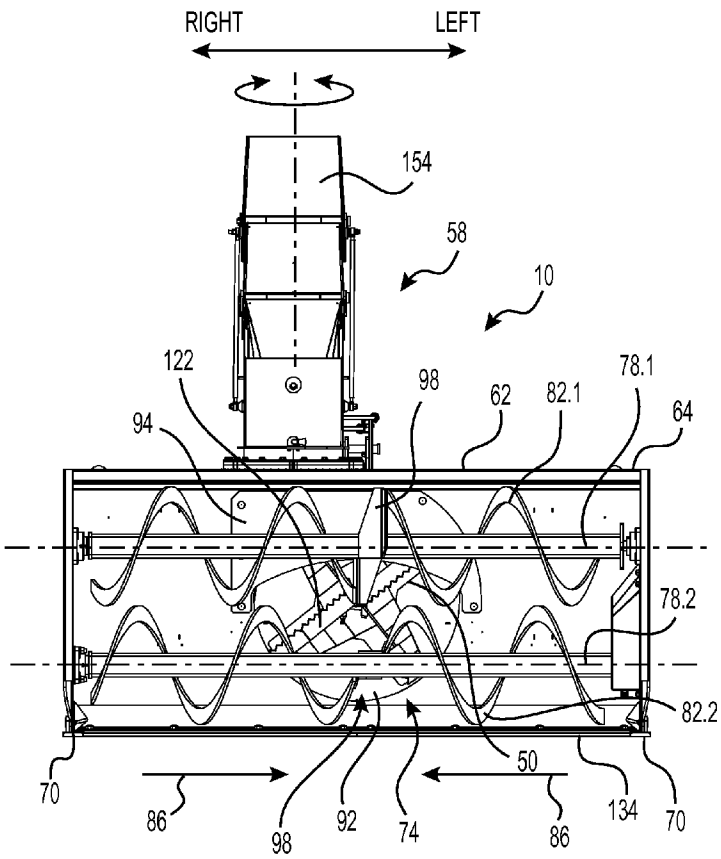
FIG. 10 is a front side elevational view of an exemplary snowblower, in accordance with at least one embodiment thereof.
Figure 9:
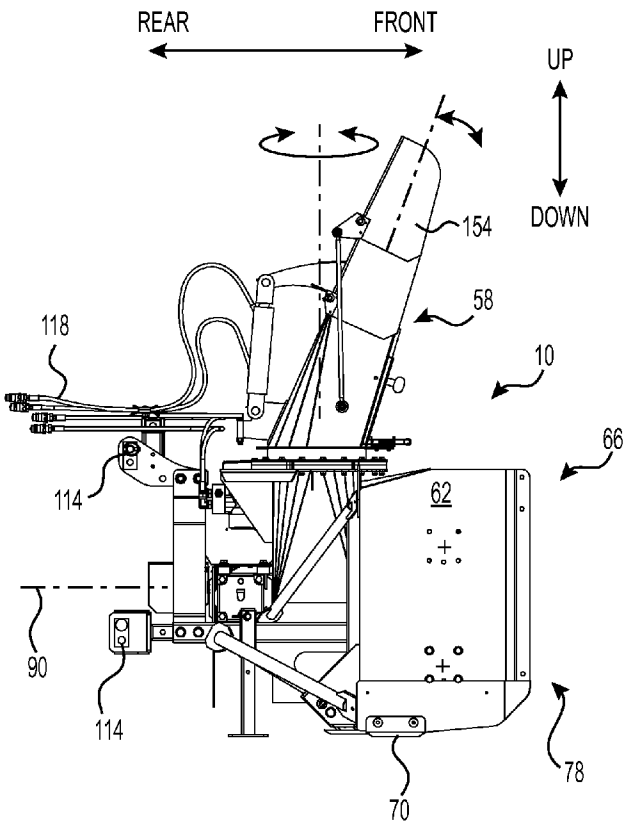
FIG. 9 is a right side elevational view of an exemplary snowblower, in accordance with at least one embodiment thereof.

The rotating axle 78 illustrated in FIG. 3 throughout FIG. 10 include a screw-like tooth member 82 with additional snow shovel members 98 disposed in the middle of the screw-like tooth member 82. The snow shovel members 98 rotate with the rotating axle 78 and push the snow facing the middle portion of the screw-like tooth member 82 toward the snow-blowing mechanism 74 in the snowblower 10. The snow shovel members 98 are generally used to collect snow located on the ground about the middle of the screw-like tooth member 82 length and propel the snow toward the snow-blowing mechanism 74. In the configuration of FIG. 8, the lower screw-like tooth member 82.2 collects snow on the ground while the other upper screw-like tooth member 82.1 is efficient when there is more snow in front of the snowblower 10. The screw-like tooth member 82 and its associated snow shovel members 98 are going to be discussed in greater details below.

Figure 51:
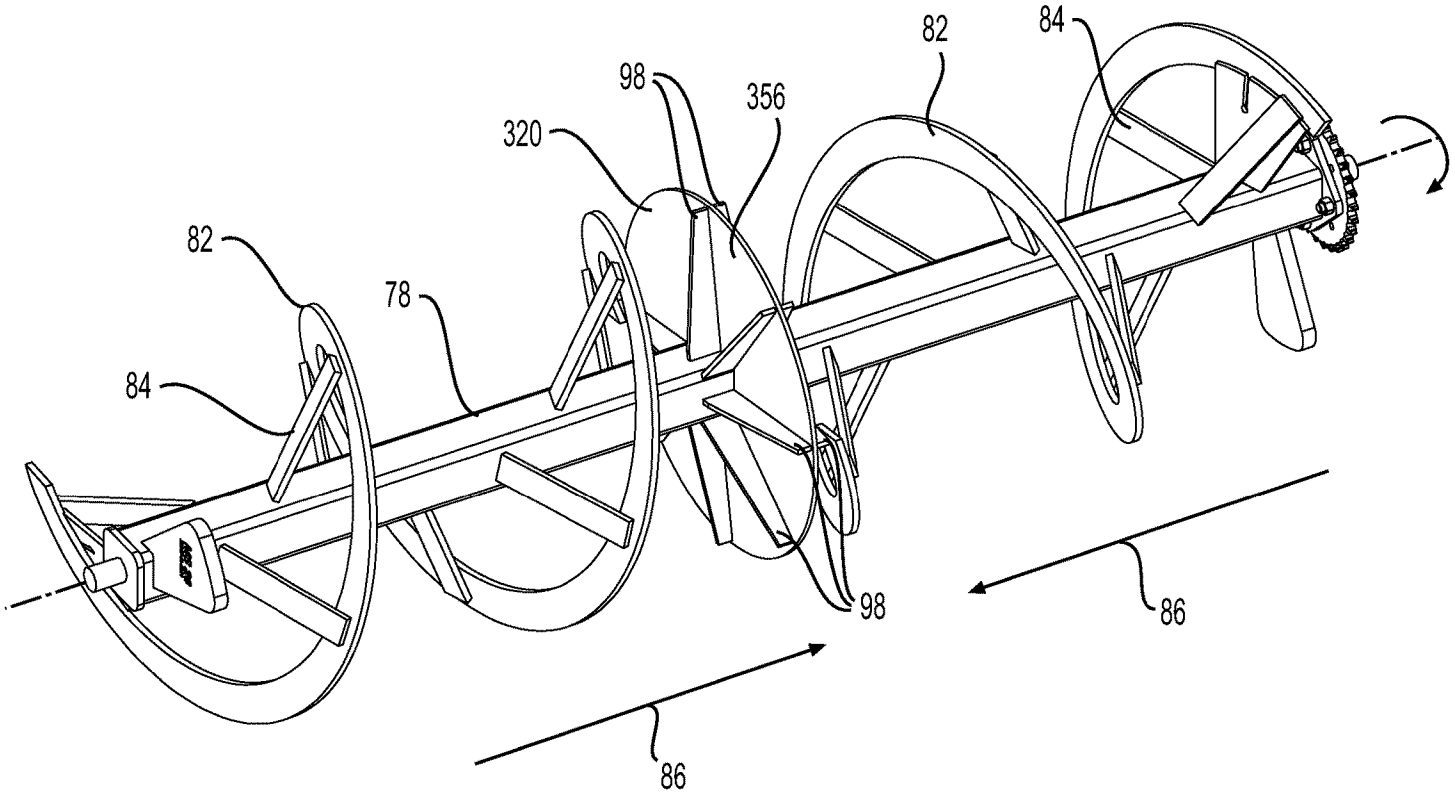
FIG. 51 is a perspective view of illustration of an embodiment of the screw-like tooth member and the snow shovel member.

A plurality of screw-like tooth member 82 configurations is presented in FIG. 3 throughout FIG. 51. The screw-like tooth member 82 is adapted to move the snow toward the center of the snowblower 10 when rotating. The middle section of the screw-like tooth member 82, where the snow is directed from each side of the screw-like tooth member 82, is equipped with a pair of radially opposed rotating snow shovel members 98. The snow shovel members 98 are provided to push snow remaining in the middle portion of the screw-like tooth member 82 that cannot be reached and shoveled by the screw-like tooth member 82 toward the opening 92 of the snow-blowing mechanism 74. The snow shovel members 98 are illustratively embodied as a pair of substantially flat members that might be disposed at an angle $\alpha$ in respect with the ground as depicted, inter alia, in FIG. 17. The snow shovel members 98 are located toward the distal radial location of the screw-like tooth member 82 to move close to the ground.

Figure 16:
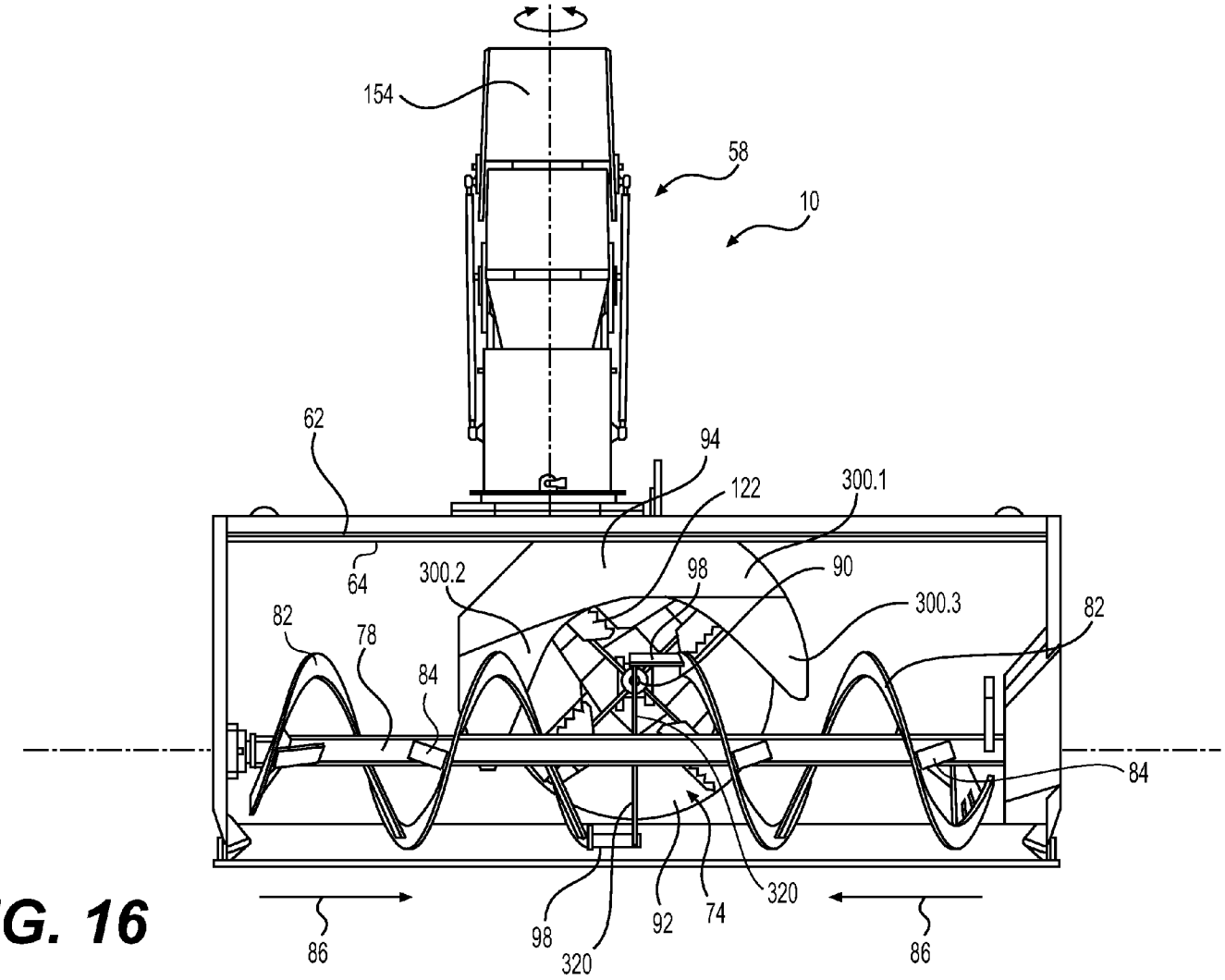
FIG. 16 is a front elevational view of a snowblower and an embodiment of the screw-like tooth member and its snow shovel members.

These snow shovel members 98 are configured to shovel snow found in the middle of the screw-like tooth member 82 while preventing shoveling the snow further to the front of the snowblower 10. As seen in FIG. 16 and others, the snow shovel members 98 are secured, on a first side thereof, to an axial end of their associated screw-like tooth member 82 and to a radial member 320 on a second side thereof. The radial members 320 have a shape that is not adapted to propel snow upon rotation thereof. The radial member 320 of the present embodiment is illustratively a thin flat that does not provide a surface large enough to shovel snow when rotating, leaving the shoveling to be shoveled by the shovel members 98.

Figure 20:
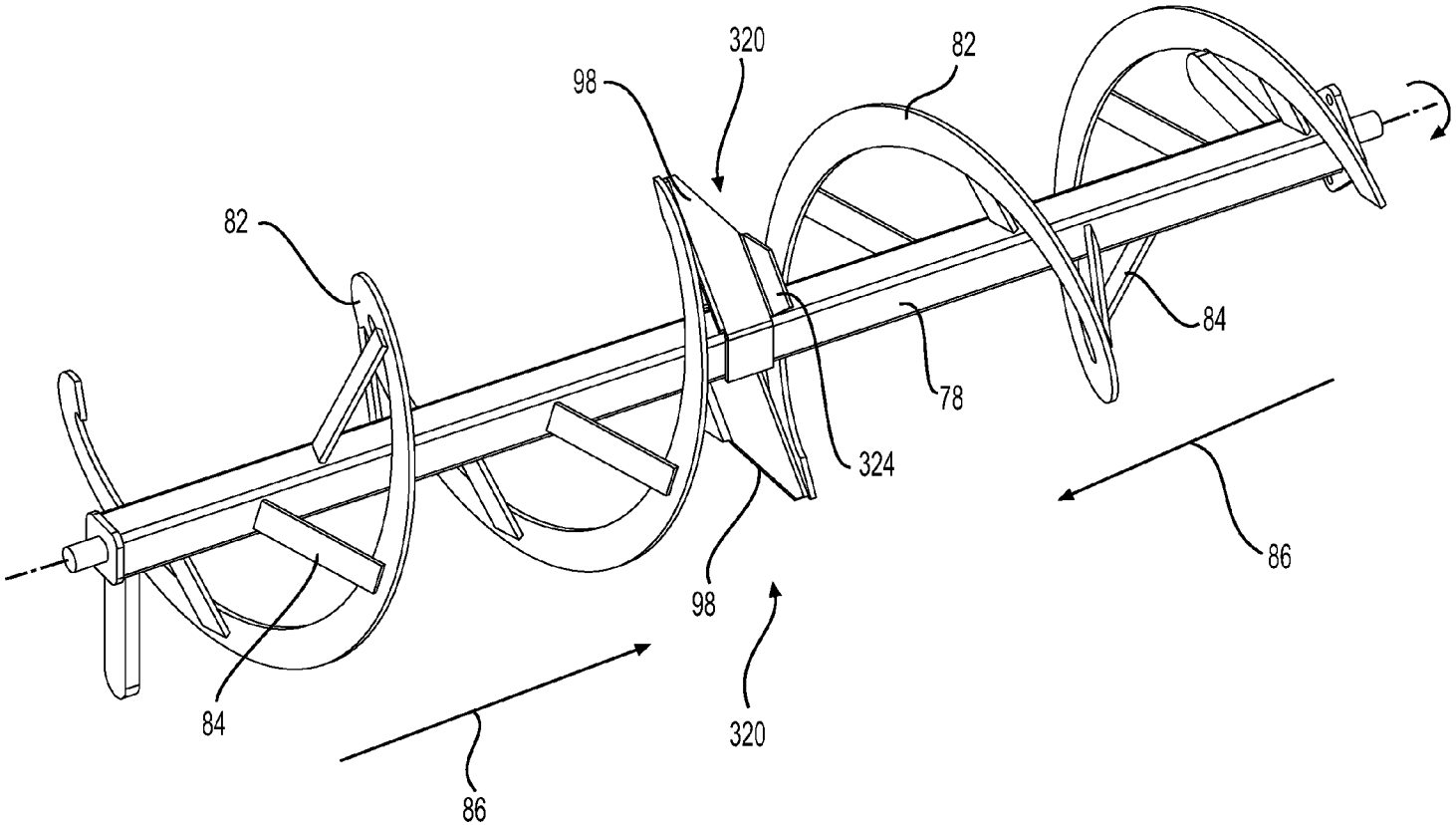
FIG. 20 is a perspective illustration of an embodiment of the screw—the screw-like tooth member and its snow shovel members.
Figure 22:
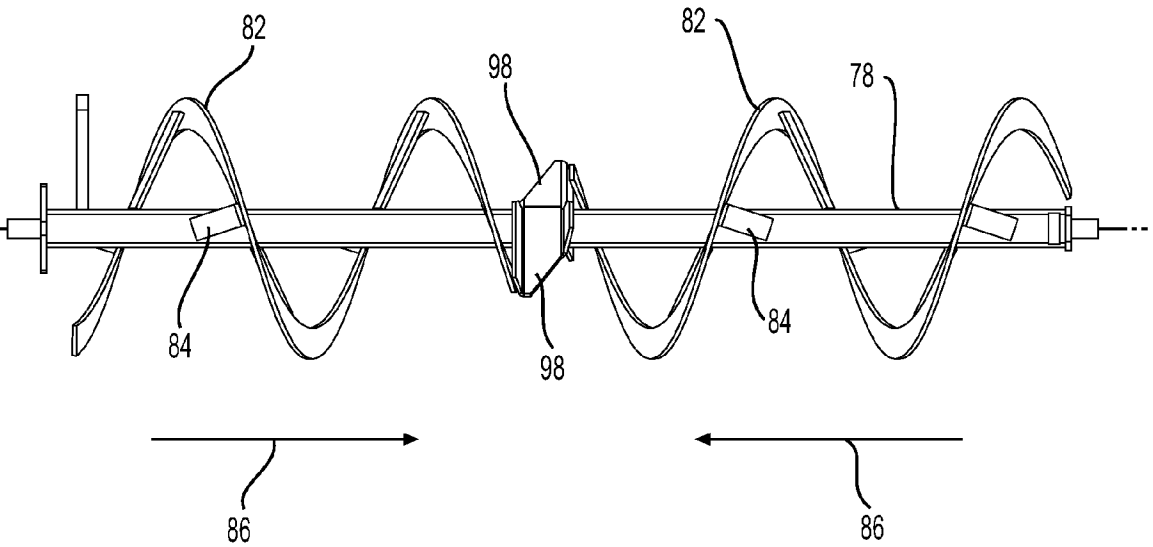
FIG. 22 is a perspective illustration of an embodiment of the screw—the screw-like tooth member and its snow shovel members.
Figure 21:
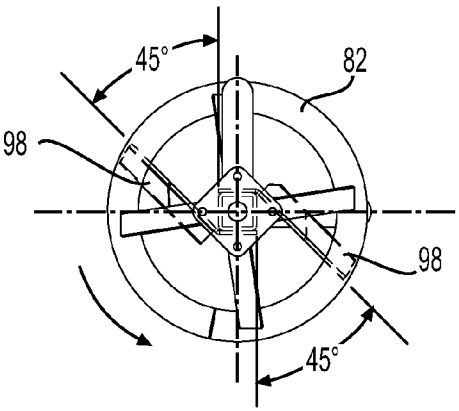
FIG. 21 is a side illustration of an embodiment of the screw-like tooth screw-like tooth member and its snow shovel members.

Another embodiment of the snow shovel members 98 is illustrated in FIG. 20, FIG. 21 and FIG. 22. The snow shovel members 98 are embodied as a flat member combining the radial member 320 that has a reduced width on its distal side from the rotating axle 78. The flat member is used in combination with a side edge 324 to help direct the snow toward the snowblower 10 when rotating.

Figure 37:
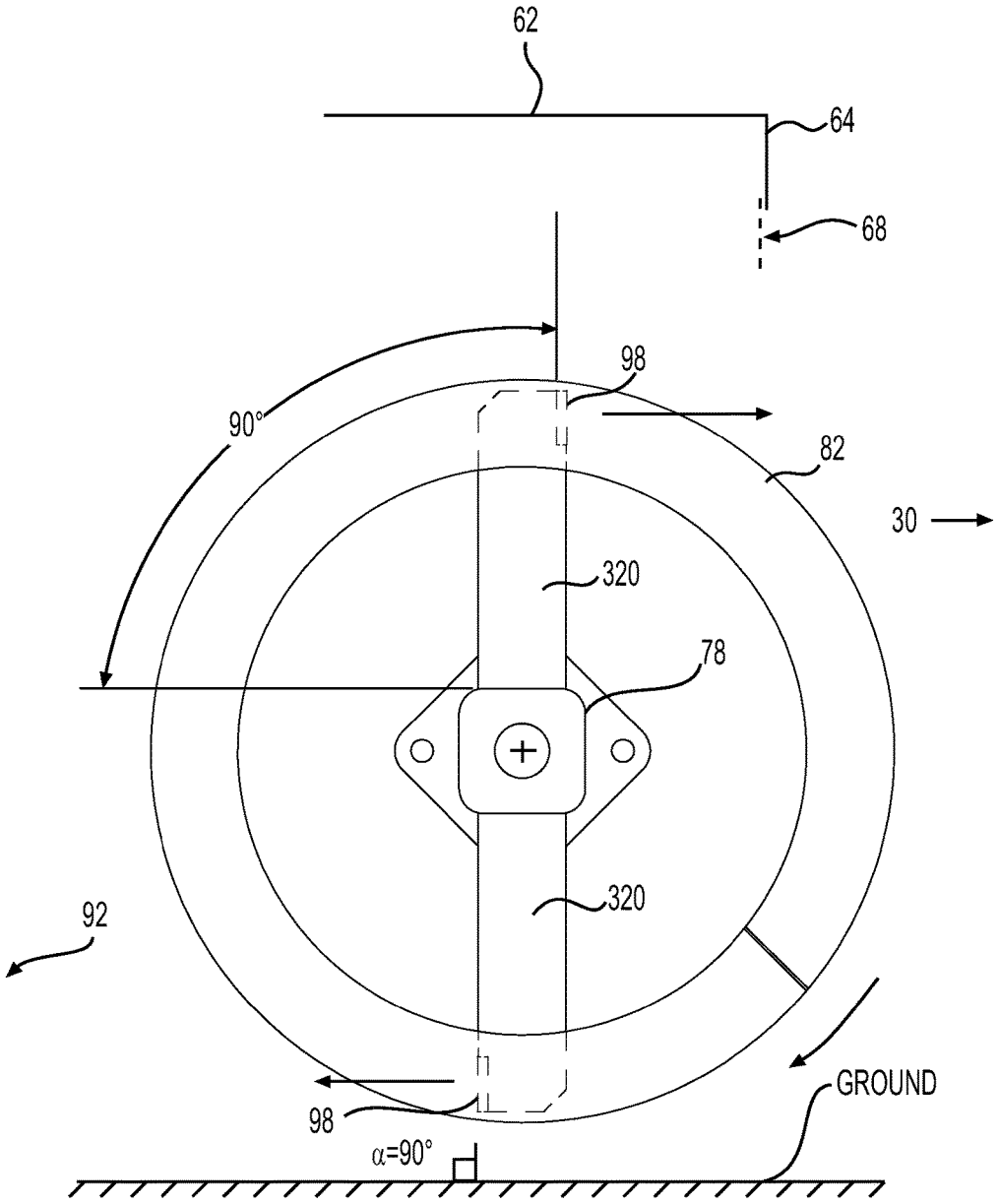
FIG. 37 is side illustration of an embodiment of the snow shovel members.
Figure 38:
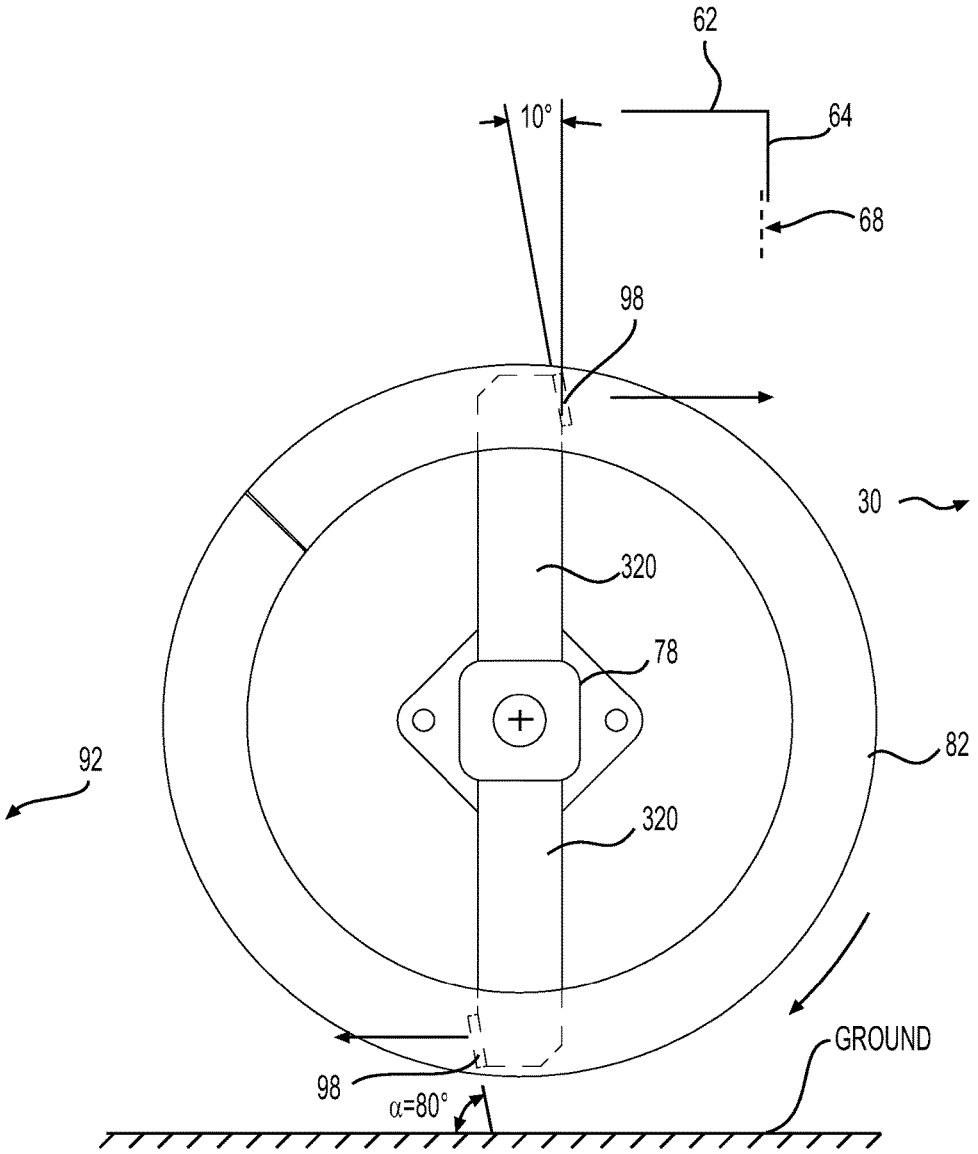
FIG. 38 is side illustration of an embodiment of the snow shovel members.
Figure 39:
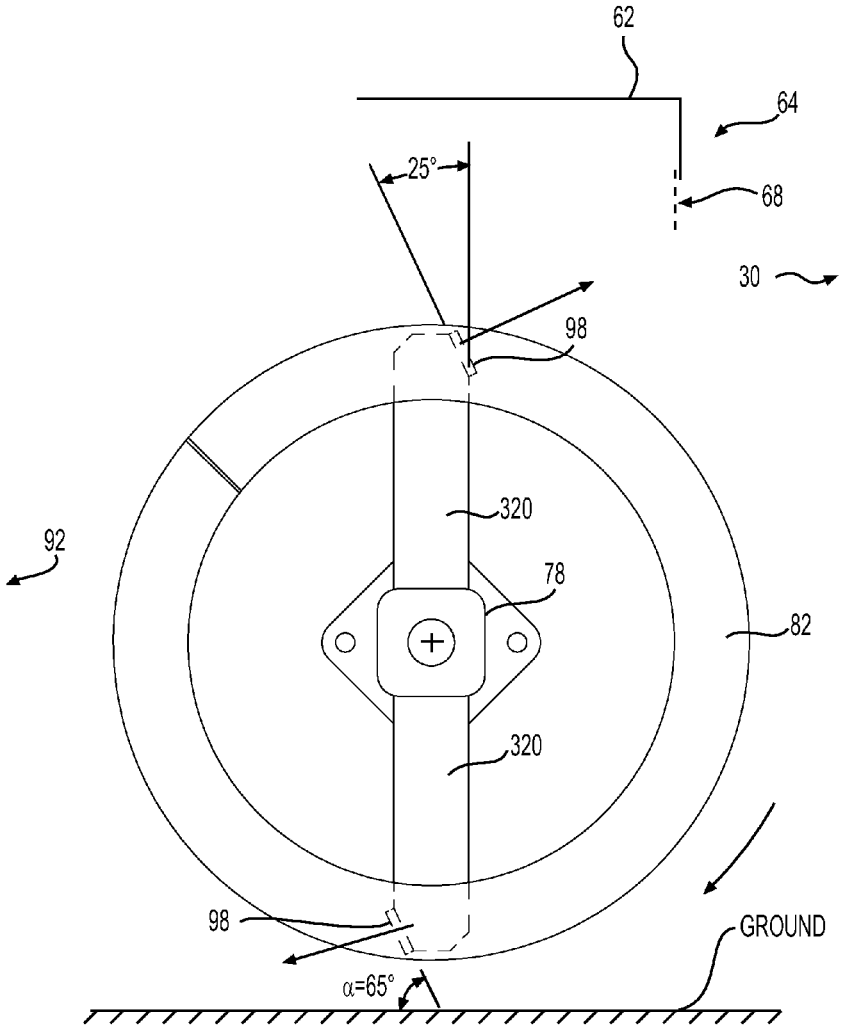
FIG. 39 is side illustration of an embodiment of the snow shovel members.
Figure 40:
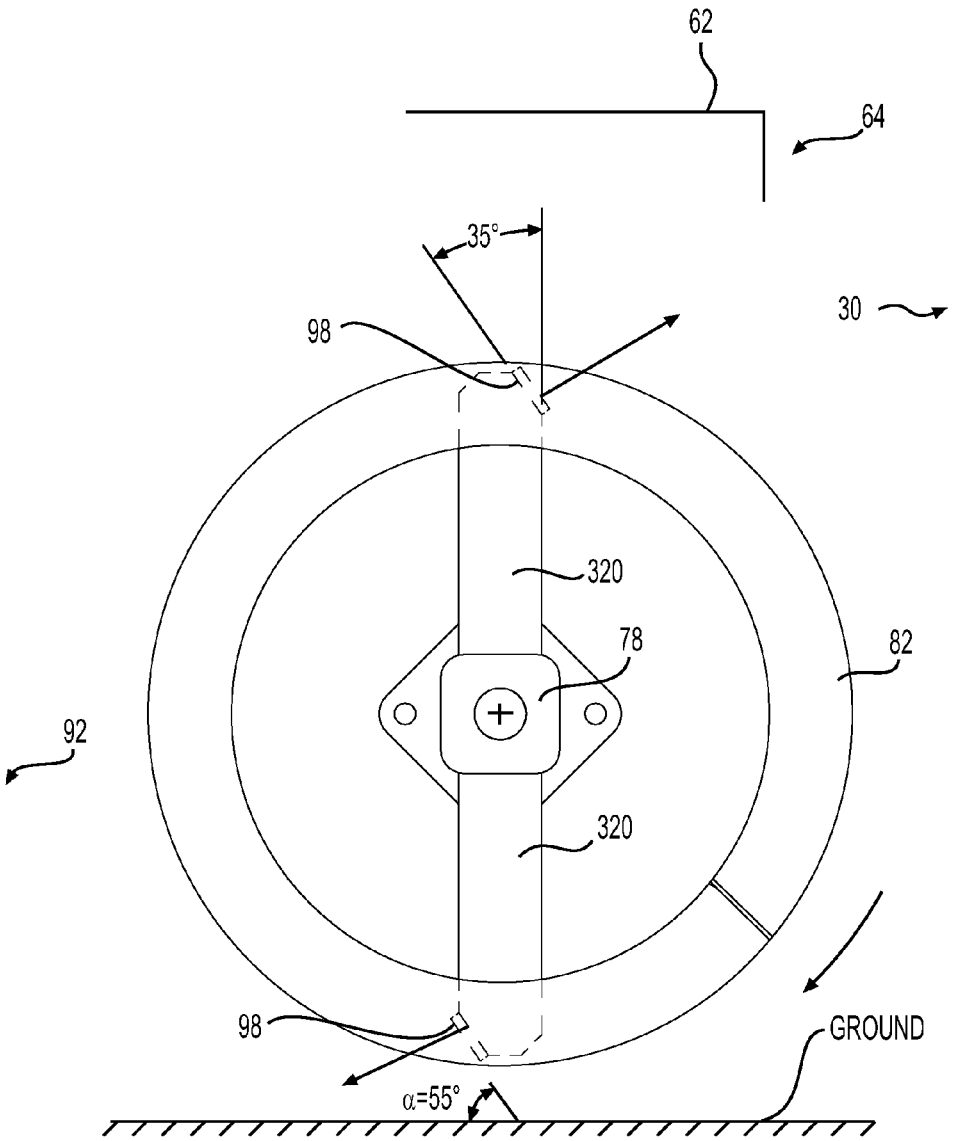
FIG. 40 is side illustration of an embodiment of the snow shovel members.

It can be appreciated in FIG. 21 that the snow shovel members 98 are radially angled, identified with $\alpha$, from the rotting axle 78. The angle $\alpha$ of the snow shovel members 98, in combination or not with the rotative movement of the rotating axle 78, is pushing the snow on the ground with a vertical component toward the ground when moving toward the snow-blowing mechanism 74. The $\alpha$ of the snow shovel members 98 is pushing any possibly remaining snow thereon with a vertical component in the upper direction when moving away from the snow-blowing mechanism 74. The vertical component in the upper direction provided by the angled snow shovel members 98 when moving snow away from the snow-blowing mechanism 74 prevents the remaining snow to be propelled away in front of the snowblower 10 by propelling the snow against the body 62 of the snowblower 10. The body 62 can be optionally equipped with a downward edge 64 thereof that is used as a snow stopper hence preventing remaining snow on the snow shovel members 98 to be thrown away from the snowblower 10. This phenomenon is illustrated in FIG. 37 throughout FIG. 41. The downward edge 64 can be long or short without departing from the scope of the present invention. The downward edge 64 can alternatively be replaced by a rubber flap 68, or the like, further extending downward from the body 62, or from the edge 64. One can appreciated that the rubber flap 68 is secured to the body 62 on the upper side thereof and can optionally be weighted with a weight member (not illustrated) secured thereto on the lower side thereof. The radial angle $\alpha$ of the snow shovel member 98 is between 20° and 60° with the ground, more preferably between 30° and 50° with the ground, and preferably about 45° with the ground. The snow shovel could alternatively be at other working angles thereof without departing from the scope of the present invention.

Figure 23:
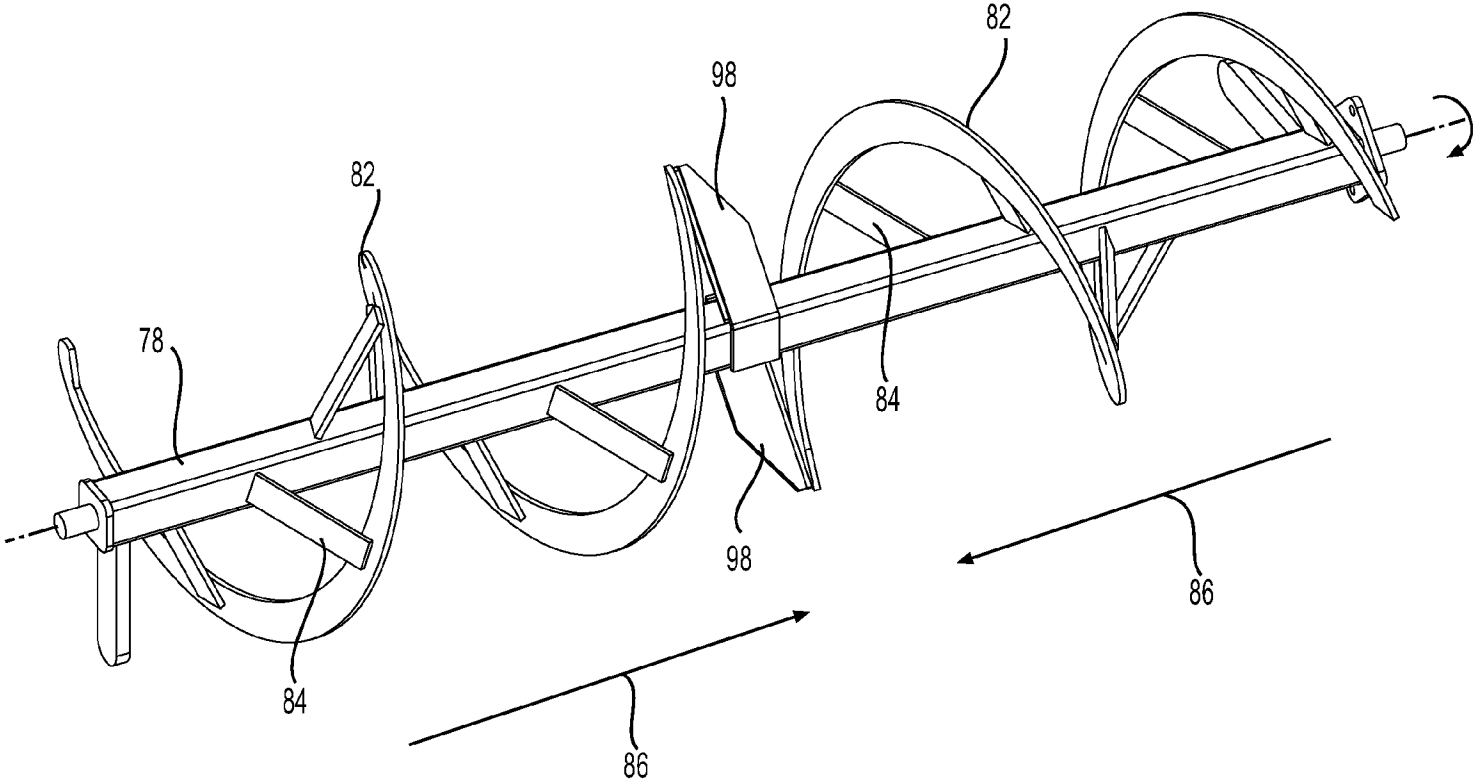
FIG. 23 is a perspective illustration of an embodiment of the screw-like tooth member and its snow shovel members.
Figure 25:
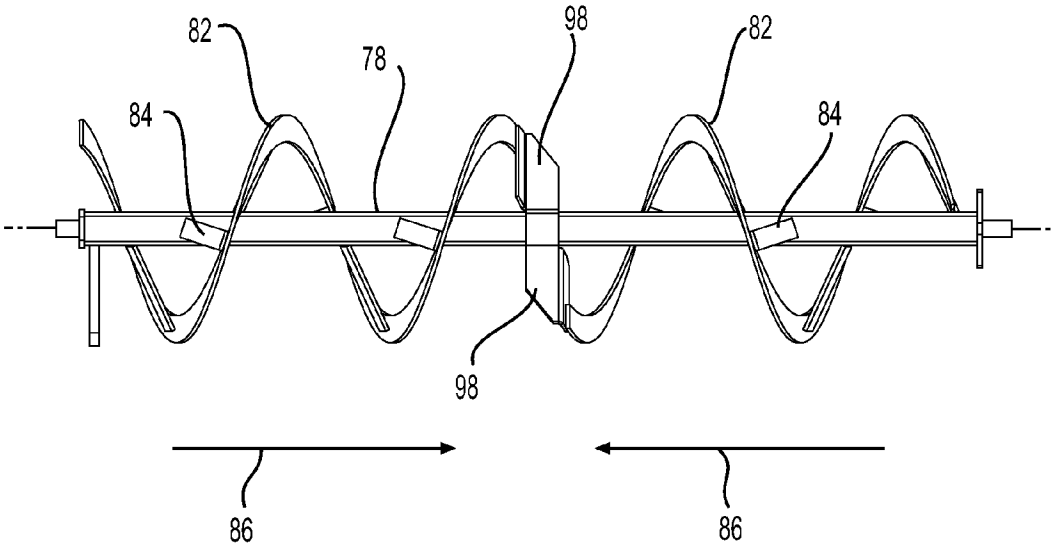
FIG. 25 is a perspective illustration of an embodiment of the screw-like tooth member and its snow shovel members.
Figure 24:
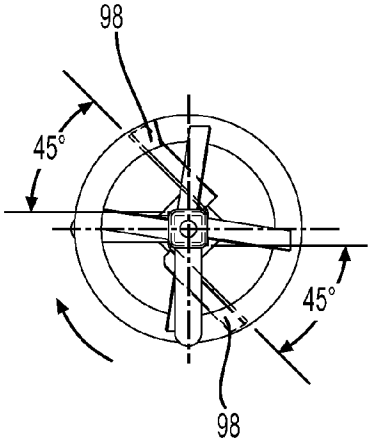
FIG. 24 is a side illustration of an embodiment of the screw-like tooth member and its snow shovel members.

A variation of the embodiment of the snow shovel members 98 is illustrated in FIG. 23, FIG. 24 and FIG. 25. The snow shovel members 98 are embodied as a flat member that has a reduced width on its radial distal end thereof. This time, the flat member is not used in combination with a side edge (numeral reference 324 in FIG. 20, FIG. 21 and FIG. 22). It can be appreciated from FIG. 24 that the snow shovel members 98 are angled. The angle is between 20° and 60°, between 30° and 50°, and about 45° with the ground. The snow shovel could alternatively be vertical or at any other angles for some uses without departing from the scope of the present invention.

Figure 26:
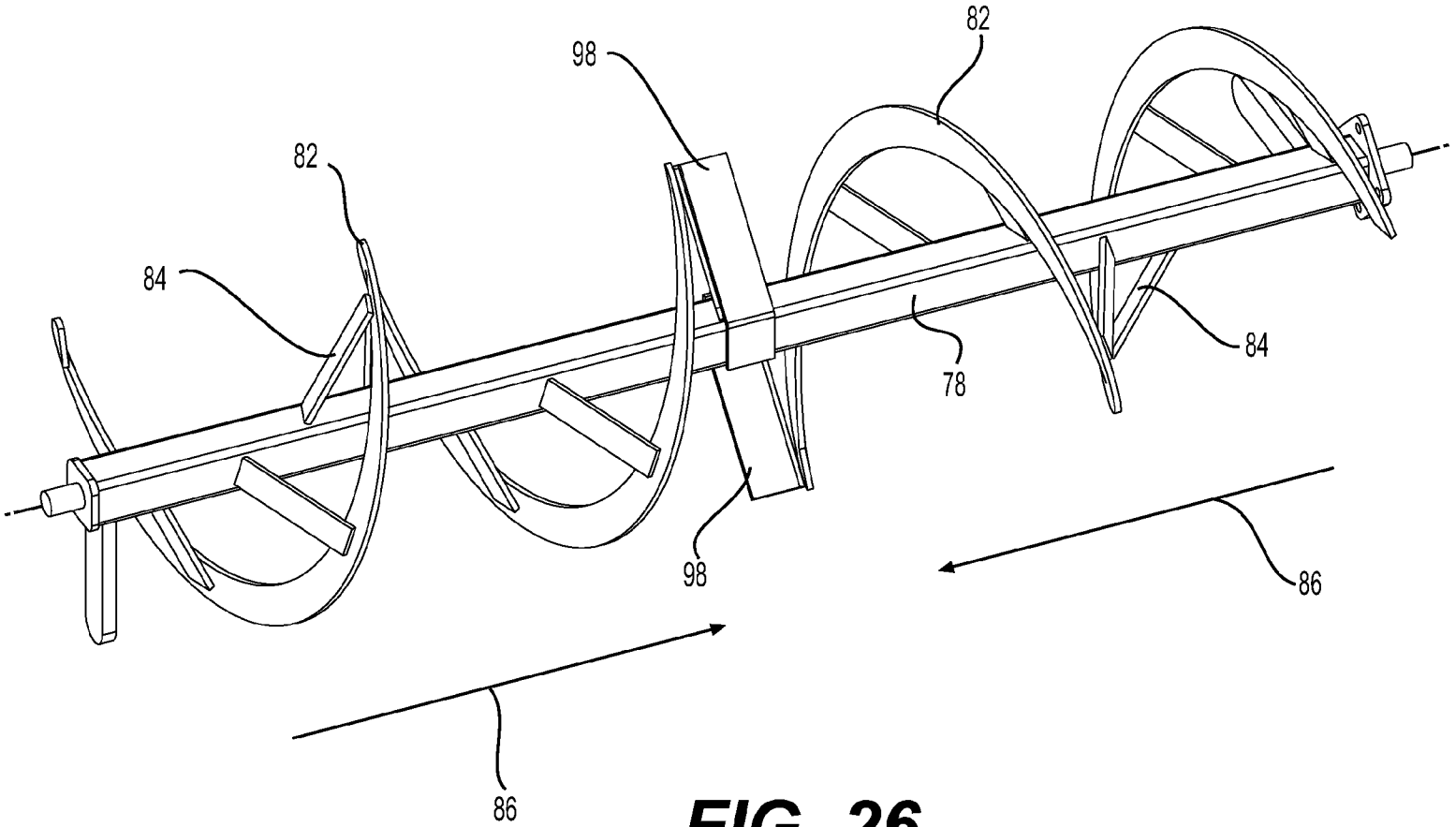
FIG. 26 is a perspective illustration of an embodiment of the screw-like tooth member and its snow shovel members.

FIG. 26 illustrates another variation where the snow shovel members 98 is embodied as a flat member that has a constant width all along its radial length thereof. The flat member is not used in combination with a side edge (numeral reference 324 in FIG. 20, FIG. 21 and FIG. 22). It can be appreciated that the snow shovel members 98 remain angled. The angle $\alpha$ is between 20° and 60°, between 30° and 50°, and about 45° with the ground. The snow shovel could alternatively be vertical or at any other angles for some uses without departing from the scope of the present invention.

The shovel members 98 are disposed on respective radial sides of the rotation axis 90 and are collectively shoveling between 15 cm and 30 cm wide, in the illustrated exemplary embodiment. The axial width covered by the shovel members 98 can change in other embodiments that remain within the scope of the present application. A significant advantage of the illustrated embodiment is to shovel the snow low on the ground while preventing shoveling remaining snow further away, in front of the snowblower 10, when rotating toward the front of the snowblower 10. Further, the angled snow shovel members 98, allow shoveling snow low from the ground into the opening 92 despite the angle α thereof while rendering more difficult to shovel snow out of the snowblower 10 when rotating toward the front of the snowblower 10. The snow shovels members 98 angle α can vary and is embodied between 20° and 60°, between 30° and 50°, and about 45° with the ground. The snow shovel members 98 could alternatively use any other working angles α thereof without departing from the scope of the present invention. The snow shovels members 98 can be permanently secured to the parts that are maintaining the snow shovels members 98 on the rotative part of the snowblower 10. Alternatively, the snow shovels members 98 can be fastened to be replaced, if desirable. The snow shovels members 98 angle α about the ground is also contemplated to be adjustable. The snow shovels members 98 can come in different heights and shapes adapted to be efficient under different operating conditions.

Figure 27:
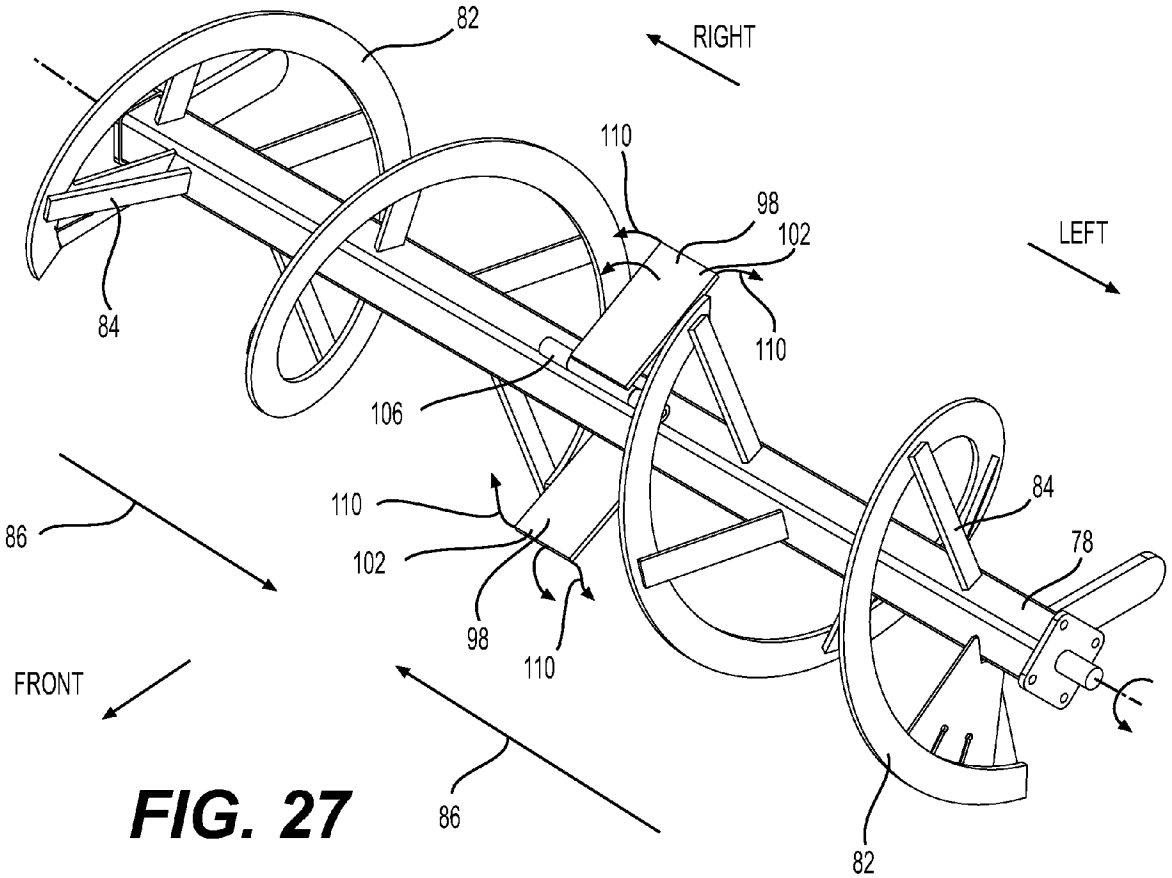
FIG. 27 is a perspective illustration of a screw-like tooth member adapted to be assembled in a snowblower, in accordance with at least one embodiment thereof.
Figure 28:
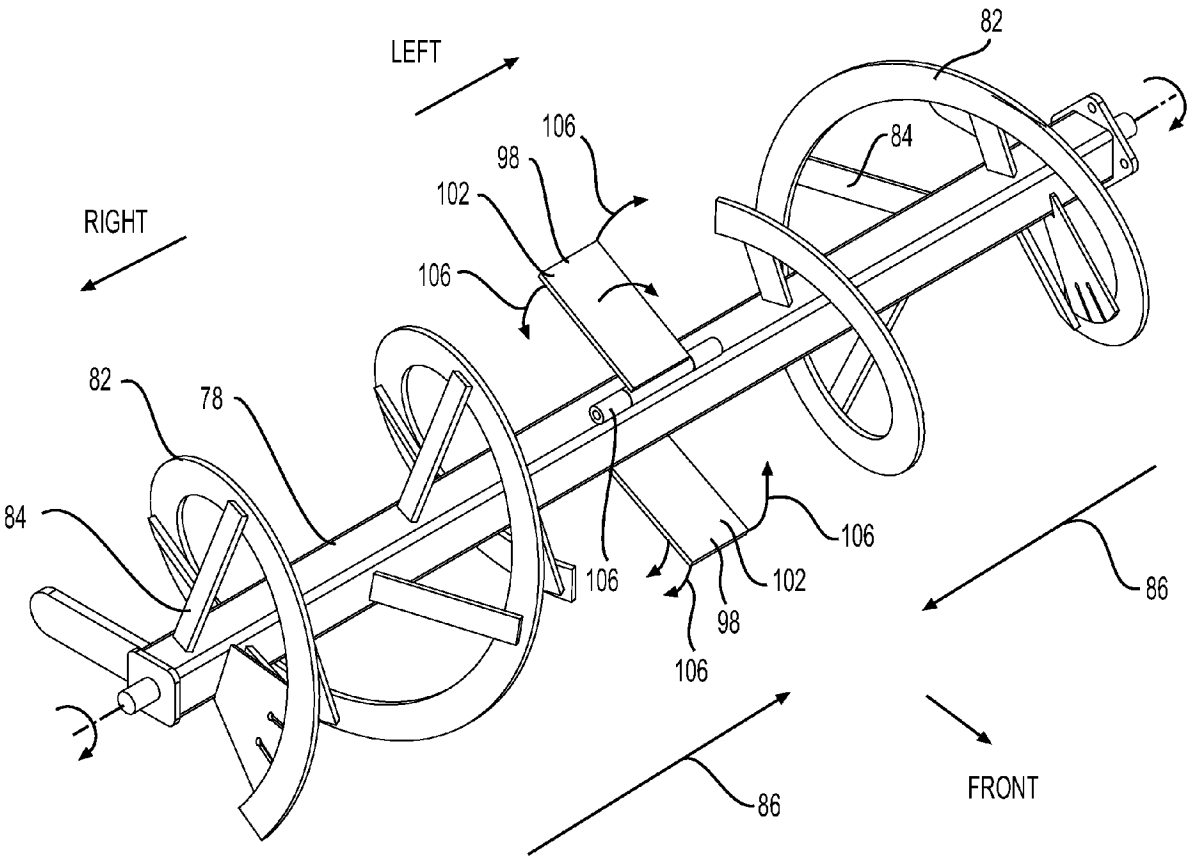
FIG. 28 is a perspective illustration of a screw-like tooth member adapted to be assembled in a snowblower, in accordance with at least one embodiment thereof.
Figure 29:
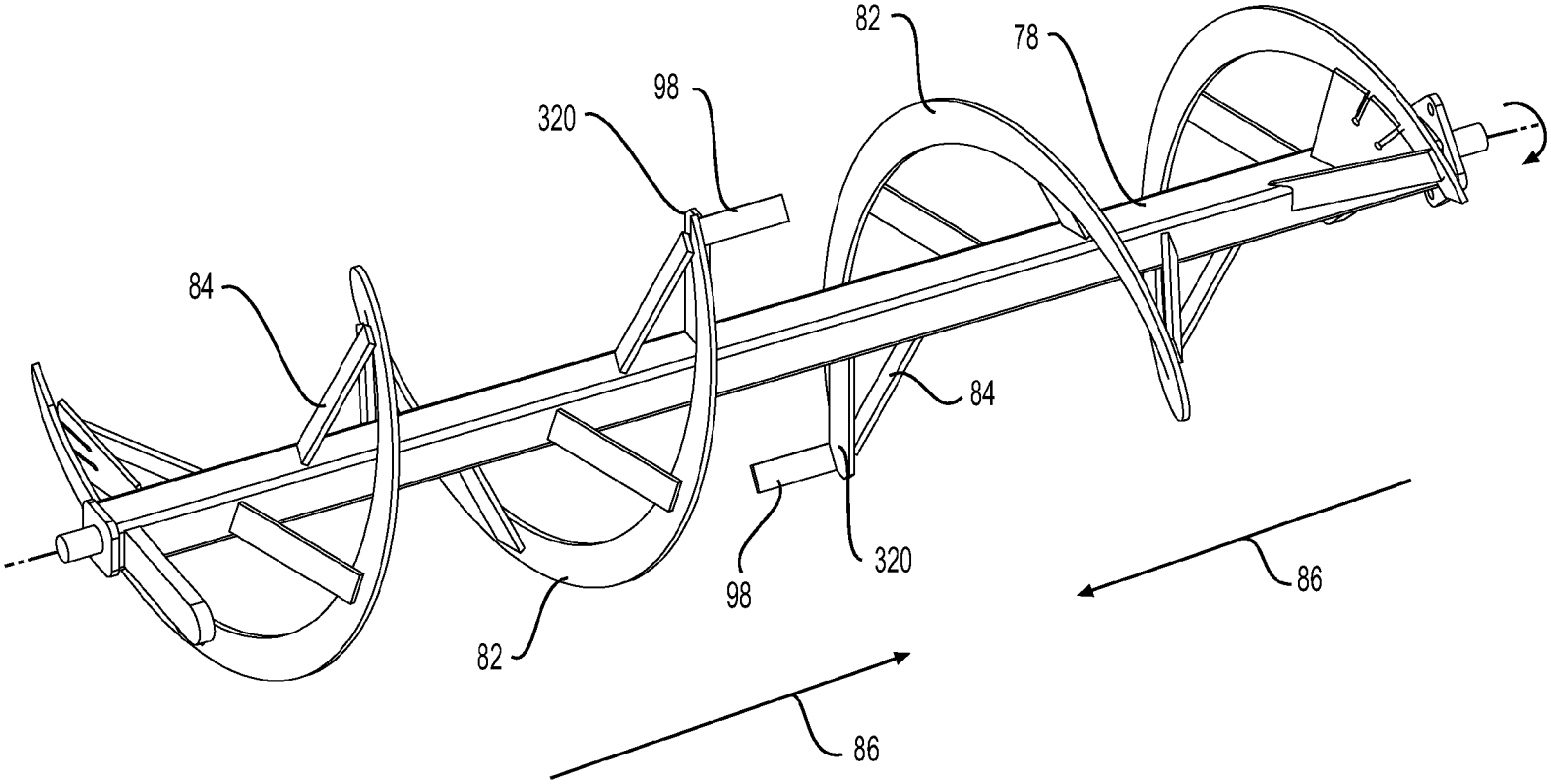
FIG. 29 is a perspective illustration of an embodiment of the screw-like tooth member and its snow shovel members.
Figure 30:
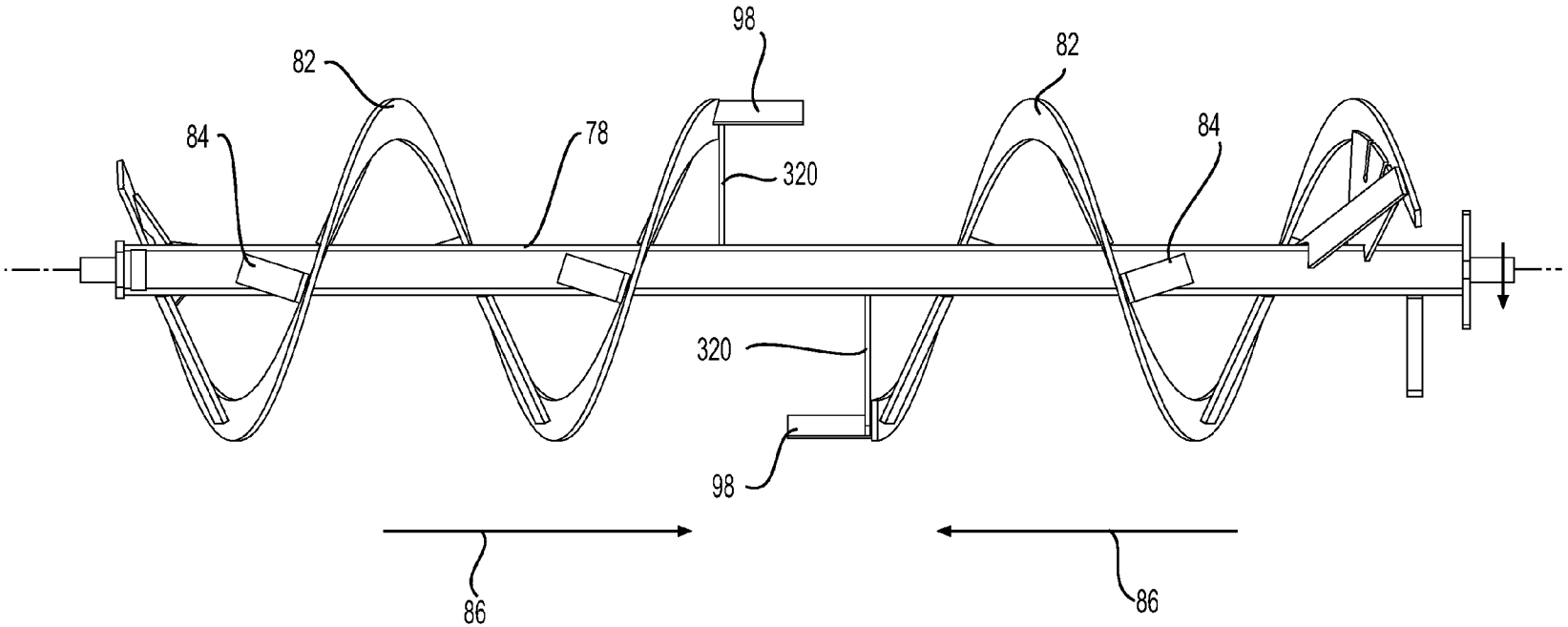
FIG. 30 is a perspective illustration of an embodiment of the screw-like tooth member and its snow shovel members.

A screw-like tooth member 82 with an alternative snow shovel members 98 is illustrated in FIG. 27 and FIG. 28. A pivotable pair of opposed snow shovel members 102 are illustrated. The snow shovel members 102 are mounted about a pivot axis 106 that is allowing the snow shovel members 102 to pivot 106 instead of being fixedly connected to the rotating axle 78. The pivotable snow shovel members 102 are adapted to pivot under the centrifugal force generated by rotating axle 78, or the lack thereof. The position of the pivotable snow shovel members 102 are also influenced by resistance offered by the snow that is contacted by the pivotable snow shovel members 102. For instance, when there is a significant amount of snow in front of the snowblower 10, the pivotable snow shovel members 102 are reacting by modifying their angles to adjust to the restriction caused by the amount of snow. The pivotable snow shovel members 102 are thus preventing the snow shovel members 102 to push back snow toward the front of the snowblower 10 because they are pivoting under the load of the snow and their own weight. In contrast, when there is little snow in front of the snowblower 10, the pivotable snow shovel members 102 are adapted to extend under the centrifugal force generated by the rotation of the rotating axle 78 and shovel the snow in the snowblower 10. Another benefit provided by the pivotal configuration of the snow shovel members 102 is their resilience when contacting a foreign object hence preventing serious damages to the equipment and/or the foreign object. Moving now to FIG. 29 and FIG. 30 illustrating another embodiment of the invention with the snow shovels members 98 secured on one side, their distal side, to the screw-like tooth member 82 in cantilever. This alternative configuration allows for removal of the radial member 320. The snow shovels members 98 of this embodiment are adapted to include individually or collectively the specifics described in respect with the other embodiments without departing from the scope of the present invention.

Figure 31:
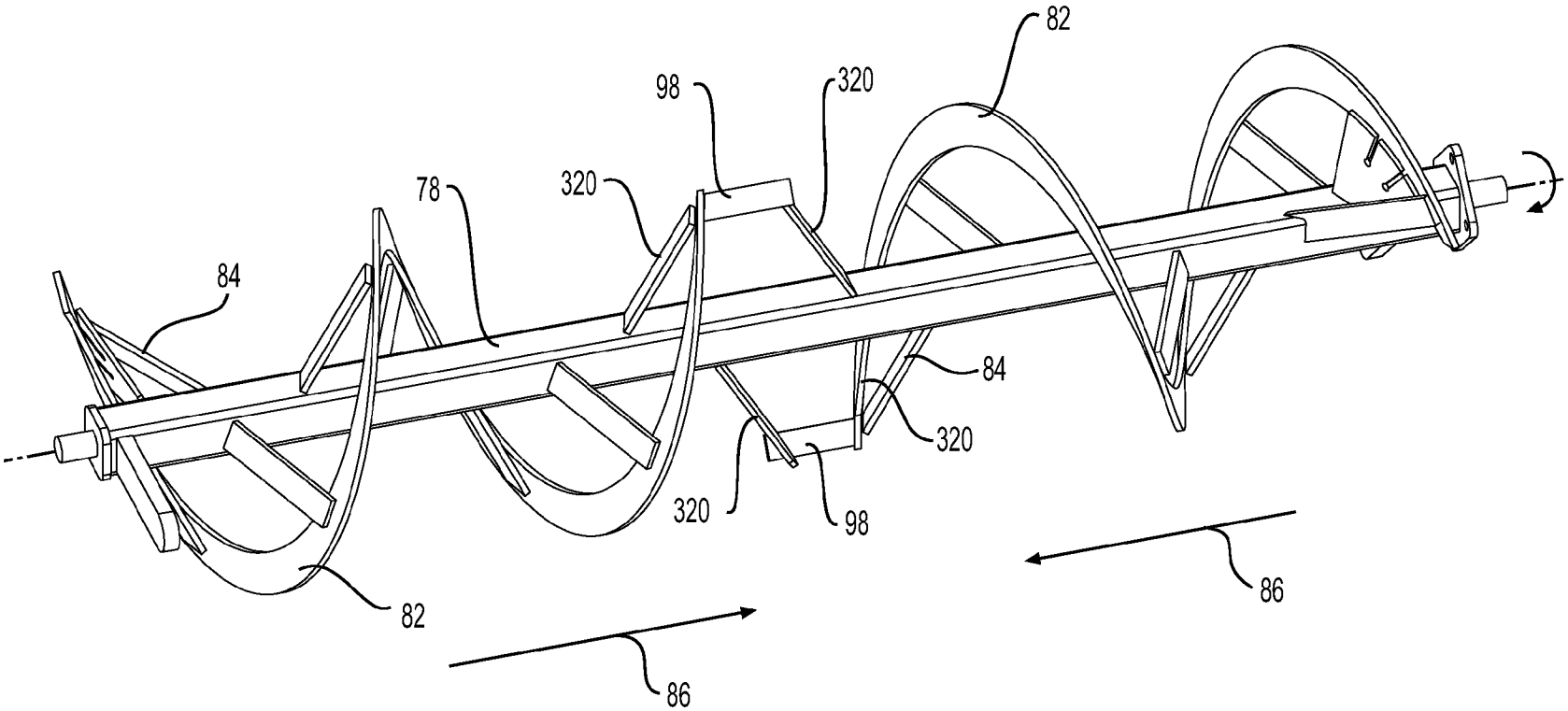
FIG. 31 is a perspective illustration of an embodiment of the screw-like tooth member and its snow shovel members.
Figure 32:
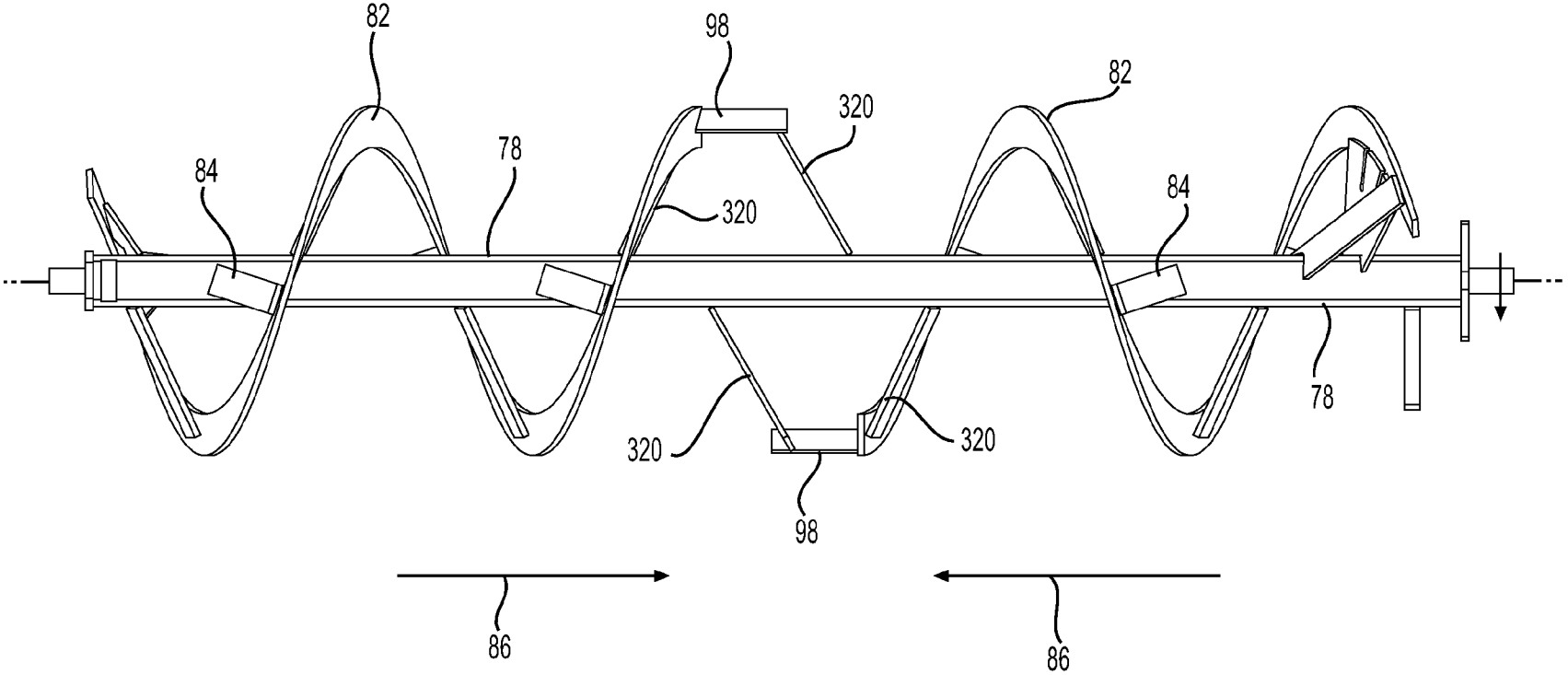
FIG. 32 is a perspective illustration of an embodiment of the screw-like tooth member and its snow shovel members.

In respect with FIG. 31 and FIG. 32 illustrating another embodiment of the invention with the snow shovels members 98 secured on one side, their distal side, to the screw-like tooth member 82 and on both sides with a radial member 320. The radial members 320 are illustrated in an angled configuration, however, they could alternatively be embodied with a different angle or perpendicular with the rotating axle 78. The snow shovels members 98 of this embodiment are adapted to include individually or collectively the specifics described in respect with the other embodiments without departing from the scope of the present invention.

Figure 33:
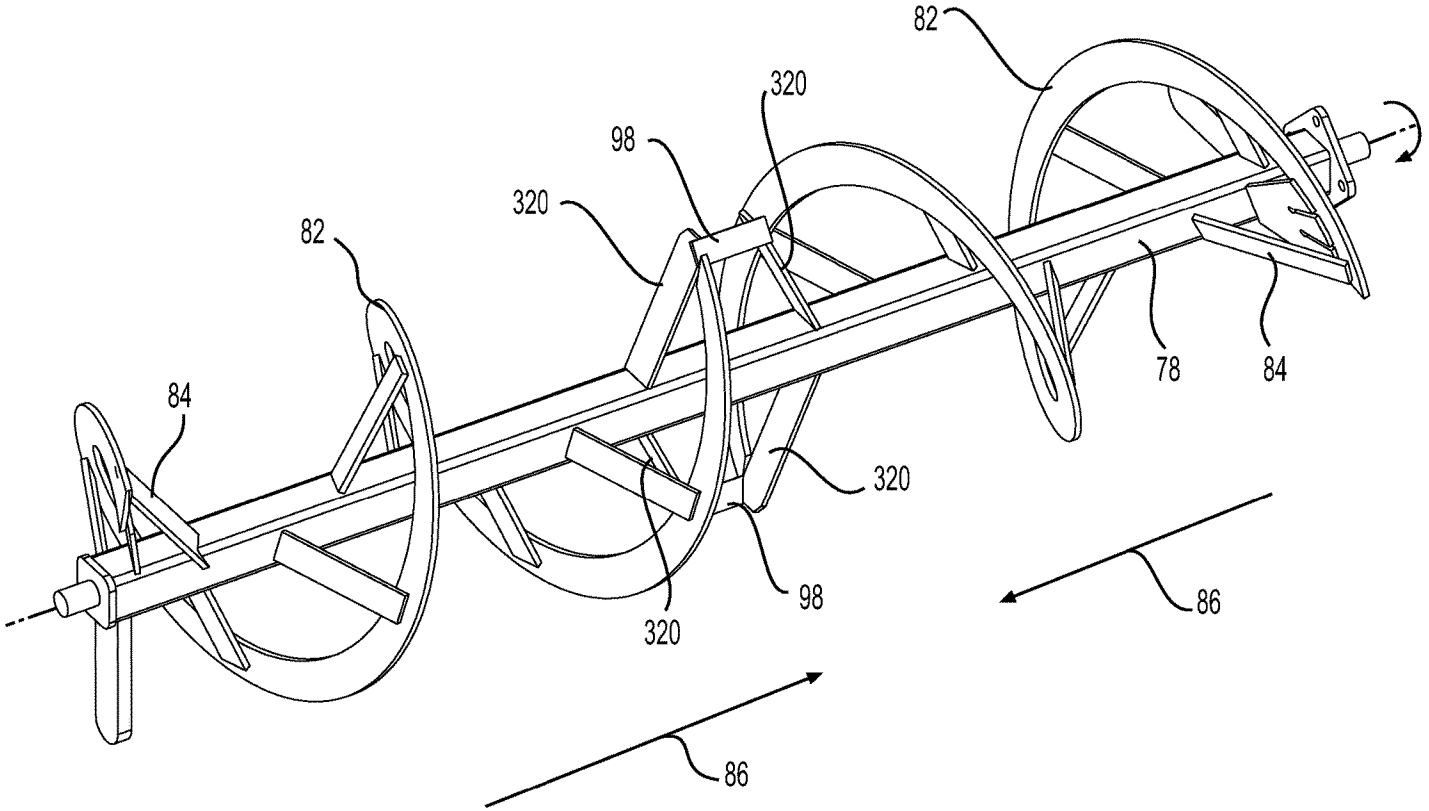
FIG. 33 is a perspective illustration of an embodiment of the screw-like tooth member and its snow shovel members.
Figure 34:
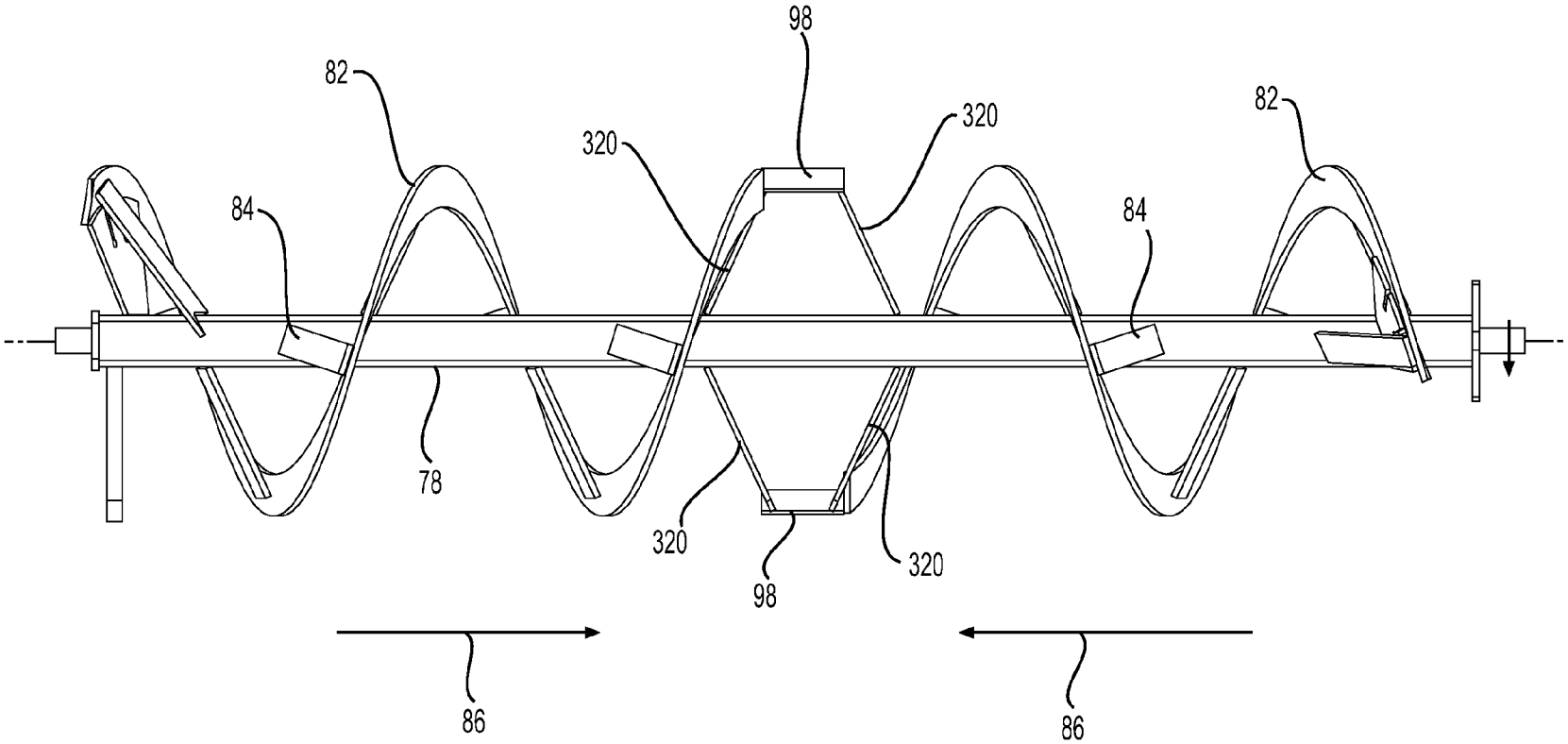
FIG. 34 is a perspective illustration of an embodiment of the screw-like tooth member and its snow shovel members.

In respect with FIG. 33 and FIG. 34 illustrating another embodiment of the invention with the snow shovels members 98 secured on both sides to the screw-like tooth members 82 and also on both sides with a radial member 320. This configuration provides added strength to the assembly because of the number of the members interconnected and also because the structure is three dimensional and triangular interconnections are stiff. The radial members 320 are illustrated in an angled configuration, however, they could alternatively be embodied with a different angle or perpendicular with the rotating axle 78. The snow shovels members 98 of this embodiment are adapted to include individually or collectively the specifics described in respect with the other embodiments without departing from the scope of the present invention.

Figure 35:
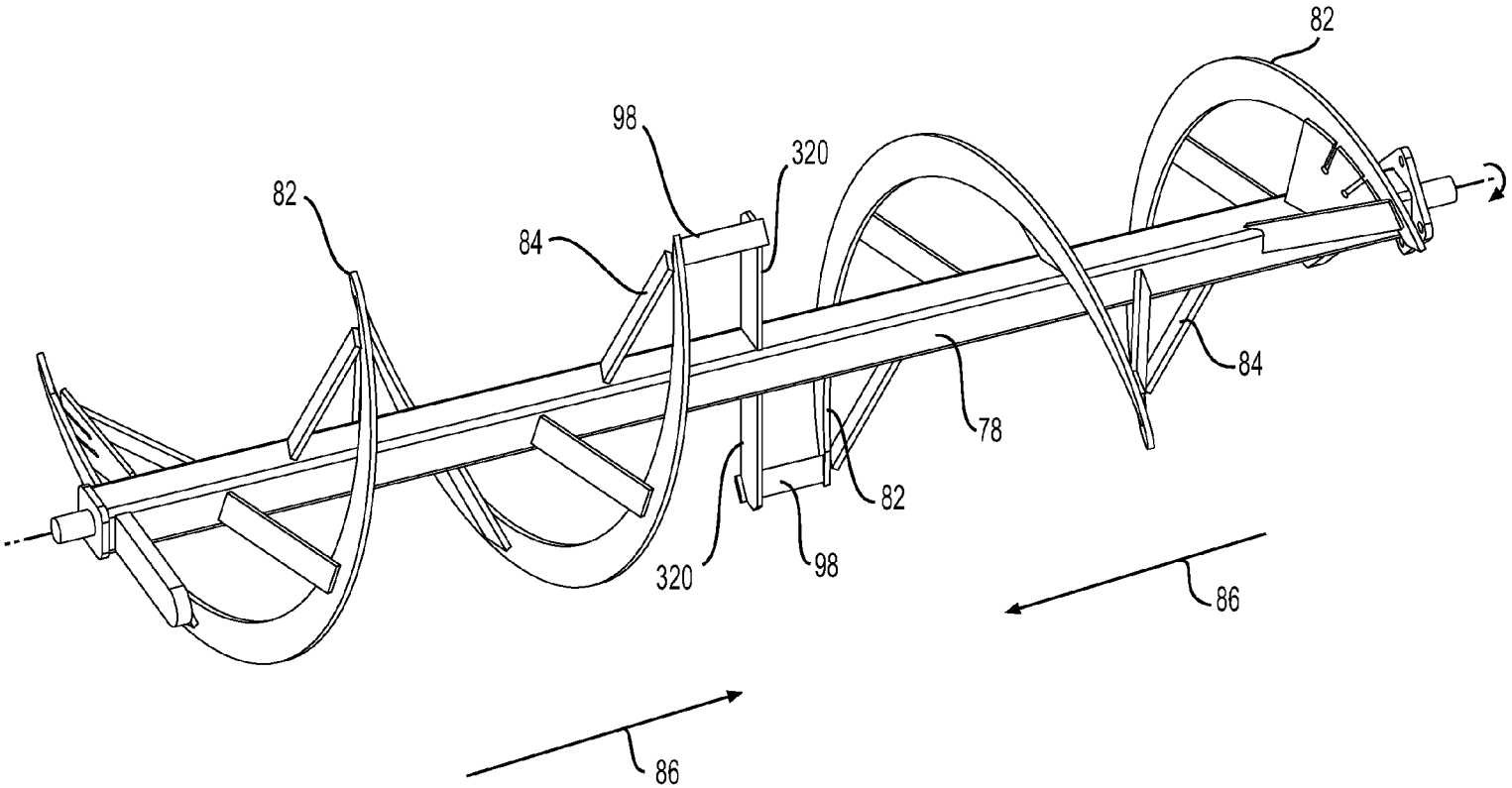
FIG. 35 is a perspective illustration of an embodiment of the screw-like tooth member and its snow shovel members.
Figure 36:
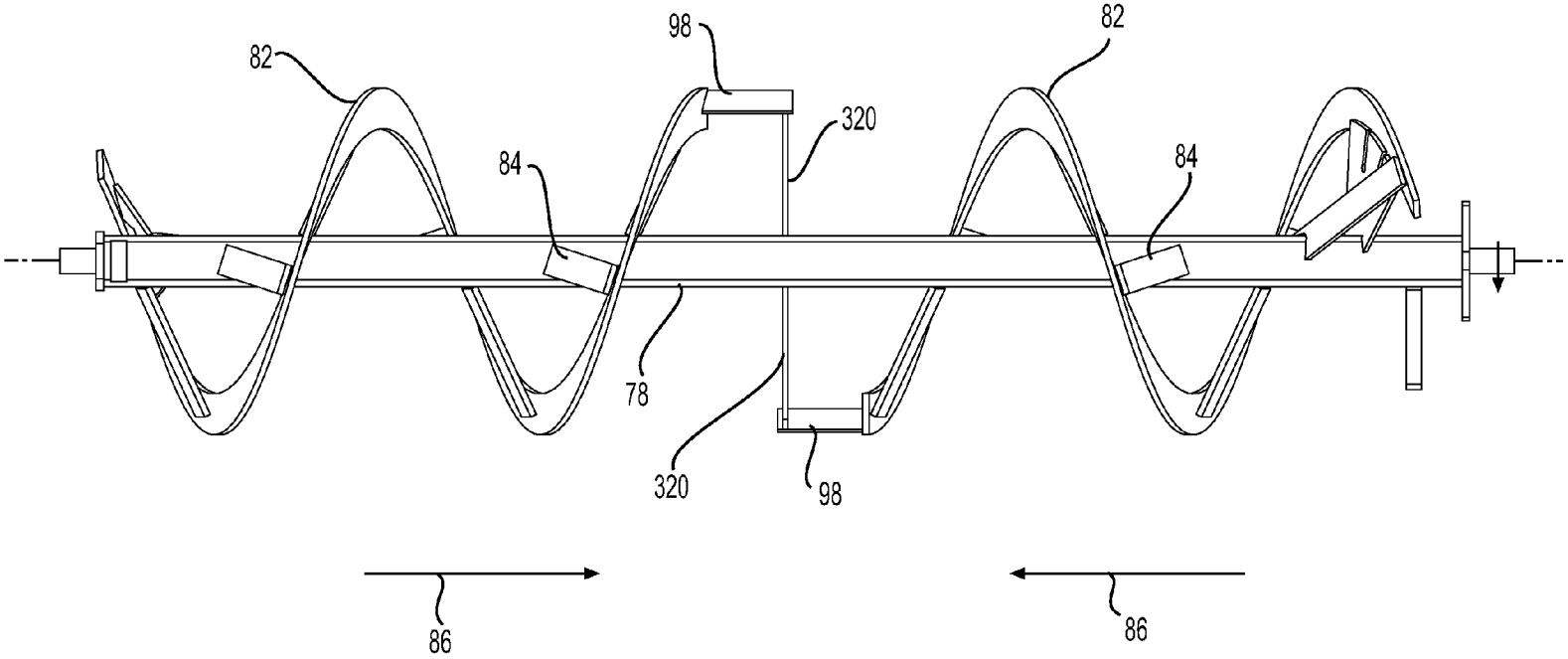
FIG. 36 is a perspective illustration of an embodiment of the screw-like tooth member and its snow shovel members.

In respect with FIG. 35 and FIG. 36 illustrating another embodiment of the invention with the snow shovels members 98 secured on one side to the screw-like tooth members 82 and also on both sides with a radial member 320. This alternative configuration provides added strength to the assembly because of the number of the members interconnected and also because the structure is three dimensional and triangular interconnections are stiff. The radial members 320 are illustrated in an angled configuration, however, they could alternatively be embodied with a different angle or perpendicular with the rotating axle 78. The snow shovels members 98 of this embodiment are adapted to include individually or collectively the specifics described in respect with the other embodiments without departing from the scope of the present invention.

Figure 41:
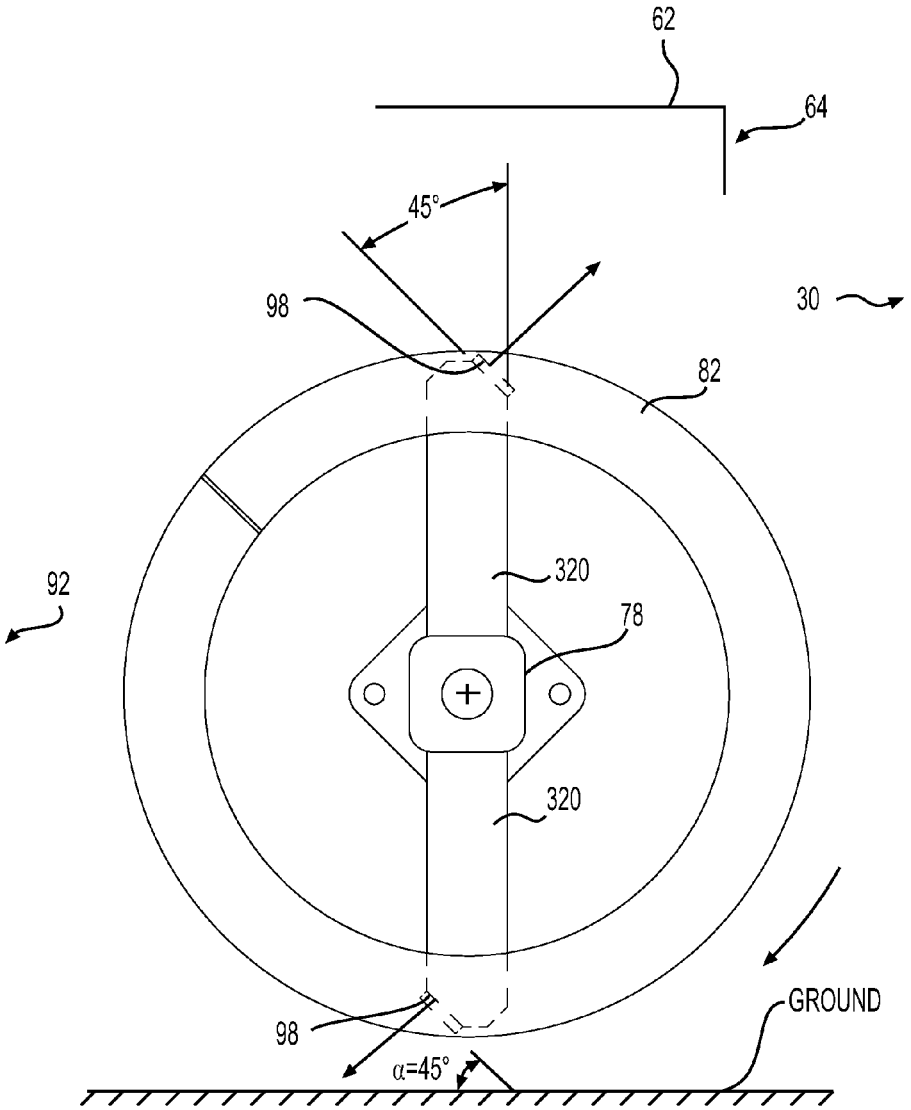
FIG. 41 is side illustration of an embodiment of the snow shovel members.

FIG. 37 throughout FIG. 41 depicts various exemplary angles α of the snow shovels members 98 in respect with the ground. Angles α of 90°, 80°, 65°, 55° and 45° are illustrated although other non-illustrated angles α are considered within the scope of the description. These embodiments are adapted to include individually or collectively the specifics described in respect with the other embodiments without departing from the scope of the present invention. These embodiments are also intended to be combined together and combined with the other embodiments described above.

Figure 42:
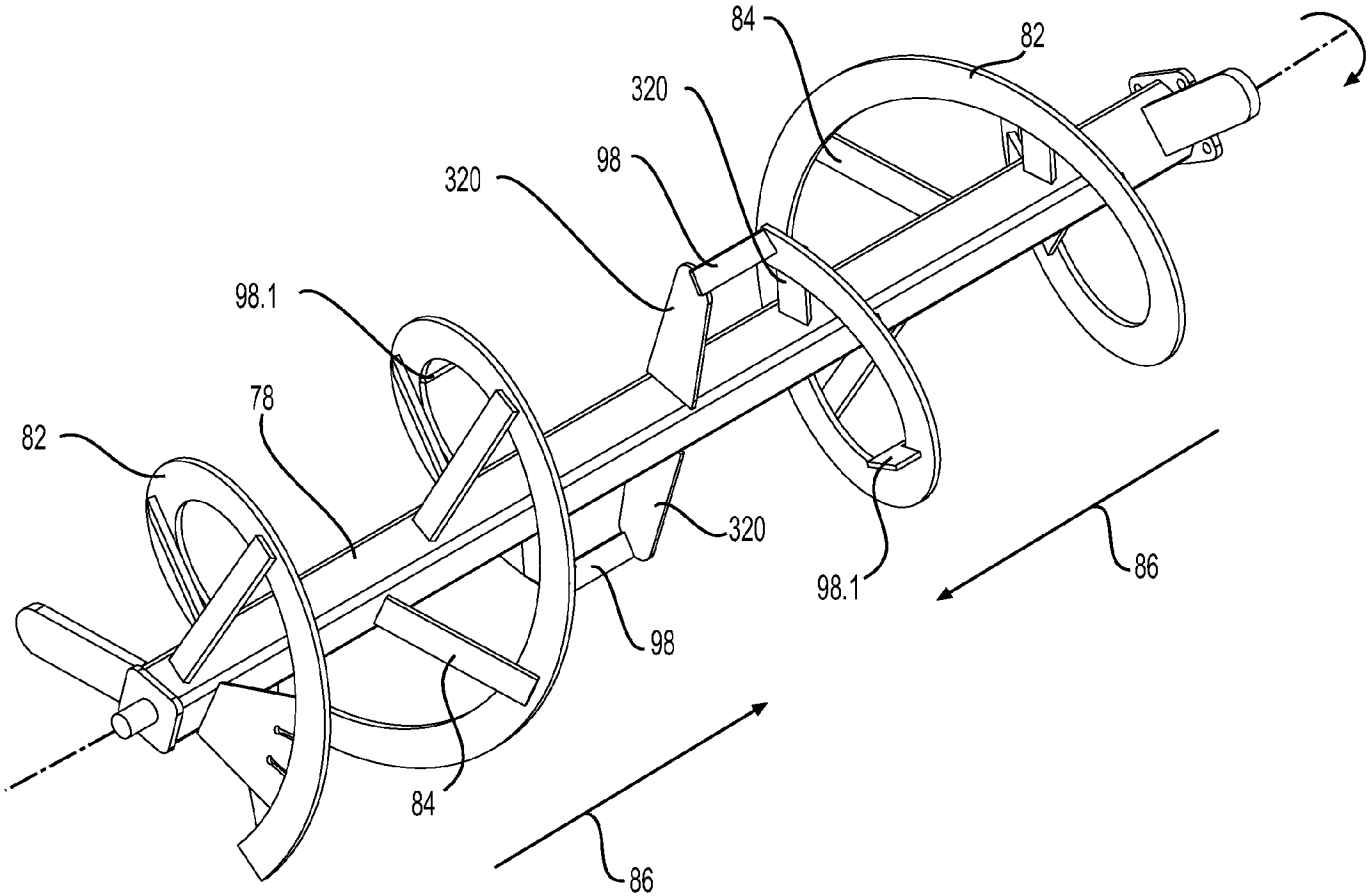
FIG. 42 is a perspective view of illustration of an embodiment of the screw-like tooth member and its snow shovel members.

FIG. 42 illustrates an additional embodiment using a pair of opposed radial members 320 secured, on a proximal side thereof, to the rotating axle 78 and secured, on a respective distal side thereof, to a snow shovel member 98. The snow shovel member 98 is also secured to the screw-like tooth member 82 nearby a distalmost radial portion of the screw-like tooth member 82. The snow shovel member 98 of the present embodiment is angled in a fashion that has been previously described. In the embodiment illustrated in FIG. 42, the snow shovel member 98 is angled to push snow toward the impeller 50 and also toward the ground to help prevent push snow away from the impeller 50 with the continuous rotation of the screw-like tooth member 82. One can appreciate the opposed radial members 320 are disposed on the rotating axle 78 placing the thin side in a way that the rotation of the radial member 320 has limited snow pushing capability while having an axial snow stopping capability. Additional secondary snow shovel members 98.1 are also optionally secured to the screw-like tooth member 82 to help manage snow in the middle region of the screw-like tooth member 82. A single pair of secondary snow shovels members 98 are illustrated in FIG. 42 although a different number of additional secondary snow shovel members 98.1 could be installed on the screw-like tooth member 82 without departing from the scope of the present application. It is also contemplated that the secondary snow shovel members 98.1 could be angled in respect with the ground and also, independently or collectively, be angled toward the middle region of the screw-like tooth member 82.

Figure 43:
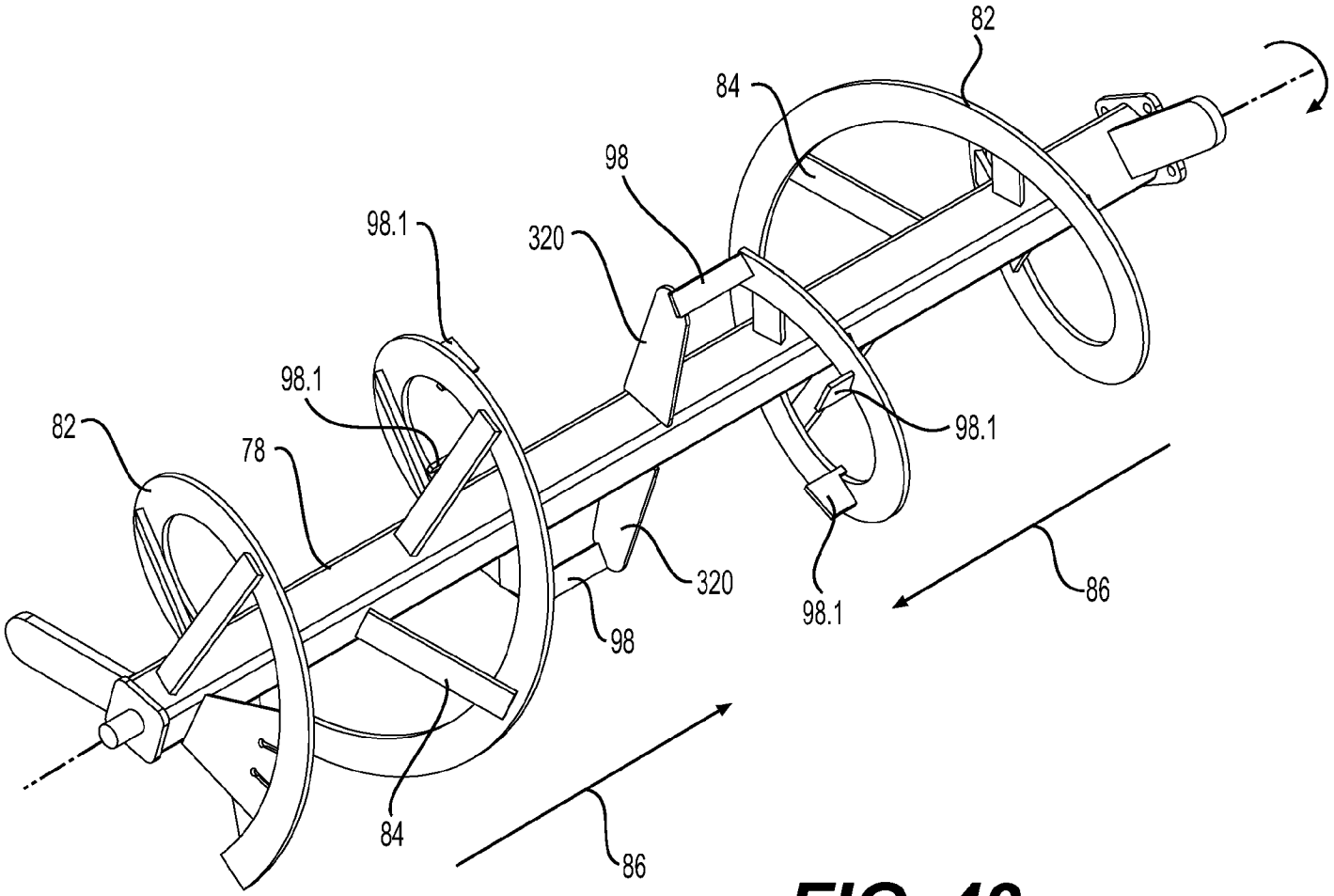
FIG. 43 is a perspective view of illustration of an embodiment of the screw-like tooth member and its snow shovel members.
Figure 44:
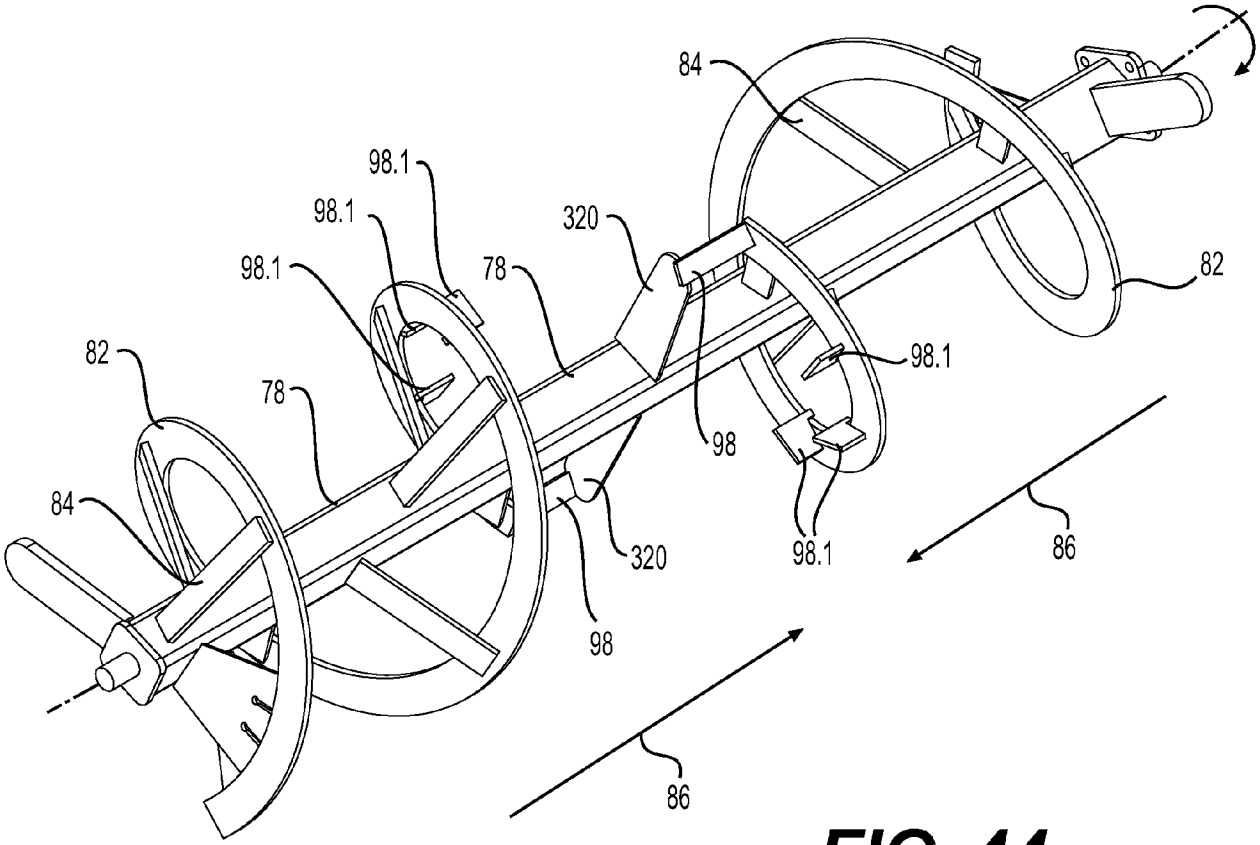
FIG. 44 is a perspective view of illustration of an embodiment of the screw-like tooth member and its snow shovel members.
Figure 45:
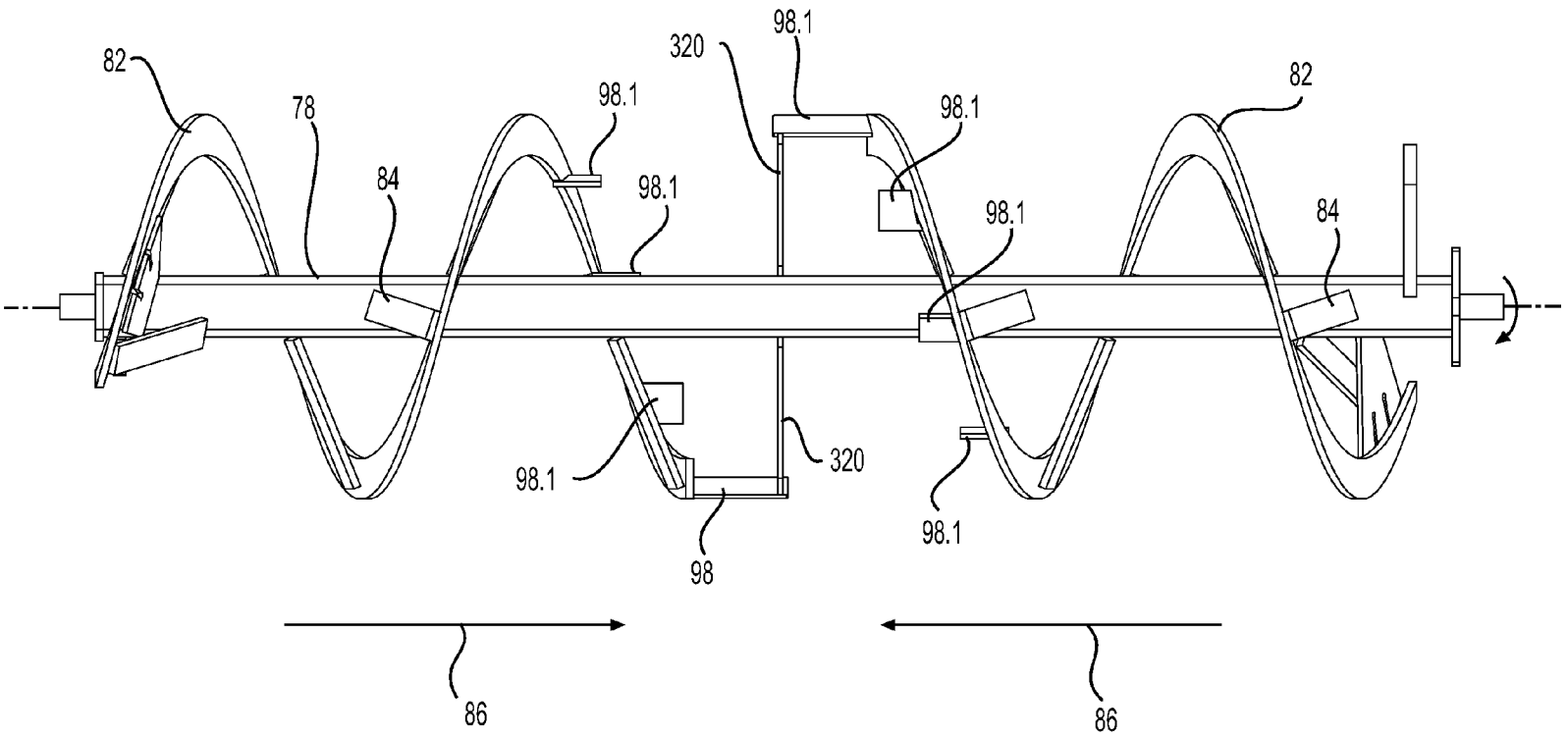
FIG. 45 is a front view illustration of an embodiment of the screw-like tooth member and its snow shovel members.

A plurality of secondary snow shovel members 98.1 is illustrated in FIG. 43, FIG. 44 and FIG. 45 to help manage snow in the middle region of the screw-like tooth member 82. It is contemplated that the secondary snow shovel members 98.1 could be angled in respect with the ground and also, independently or collectively, be angled toward the middle region of the screw-like tooth member 82. The geometry, the size, the locations and the number of secondary snow shovel members 98.1 can vary for properly managing different types of snow and ice conditions.

Figure 46:
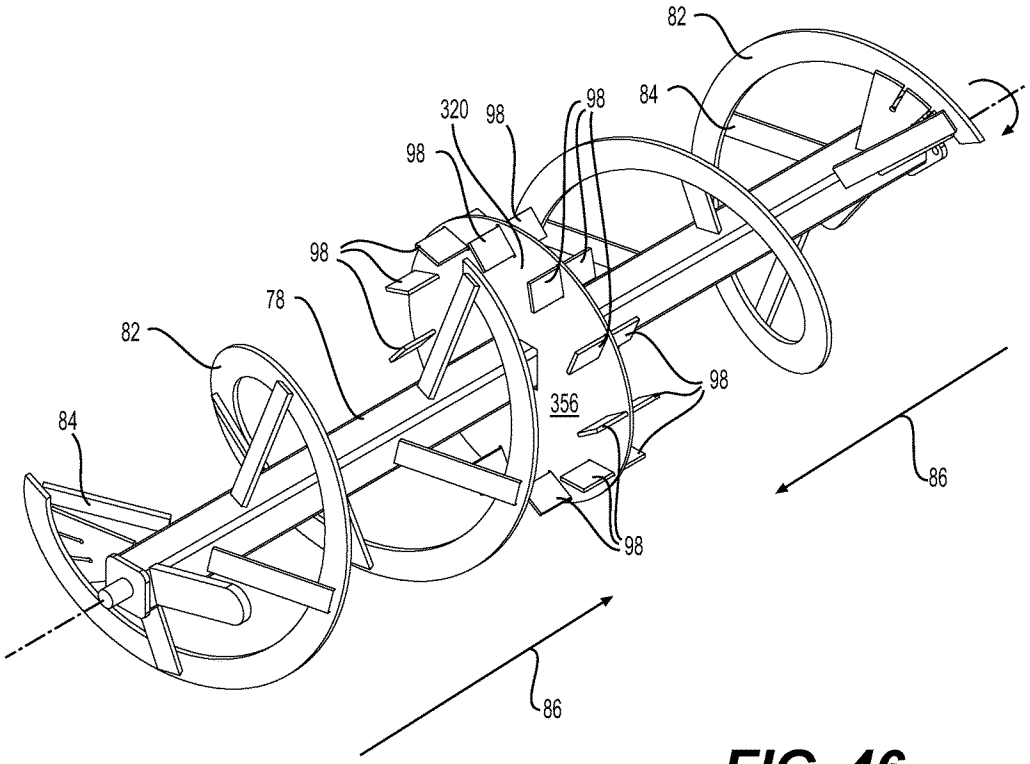
FIG. 46 is a perspective view of illustration of an embodiment of the screw-like tooth member and the snow shovel member.

An additional embodiment is exemplified in FIG. 46. A central member 356 is disposed about the center of the rotating axle 78 and/or centered about the center of the impeller 50 between the opposed screw-like tooth members 82. The central member 356 of the illustrated embodiment has a radial diameter of about the diameter of the screw-like tooth member 82. An array of snow shovel members 98 is secured on both axial sides of the central member 356 to increase the shoveling capability. The solid central member 356 of the illustrated embodiment also prevents snow moved toward the center of the rotating axle 78 to move further on the opposite side. In other words, it stops the movement of the snow right in front of the snow-blowing mechanism 74. The snow shovel members 98 are illustrated in a symmetrical arrangement on both sides of the central member 356 and could be alternated or disposed in a different fashion that remains within the scope of the present application. The continuous and circular central member 356 also prevents hitting sidewalks or any other object. The circular central member 356 is going to touch the object and the rotational movement of the circular central member 356 is going to make the central member 356 slips on the object as opposed to hit the object and prevent the rotating axle 78 to rotate. It is also within the scope of the present application that the snow shovel members 98 be proximally recessed in respect with the periphery of the central member 356 to let the central member 356 contacts the object first and freely slip thereon. The length, the angle and the number of snow shovel members 98 can also vary and variation thereof are contemplated by the present application despite the great number of possible variations are not expressly illustrated therein but can nonetheless be appreciated by a skilled reader in light of the specification considered in its entirety.

Figure 47:
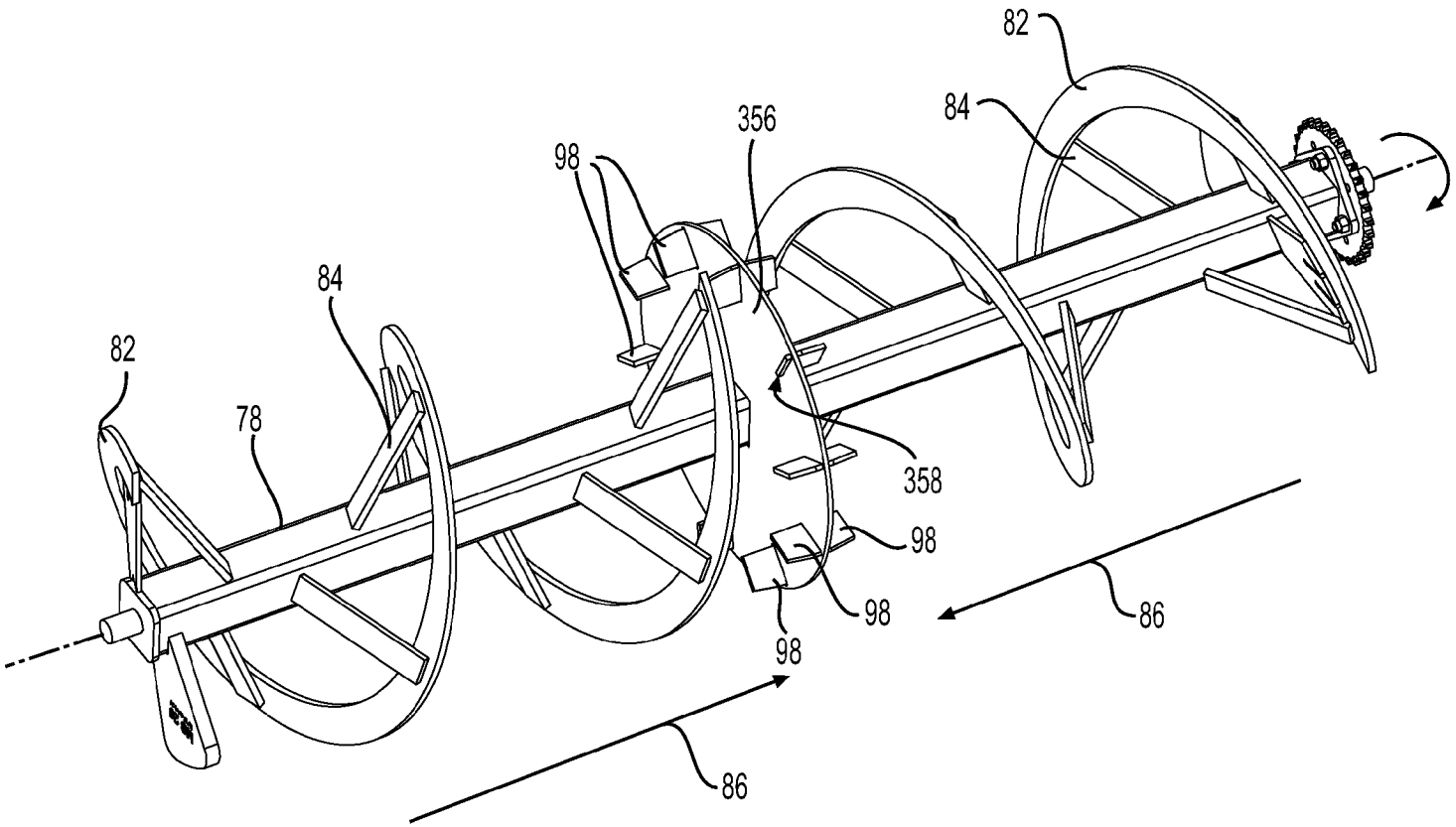
FIG. 47 is a perspective view of illustration of an embodiment of the screw-like tooth member and the snow shovel member.

FIG. 47 illustrates an embodiment where a snow shovel member 98 is missing (at location identified by numeral reference 358). The snow shovel member at location 358 is missing to prevent any snow to remain stuck in the narrow space created between the screw-like tooth member 84 and the central member 356 in the region nearby the connection between the screw-like tooth member 84 and the central member 356. The other side of the solid central member 356 is identical although it is not visible in FIG. 47.

Figure 48:
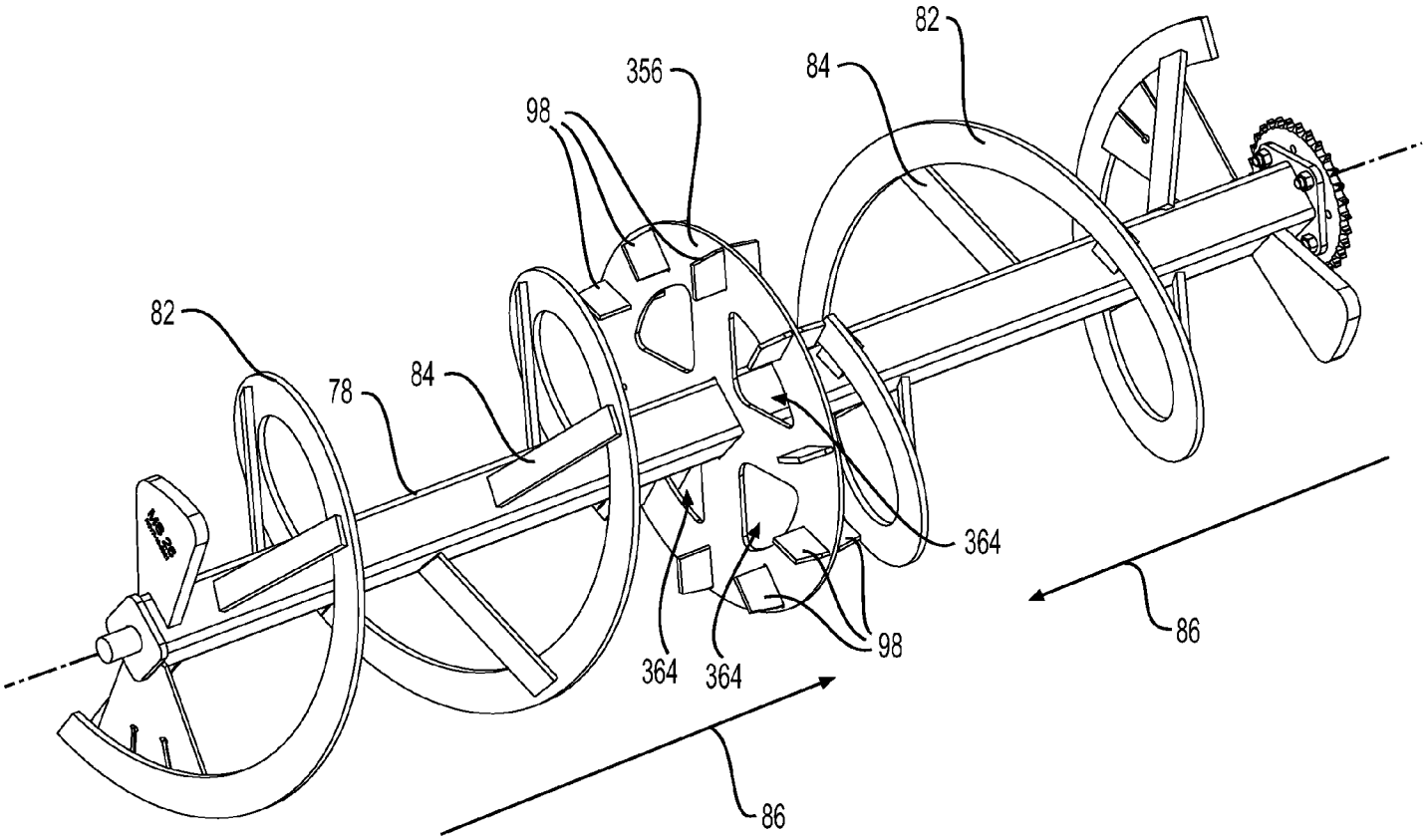
FIG. 48 is a perspective view of illustration of an embodiment of the screw-like tooth member and the snow shovel member.

Moving now to FIG. 48 illustrating the central member 356 with openings 364 therein. In the embodiment of FIG. 48, there are four openings 364 and it is contemplated by the present invention that other embodiments can be desirable with a different number of openings 364. The openings 364 are removing weight to the assembly and are also allowing limited air and snow passage therethrough. The size of the openings 364 can be adjusted to allow a predetermined amount of air and snow to pass therethrough. The number of snow shovel members 98 is embodied as 10 on each lateral side of the central member 356. The number of snow shovel members 98 can be modified according to snow conditions and tractor strength without departing from the scope of the invention. Similarly, the snow shovel members 98 are illustrated in pairs, one of each side of the central member 356. Other embodiments could omit some of the snow shovel members 98 and remain within the scope of the present application.

Figure 49:
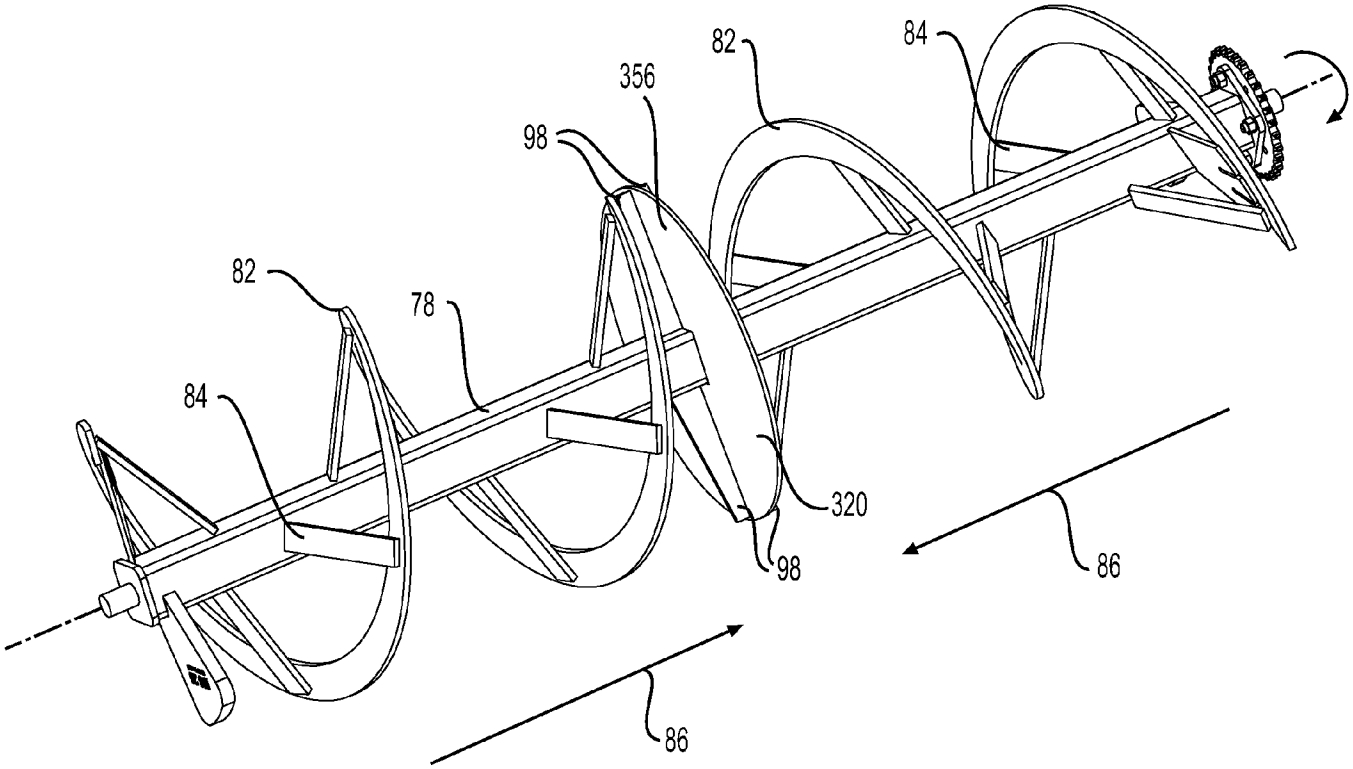
FIG. 49 is a perspective view of illustration of an embodiment of the screw-like tooth member and the snow shovel member.
Figure 50:
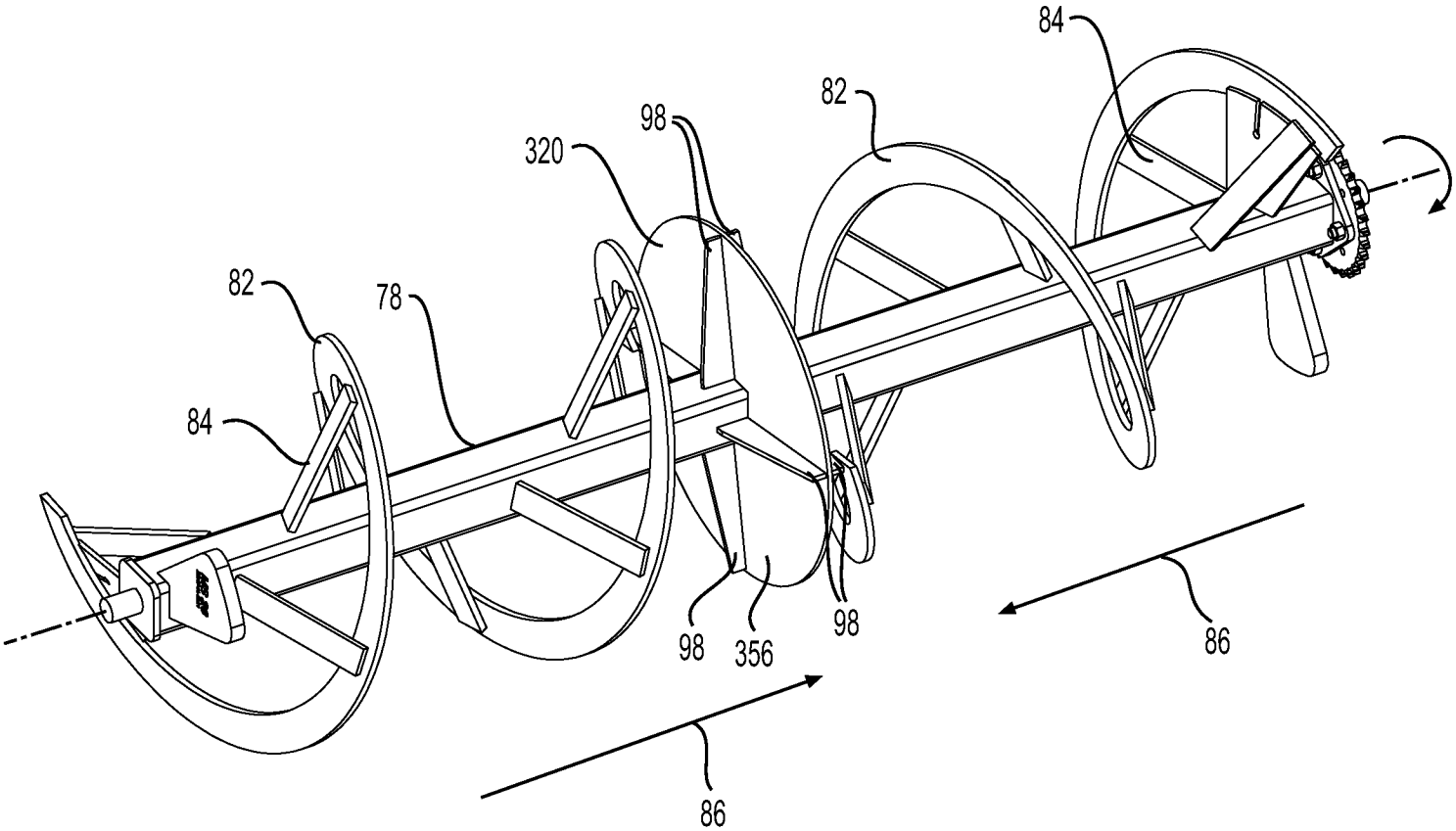
FIG. 50 is a perspective view of illustration of an embodiment of the screw-like tooth member and the snow shovel member.
Figure 52:
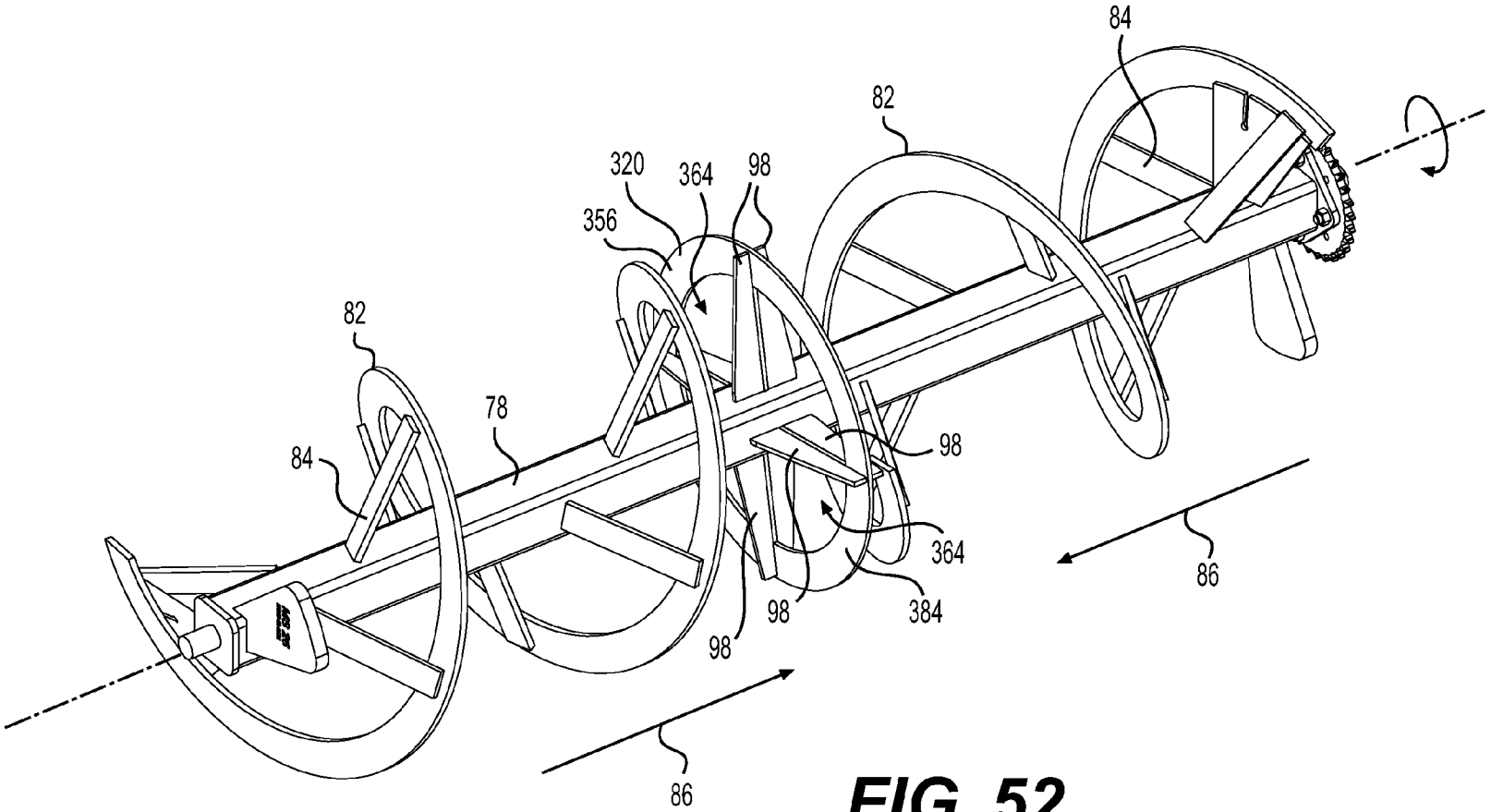
FIG. 52 is a perspective view of illustration of an embodiment of the screw-like tooth member and the snow shovel member.
Figure 53:
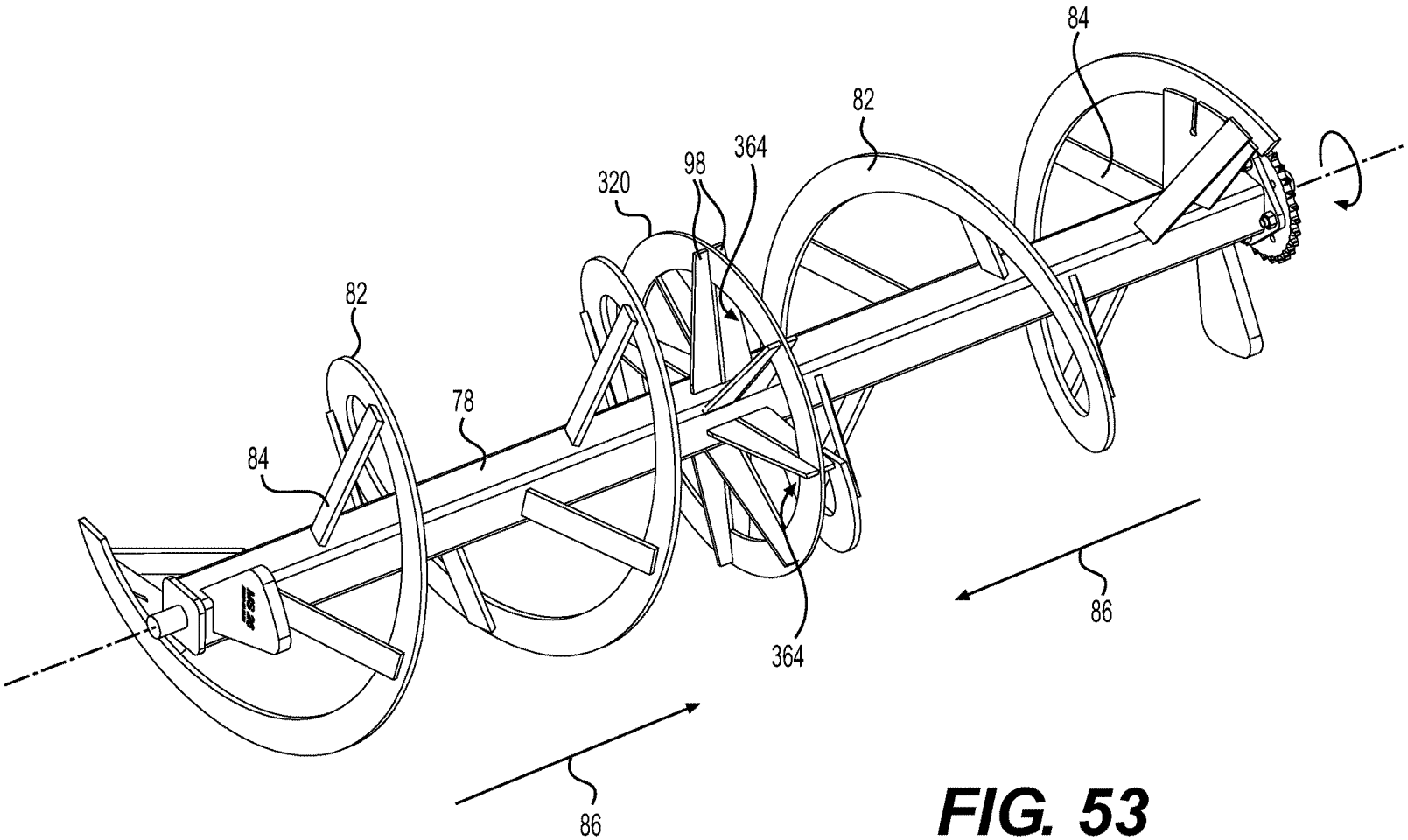
FIG. 53 is a perspective view of illustration of an embodiment of the screw-like tooth member and the snow shovel member.
Figure 54:
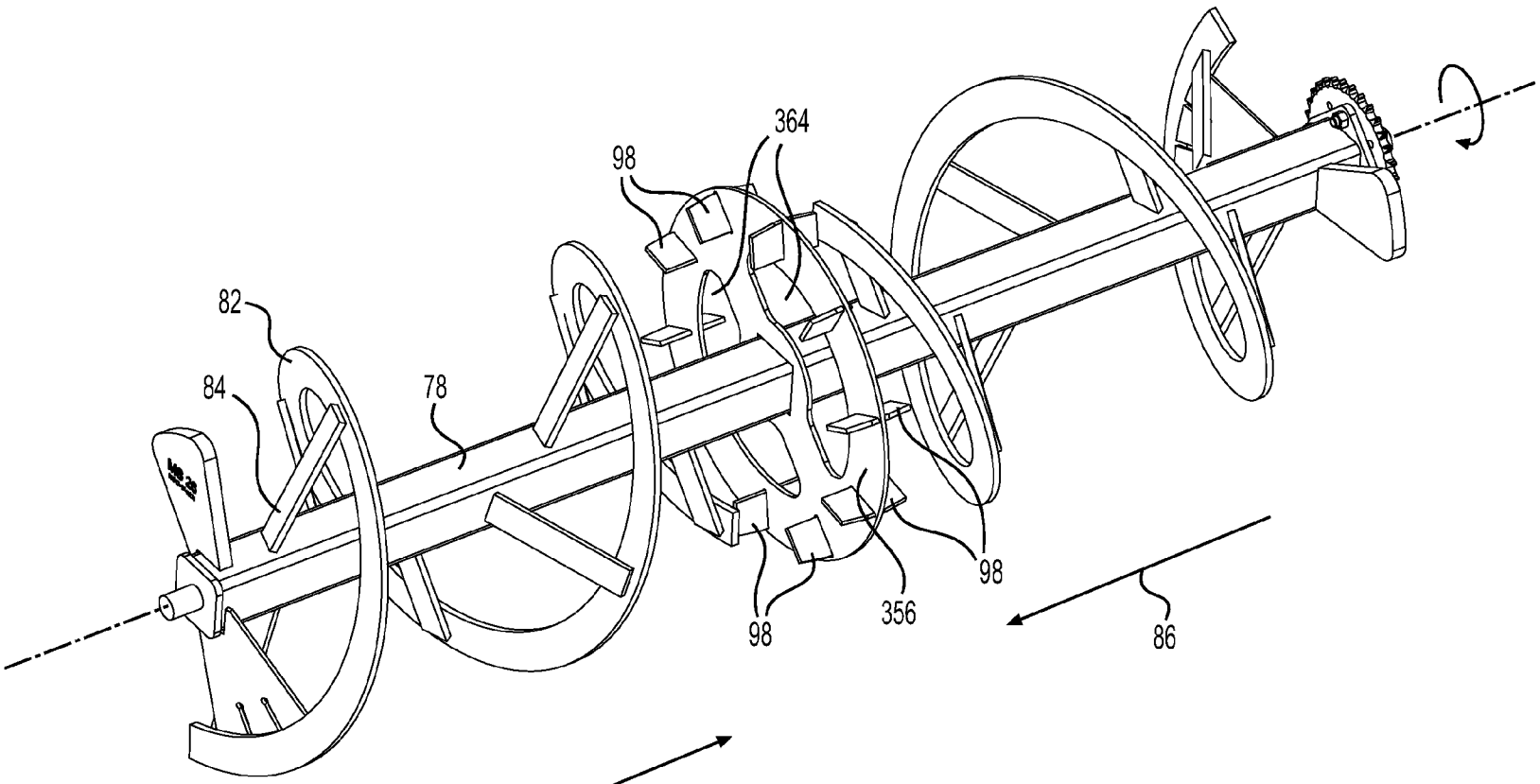
FIG. 54 is a perspective view of illustration of an embodiment of the screw-like tooth member and the snow shovel member.

FIG. 49 throughout FIG. 51 illustrate a solid central member 356 operating in association with radially extending snow shovel members 98. The snow shovel members 98 include a proximal side adjacent to the central member 356 and a distal side slightly outwardly taper. Similar snow shovel members 98 are illustrated in embodiments depicted in FIG. 52 and FIG. 53. These embodiments use a central member 356 comprising a circular shape, a ring shaped portion 384 held in place by the radial the snow shovel members 98. As it can be appreciated from FIG. 53, the number of radial the snow shovel members 98 can vary according to the desired amount of snow to be propelled with each revolution of the rotating axle 78, snow conditions and tractor strength, inter alia. In the embodiment of FIG. 53, six pairs of snow shovel members 98 are assembled in contrast with the four pairs of snow shovel members 98 embodied in FIG. 52. Again, the area of the central opening 364 can be adapted according to the desired amount of snow that can be exchanged from one side of the central member 356 to the opposite side and according to snow conditions and tractor strength, inter alia. Along similar principles, in contrast with the embodiment of FIG. 48 that includes four openings 356 in the central member 356, the embodiments of FIG. 54 includes two openings 356 in the central member 356. The size and the number of openings 356 in the central member 356 can be adapted to a desired strength of the central member 356 as well as the desired amount of snow that can be exchanged from one side of the central member 356 to the opposite side and according to snow conditions and tractor strength.

Figure 55:
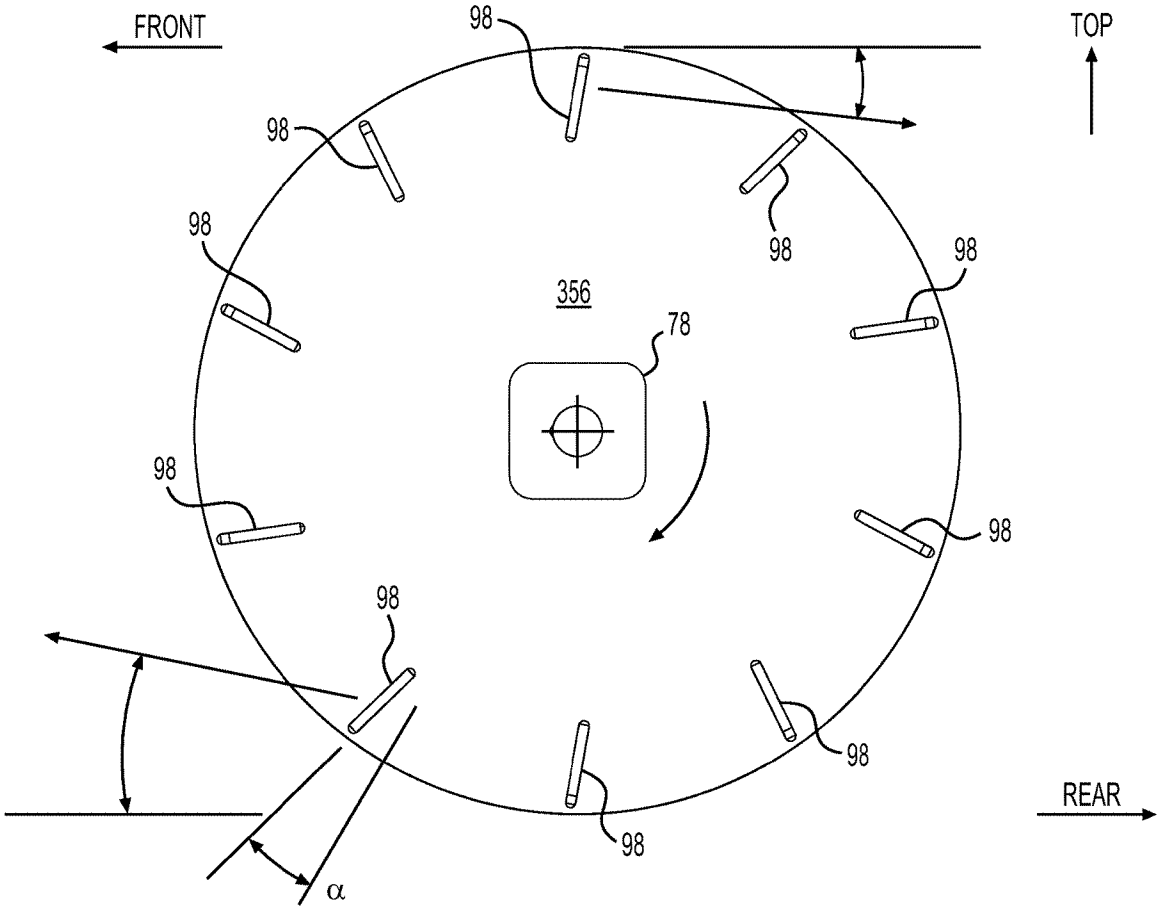
FIG. 55 illustrates an axial elevation view from the right side of an embodiment of the snow shovel members.

FIG. 55 illustrates an embodiment with the snow shovel members 98 are angled in the opposite direction as the snow shovel members 98 embodied in, inter alia, FIG. 41. In this embodiment, the snow shovel members 98 are propelling snow in the upper direction when collecting snow on the ground and in the downward direction when rotating above toward the rear of the snowblower 10. This embodiment elevates the snow from the ground hence facilitating the entry of the snow in the snow-blowing mechanism 74. The snow is propelled toward the ground when there is remaining snow on the snow shovel members 98 rotating about their upper rotational position. An angle $\alpha$ of 5 degrees to 35 degrees is contemplated. An angle $\alpha$ of 5 degrees to 25 degrees is also contemplated in another embodiment. An angle $\alpha$ of about 155 degrees is equally contemplated in another embodiment.

Figure 56:
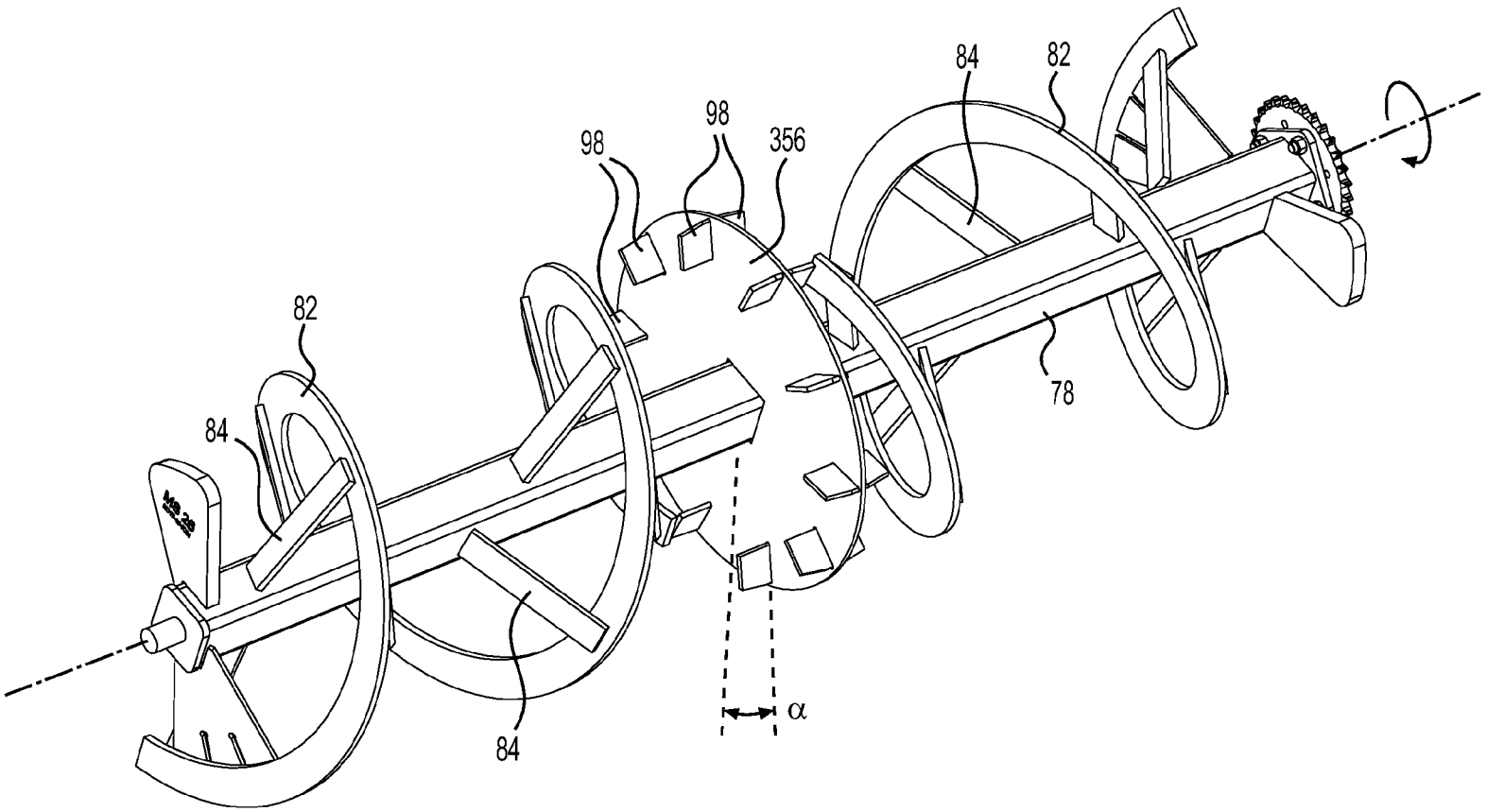
FIG. 56 is a perspective view of illustration of an embodiment of the screw-like tooth member and the snow shovel member of FIG. 55.
Figure 57:
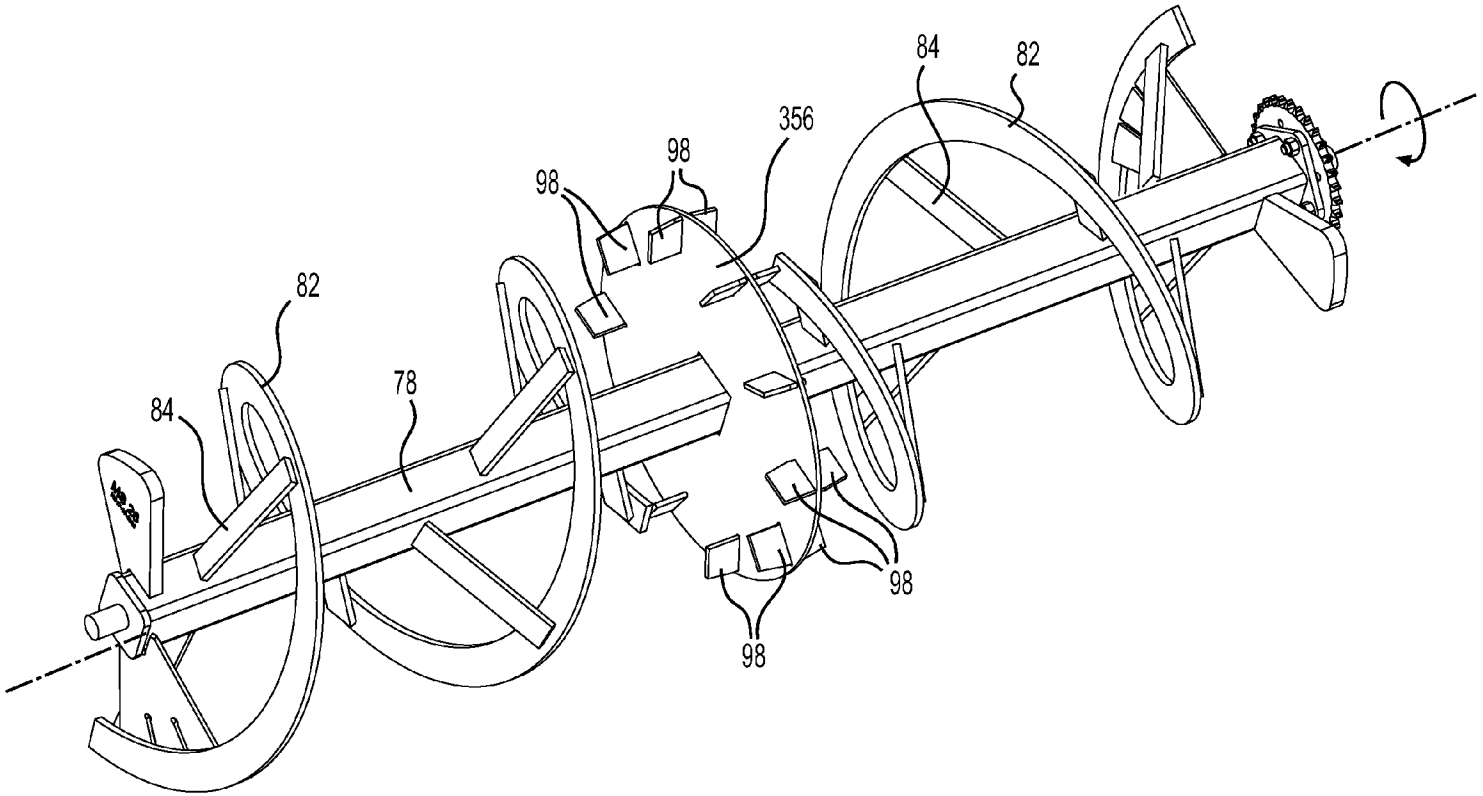
FIG. 57 is a perspective view of illustration of an embodiment of the screw-like tooth member and the snow shovel member.

FIG. 56 is illustrating the embodiment of FIG. 55 in the context of the mechanical assembly with the screw-like tooth member 82 and the rotating axle 78. An alternate embodiment is depicted in FIG. 57 where one can appreciate the uneven sequence of snow shovel members 98 disposed about the circumference of the central member 356. For instance, a snow shovel members 98 on one side of the central member 356 is the only snow shovel members 98 at this location on the central member 356. An alternate distribution of the snow shovel members 98 is contemplated in en embodiment of the invention.

The description and the drawings that are presented above are meant to be illustrative of the present invention. They are not meant to be limiting of the scope of the present invention. Modifications to the embodiments described may be made without departing from the present invention, the scope of which is defined by the following claims:

What is claimed is:

1. A snowblower comprising:

an auger including an axle and a screw member configured to rotate about an axis of rotation thereof, the screw member having two opposed screw member portions for displacing snow toward a snow-blowing mechanism;

a central member substantially orthogonally disposed along the axle between the two opposed screw member portions;

at least three snow shovel members, substantially disposed on the central member within a periphery of the central member and substantially axially disposed between the two opposed screw member portions, wherein the central member is generally separating the snow from the two opposed screw member portions, wherein at least one of the snow shovel members is axially secured in cantilever to the central member.

2. The snowblower of claim 1, wherein at least one of the snow shovel members is securing at least one of the opposed screw member portions to the central member.

3. The snowblower of claim 1, wherein at least some of the snow shovel members are radially disposed at an angle from the axis of rotation to propel snow with a vertical component toward an ascendant direction when the angled snow shovel members are moving at their highest point about the axis of rotation.

4. The snowblower of claim 1, wherein the snow shovel members are radially disposed in respect with the axis of rotation.

5. The snowblower of claim 1, wherein the snow shovel members are not evenly angularly distributed about the axis of rotation.

6. The snowblower of claim 1, wherein the central member includes an opening therein.

7. The snowblower of claim 6, wherein the opening is axially disposed about the axis of rotation.

8. The snowblower of claim 1, wherein the central member is adapted to restrict an axial flow of snow between the two opposed screw portions.

9. The snowblower of claim 1, wherein the periphery of the central member includes a diameter substantially similar to the diameter of the two opposed screw member portions.

10. An auger for a snowblower comprising:

an axle and a screw member configured to rotate about an axis of rotation thereof, the screw member having two opposed screw member portions for displacing snow toward a snow-blowing mechanism;

a central member substantially orthogonally disposed along the axle between the two opposed screw member portions;

at least three snow shovel members, substantially disposed on the central member within a periphery of the central member and substantially axially disposed between the two opposed screw member portions, wherein the central member is generally separating the snow from the two opposed screw member portions, wherein at least one of the snow shovel members is axially secured in cantilever to the central member.

11. The auger of claim 10, wherein at least one of the snow shovel members is securing at least one of the opposed screw member portions to the central member.

12. The auger of claim 10, wherein at least some of the snow shovel members are radially disposed at an angle from the axis of rotation to propel snow with a vertical component toward an ascendant direction when the angled snow shovel members are moving at their highest point about the axis of rotation.

13. The auger of claim 10, wherein the snow shovel members are radially disposed in respect with the axis of rotation.

14. The auger of claim 10, wherein the snow shovel members are not evenly angularly distributed about the axis of rotation.

15. The auger of claim 10, wherein the central member includes an opening therein.

16. The auger of claim 15, wherein the opening is axially disposed about the axis of rotation.

17. The auger of claim 10, wherein the central member is adapted to restrict an axial flow of snow between the two opposed screw portions.

18. The auger of claim 10, wherein the periphery of the central member includes a diameter substantially similar to the diameter of the two opposed screw member portions.

19. A snow shovel members kit for an auger for a snowblower, the kit comprising an axle including an axis of rotation thereof; and a screw member configured to rotate about the axis of rotation, the screw member having two opposed screw member portions for displacing snow toward a snow-blowing mechanism; the screw member comprising a central member substantially orthogonally disposed along the axle between the two opposed screw member portions; and at least three snow shovel members adapted to be substantially disposed on an auger, between two opposed screw member portions thereof, wherein at least one of the snow shovel members is axially secured in cantilever to the central member.

* * * * *